US012064015B2

(12) United States Patent
Richter et al.

(10) Patent No.: US 12,064,015 B2
(45) Date of Patent: Aug. 20, 2024

(54) CONNECTING APPARATUS

(71) Applicant: Fidlock GmbH, Hannover (DE)

(72) Inventors: David Richter, Hannover (DE); Joachim Fiedler, Hannover (DE); Breido Botkus, Hannover (DE)

(73) Assignee: Fidlock GmbH, Hannover (DE)

( * ) Notice: Subject to any disclaimer, the term of this patent is extended or adjusted under 35 U.S.C. 154(b) by 0 days.

(21) Appl. No.: 18/012,559

(22) PCT Filed: Nov. 30, 2021

(86) PCT No.: PCT/EP2021/083608
§ 371 (c)(1),
(2) Date: Dec. 22, 2022

(87) PCT Pub. No.: WO2023/098979
PCT Pub. Date: Jun. 8, 2023

(65) Prior Publication Data
US 2024/0099429 A1 Mar. 28, 2024

(51) Int. Cl.
*A44B 1/08* (2006.01)
*A41F 9/00* (2006.01)

(52) U.S. Cl.
CPC ..... *A44B 1/08* (2013.01); *A41F 9/00* (2013.01); *A44D 2203/00* (2013.01)

(58) Field of Classification Search
CPC ..... A44B 1/08; A41F 9/00; A44D 2203/00; Y10T 24/32
See application file for complete search history.

(56) References Cited

U.S. PATENT DOCUMENTS 8,739,371 B2 * 6/2014 Fiedler ..... A45C 13/1069 24/303
8,794,682 B2 * 8/2014 Fiedler ..... A45C 13/1069 24/303

(Continued)

FOREIGN PATENT DOCUMENTS

EP 3192388 B1 3/2020
EP 3616553 A1 3/2020
WO 2014090926 A1 6/2014

*Primary Examiner* — Robert Sandy
*Assistant Examiner* — Louis A Mercado
(74) *Attorney, Agent, or Firm* — The Webb Law Firm

(57) ABSTRACT

A connecting apparatus includes a first connecting part, which has a first basic body and at least one engagement protrusion arranged rigidly on the first basic body, and a second connecting part, which is attachable to the first connecting part in a closing direction and which has a second basic body with an engagement portion arranged rigidly on the second basic body. The first connecting part has a first magnetic device and the second connecting part has a second magnetic device. The first magnetic device and the second magnetic device interact in a magnetically attracting manner along the closing direction to assist the attachment of the first connecting part and the second connecting part to each other. The first connecting part has a blocking portion which is designed, in the connected position, to interact with the second connecting part in order to block the engagement of the engagement portion with the at least one engagement protrusion counter to an engagement direction. In the connected position, the second connecting part is rotatable about the closing direction with respect to the first connecting part. In the event of rotation, the engagement of the engagement portion with the at least one engagement protrusion and the blocking of the engagement by the blocking portion remains.

20 Claims, 52 Drawing Sheets

(56) References Cited

U.S. PATENT DOCUMENTS

| | | | | |
|---|---|---|---|---|
| 8,850,670 | B2 * | 10/2014 | Fiedler | A63C 11/2224 280/821 |
| 8,851,534 | B2 * | 10/2014 | Fiedler | H01F 7/0263 220/230 |
| 9,555,935 | B2 * | 1/2017 | Fiedler | A44B 11/258 |
| 9,677,581 | B2 * | 6/2017 | Tucholke | A44B 11/2584 |
| 9,907,367 | B2 * | 3/2018 | Paik | A41F 1/002 |
| 9,936,772 | B2 * | 4/2018 | Paik | A44B 11/2588 |
| 10,085,521 | B2 * | 10/2018 | Chen | A45C 13/1069 |
| 10,143,270 | B2 * | 12/2018 | Fiedler | A44B 11/2588 |
| 10,212,993 | B2 | 2/2019 | Fiedler et al. | |
| 10,376,022 | B2 * | 8/2019 | Duncan | A44C 5/2071 |
| 2011/0265289 | A1 * | 11/2011 | Wu | A45C 13/1069 24/303 |
| 2012/0248793 | A1 * | 10/2012 | Fiedler | A44B 11/2592 70/330 |
| 2015/0135486 | A1 | 5/2015 | Fiedler et al. | |
| 2020/0054101 | A1 | 2/2020 | Fiedler et al. | |

* cited by examiner

CONNECTING APPARATUS

CROSS-REFERENCE TO RELATED APPLICATION

This application is the United States national phase of International Patent Application Number PCT/EP2021/083608, filed Nov. 30, 2021, the disclosure of which is hereby incorporated by reference in its entirety.

BACKGROUND OF THE INVENTION

Field of the Invention

The disclosure relates to a connecting apparatus.

Description of Related Art

A connecting apparatus of this type comprises a first connecting part, which has a first basic body and at least one engagement protrusion arranged rigidly on the first basic body. In addition, the connecting apparatus comprises a second connecting part, which is attachable to the first connecting part in a closing direction and which has a second basic body with an engagement portion arranged rigidly on the second basic body, wherein the engagement portion can be brought along an engagement direction which is different from the closing direction into engagement with the at least one engagement protrusion of the first connecting part such that, in a connected position of the first connecting part and the second connecting part, the engagement portion is in engagement with the at least one engagement protrusion of the first connecting part. The first connecting part has a first magnetic device and the second connecting part has a second magnetic device. The first magnetic device and the second magnetic device interact in a magnetically attracting manner along the closing direction to assist the attachment of the first connecting part and the second connecting part to each other.

In the connecting apparatus, one or more engagement protrusions are formed rigidly on the first basic body of the first connecting part. The second connecting part can be brought into engagement with the at least one rigid engagement protrusion by an engagement portion of the second connecting part being brought into engagement with the at least one engagement protrusion of the first connecting part. The first connecting part and the second connecting part are attached to each other here along a closing direction, along which magnetic devices of the connecting parts provide a magnetic attraction force such that the connecting parts are drawn toward each other along the closing direction. By contrast, the engagement portion of the second connecting part is brought into engagement with the at least one engagement protrusion of the first connecting part along an engagement direction which is directed transversely with respect to the closing direction. In the connected position, the engagement portion is in engagement with the at least one engagement protrusion in a positive locking manner or non-positive locking manner such that the connecting parts are held on each other.

The fact that the engagement direction is different from the closing direction should be understood here as meaning that the engagement direction is directed perpendicular or at an oblique angle to the closing direction. The engagement direction here is not necessarily directed exactly perpendicular to the closing direction, but may be extended at an oblique angle to the closing direction. However, the engagement direction is not directed along the closing direction, in particular also not opposite to the closing direction.

In the case of a fastener apparatus for releasably connecting two parts, which is known from EP 3 616 553 A1, a first connecting part can be attached to a second connecting part in order to connect the connecting parts to each other. A shoelace which can be tensioned by connecting the connecting parts to each other is arranged here on one of the connecting parts.

EP 3 192 388 B1 discloses a fastener apparatus, in which a first connecting part has a rigid engagement protrusion and can be connected to a second connecting part. A belt or strap is arranged adjustably on the second connecting part.

In the case of a connecting apparatus of the type mentioned, it is generally desirable to enable connection of the connecting parts in a simple, comfortable and haptically pleasant manner for a user. The connection is intended here preferably to be permitted in a position-tolerant manner, with the connecting parts being unprecisely attached to each other. In a connected position of the connecting parts, a secure, loadable connection is intended to be provided.

SUMMARY OF THE INVENTION

It is an object underlying the proposed solution to provide a connecting apparatus in which the connecting parts can be attached to one another in a simple, comfortable manner and, in a connected position, provide a secure, loadable grip to each other.

This object is achieved by a connecting apparatus having features as described herein.

According thereto, the first connecting part has a blocking portion which is arranged rigidly on the first basic body and which is designed, in the connected position, to interact with the second connecting part in order to block the engagement of the engagement portion with the at least one engagement protrusion counter to the engagement direction. In the connected position, the second connecting part is rotatable about the closing direction with respect to the first connecting part. In the event of rotation, the engagement of the engagement portion with the at least one engagement protrusion and the blocking of the engagement by the blocking portion remain. The second connecting part is tiltable here with respect to the first connecting part in order, for separating the first connecting part and the second connecting part from each other, to remove the blocking counter to the engagement direction and to permit disengagement of the engagement portion and the at least one engagement protrusion.

The connecting parts are to be attached to each other along the closing direction, the attachment of the connecting parts to each other being assisted magnetically by the magnetic devices of the connecting parts. During the attachment, the connecting parts are drawn magnetically toward each other by the magnetic device and are also held magnetically on each other in the connected position.

During the attachment of the connecting parts, the engagement portion of the second connecting part enters into engagement with the at least one engagement protrusion of the first connecting part in the engagement direction, which points transversely or obliquely to the closing direction, and therefore, in the connected position, there is a positive locking or non-positive locking connection between the connecting parts, and the connecting parts are therefore held on each other in a loadable manner by the engagement of the engagement portion with the at least one engagement protrusion.

The engagement between the engagement portion of the second connecting part and the at least one engagement protrusion of the first connecting part is secured here, in the connected position, by the blocking portion of the first connecting part, formed rigidly on the first basic body of the first connecting part, by the blocking portion interacting in a blocking manner counter to the engagement direction with an associated portion of the second connecting part, and the engagement portion therefore not being able to be moved, at least without removing the blocking, counter to the engagement direction with the at least one engagement protrusion. Owing to the blocking effect of the blocking portion, the engagement portion is therefore blocked in its engagement with the at least one engagement protrusion, and therefore the connecting parts are secured in the connected position with respect to each other.

The connecting parts are held here in the connected position with respect to each other by the magnetic effect of the magnetic devices in such a manner that the connecting parts are blocked counter to the engagement direction with respect to each other by the blocking portion of the first connecting part. By means of a (pure) displacement movement counter to the engagement direction, the connecting parts therefore cannot be released from each other.

On the contrary, to release the connecting parts from each other, the connecting parts have to be tilted with respect to each other in order to move the second connecting part with respect to the first connecting part in a tilting plane, which is spanned by the closing direction and the engagement direction, in such a manner that the second connecting part can be moved counter to the engagement direction with the blocking portion. By tilting the second connecting part relative to the first connecting part, the blocking effect of the blocking portion can be removed, and therefore the second connecting part is moved beyond the blocking portion and thus the engagement portion of the second connecting part can be disengaged from the at least one engagement protrusion of the first connecting part.

By means of the blocking effect of the blocking portion arranged rigidly on the first basic body of the first connecting part, the second connecting part cannot be moved linearly counter to the engagement direction, but rather, in order to separate the connecting parts from each other, has to be tilted in a tilting plane defined by the closing direction and the engagement direction. The tilting movement can take place here about a defined tilting axis. However, the tilting movement can also take place along a curved movement path positioned in the tilting plane, wherein, as a result of the tilting movement, the second connecting part is tilted relative to the first connecting part. The tilting movement can be combined here with a rectilinear movement counter to the engagement direction and/or counter to the closing direction.

It should be noted that the connecting parts are tiltable with respect to each other in order to separate the connecting parts. However, the connection between the connecting parts is also not produced here in a rectilinear closing movement, but rather by the connecting parts being attached to each other in a wobbling manner by tilting with respect to each other and being brought into engagement with each other. The second connecting part can also tilt with respect to the first connecting part during the production of the connection in order to permit the engagement portion of the second connecting part to be brought into engagement with the at least one engagement protrusion of the first connecting part.

In the connected position, the second connecting part is rotatable about the closing direction with respect to the first connecting part. This can firstly permit an angle-tolerant attachment of the connecting parts to each other. In addition, it is thereby possible to rotate the second connecting part relative to the first connecting part when the connecting parts are in the connected position. In the event of rotation, the engagement portion and the at least one engagement protrusion maintain their engagement here. In addition, the blocking of the engagement by the blocking portion during rotation also remains. Rotation of the connecting parts with respect to each other about the closing direction in the connected position thereby does not lead to the connecting parts being separated from each other.

The rotatability between the connecting parts in the connected position can permit any desired rotational movement about any desired angle. However, it is also conceivable for the movement of the connecting parts to be limited to a predetermined angle of rotation, for example by means of stops or the like. The angle of rotation here is preferably greater than 10°, furthermore preferably greater than 20°, particularly preferably greater than 45° or even greater than 90°.

Owing to the fact that the at least one engagement protrusion is formed rigidly and nondeformably (in the event of a load acting as intended) on the first basic body of the first connecting part, the engagement protrusion, upon engagement with the engagement portion of the second basic body, can reliably absorb and dissipate forces. The at least one engagement protrusion is preferably formed integrally here with the first basic body of the first connecting part, the first basic body being designed overall to be rigid and nondeformable.

In this connection, "nondeformable" is intended to be understood as meaning a substantially stiff geometry and selection of the material of the basic body, which has the effect that the basic body of the first connecting part with the engagement protrusion formed thereon does not deform under a load as intended, i.e. the basic body is not elastic. For example, the basic body of the first connecting part can be formed from metal or a hard plastics material.

Similarly, the basic body of the second connecting part with the engagement portion formed thereon is rigid and nondeformable and, for this purpose, formed, for example, from metal or a hard plastics material.

The attachment of the connecting parts to each other is magnetically assisted. For this purpose, the first connecting part has a first magnetic device and the second connecting part has a second magnetic device. The first magnetic device and the second magnetic device interact in a magnetically attracting manner in the connected position and in particular also assist the attachment of the connecting parts to each other. The magnetic devices interact in a magnetically attracting manner along the closing direction such that the magnetic devices bring about a magnetic attraction force along the closing direction and draw the connecting parts toward each other along the closing direction during the attachment. The magnetic devices can each be formed, for example, by a permanent magnet. However, it is also possible to form one of the magnetic devices by a permanent magnet and the other of the magnetic devices by a magnetic armature and thus by a passively magnetic element.

In one embodiment, the second connecting part, for tilting relative to the first connecting part, can be lifted off the first connecting part counter to the closing direction on a side facing away from the at least one engagement protrusion. In the connected position, the second connecting part is in engagement with the at least one engagement protrusion on the first basic body of the first connecting part by the engagement portion, which is formed rigidly on the second basic body, this engagement being undertaken in a front region of the second connecting part—as seen with respect to the engagement direction. By means of a rear region with respect to the engagement direction, the second connecting part, in the connected position, can be lifted off from the first connecting part counter to the closing direction in order in this way to tilt the second connecting part relative to the first connecting part and thereby to remove the blocking effect of the blocking portion of the first connecting part such that the second connecting part moves with respect to the blocking portion of the first connecting part, and the engagement portion can be disengaged from the at least one engagement protrusion counter to the engagement direction.

In order to facilitate the handling for a user, the second connecting part can have, for example, an actuating portion, which can be grasped by a user for tilting the second connecting part relative to the first connecting part. The actuating portion can be formed, for example, by a tab in the rear region of the second connecting part, on which tab a user can pull in order to lift the second connecting part by the rear region from the first connecting part counter to the closing direction. However, the actuating portion may also be formed, for example, by a recessed grip or another gripping portion, on which a user can grip, in order in this way to tilt the second connecting part relative to the first connecting part.

In one embodiment, the at least one engagement protrusion is curved in an arcuate manner about the closing direction. If one (single) engagement protrusion is provided, the latter therefore extends in an arcuate manner about the closing direction. If a plurality of engagement protrusions are provided, each engagement protrusion can extend, for example, in an arcuate manner about the closing direction. Additionally or alternatively, the engagement protrusions can be lined up next to one another along a circumferential direction pointing around the closing direction, and therefore the engagement protrusions are lined up next to one another along an arcuate line and together produce an engagement with the engagement portion of the second connecting part when the connecting parts are in the connected position.

The at least one engagement protrusion extends about the closing direction by an angle of less than 180°, preferably less than 150°, in order to permit the engagement portion to be able to be brought into engagement in the engagement direction with the at least one engagement protrusion.

The at least one engagement protrusion preferably forms an undercut with respect to the closing direction. The at least one engagement protrusion is therefore undercut with respect to the closing direction by the at least one engagement protrusion projecting from an assigned portion of the first connecting part transversely with respect to the closing direction.

The undercut can be formed here by a surface extending perpendicular or obliquely (at an acute or obtuse angle) to the closing direction.

Equally, the engagement portion of the second connecting part preferably forms an undercut with respect to the closing direction. The engagement portion is therefore undercut with respect to the closing direction by the engagement portion projecting from an associated portion of the second connecting part transversely to the closing direction.

The undercut can be formed here in turn by a surface extending perpendicular or obliquely (at an acute or obtuse angle) to the closing direction.

In one embodiment, the engagement portion extends circumferentially about the closing direction. The engagement portion can be arranged here, for example, on a pin element and can protrude from the pin element transversely to the closing direction.

For example, the engagement portion is formed rotationally symmetrically with respect to the closing direction. This makes it possible to bring the engagement portion into engagement with the at least one engagement protrusion on the first connecting part in any desired rotational position of the second connecting part relative to the first connecting part such that there is engagement between the engagement portion and the at least one engagement protrusion in any desired rotational position of the second connecting part relative to the first connecting part, and the connecting parts can thus be rotated with respect to each other without the engagement of the engagement portion with the at least one engagement protrusion being removed.

In one embodiment, the second basic body of the second connecting part has a base portion.

In one embodiment, the base portion here can form the engagement portion such that the engagement portion for engagement with the at least one engagement protrusion of the first connecting part is formed on the base portion, for example on an encircling edge portion of the base portion.

In another embodiment, the engagement portion is spaced apart from the base portion along the closing direction. The engagement portion is therefore spatially separated from the base portion, for example by the base portion extending along a first plane and the engagement portion extending along a second plane, which is spaced apart along the closing direction from the first plane.

If the engagement portion is spatially spaced apart from the base portion, the engagement portion is formed, for example, on a pin element which protrudes from the base portion along the closing direction. The engagement portion protrudes here from the pin portion along the engagement direction and therefore forms an undercut such that the engagement portion can be brought into engagement with the at least one engagement protrusion of the first connecting part in order to produce a positive locking or non-positive locking connection.

The engagement portion can be formed, for example, circumferentially on the pin element. This makes it possible to provide a mushroom-shaped engagement element which can be brought in any desired rotational position into engagement with the at least one engagement protrusion of the first connecting part in order to connect the connecting parts to each other and to hold them on one another in the connected position.

If the engagement portion is spatially spaced apart from the base portion, the base portion can extend radially with respect to the closing direction further than the engagement portion and can therefore protrude radially over the engagement portion. The engagement portion is therefore in a radially inner position, while an outer edge of the base portion is arranged radially outside the engagement portion. In this way, good support of the second connecting part on the first connecting part can be provided via the base portion when the connecting parts are in their connected position.

In one embodiment, the base portion is, for example, in the form of a disk. In this case, the base portion can have, for example, a circular-cylindrical basic shape with a circular cross section.

A fastening portion, for example, via which a strap or belt is connected to the second connecting part can be formed on the base portion.

In one embodiment, the base portion of the second basic body of the second connecting part has an edge portion. By contrast, the first connecting part has a support portion formed rigidly on the first basic body, wherein, in the connected position, the edge portion is supported with the support portion for load absorption along the engagement direction—in addition to the engagement of the engagement portion and the at least one engagement protrusion. The edge portion can be formed, for example, in a front region of the base portion, wherein—in the case of a circular-cylindrical embodiment of the base portion—the edge portion can also encircle the base portion circumferentially. The support portion is formed in a front region of the first connecting part with respect to the engagement direction, and therefore the support portion can provide a support for the base portion in the engagement direction. In the event of loading of the second connecting part relative to the first connecting part in the engagement direction, the edge portion is therefore pressed against the support portion and therefore supported on the support portion. Via the edge portion, the base portion, in the connected position, can therefore enter into contact with the support portion on the first basic body of the first connecting part such that load forces can thereby be introduced from the second connecting part into the first connecting part.

It is conceivable here for the edge portion, in the connected position, to always be in contact with the support portion in the engagement direction. Alternatively, it can also be provided that, in an unloaded position, the edge portion is not in contact with the support portion in the engagement direction, but rather enters into contact with the support portion only in the event of loading of the connecting parts relative to each other.

Forces can advantageously be introduced from the second connecting part into the first connecting part via the support portion and the support of the edge portion of the base portion on the support portion. For example, in an embodiment of the connecting apparatus as a webbing fastener, a load direction, along which a force acts between the connecting parts during use of the connecting apparatus as intended, can preferably be directed at least with a direction vector component in the engagement direction. The load direction therefore extends at least approximately in the engagement direction or obliquely to the engagement direction, and therefore the load direction at least also points in the engagement direction, namely, in the case of vector decomposition, with a direction vector component. In a loaded state, the second connecting part is therefore (at least also) loaded in the engagement direction relative to the first connecting part and therefore in the direction of engagement with the at least one engagement protrusion formed rigidly on the first connecting part. The edge portion of the base portion enters here into supporting contact with the support portion, and therefore forces acting in the engagement direction are conducted away by the contact of the edge portion on the support portion. The at least one engagement protrusion serves here in particular for support along the closing direction and therefore for securing the grip of the connecting parts to each other, with load forces in the engagement direction primarily being absorbed and conducted away via the support portion.

In one embodiment, the support portion and the edge portion are curved in each case in an arcuate manner in a cross-sectional plane perpendicular to the closing direction. In the case of a circular-cylindrical embodiment of the base portion, the edge portion of the base portion encircles in a circular manner about the closing direction. The curvature of the support portion corresponds to the curvature of the edge portion of the base portion, and therefore, in the connected position, the base portion can enter into supporting contact with the support portion of the first connecting part.

In one embodiment, the support portion, as viewed along the closing direction, is spaced apart from the at least one engagement protrusion. The support portion here, as viewed along the closing direction, can extend above or below the at least one engagement protrusion.

Additionally or alternatively, the support portion, as viewed along the engagement direction, can be spaced apart from the at least one engagement protrusion. The support portion is therefore located, with respect to the engagement direction, at a different location from the at least one engagement protrusion. In particular, the support portion can be mounted upstream of the at least one engagement protrusion in the engagement direction such that the support portion is arranged radially outside the at least one engagement protrusion. In this way, favorable support can be provided by the support portion by the base portion being able, with a favorable lever arm, to enter into contact with the support portion when loading forces act between the connecting parts.

In one embodiment, the support portion is formed by a surface portion which is directed parallel or obliquely to the closing direction. The support portion is formed rigidly here on the first basic body of the first connecting part. In the event of loading, the support portion on the first connecting part enters into contact with the base portion of the second connecting part such that loading forces acting in the engagement direction can be absorbed and conducted away in a favorable manner.

In one embodiment, the base portion has a base surface and the first basic body has a bottom surface. The base surface and the bottom surface each extend perpendicular to the closing direction. In the connected position, the base surface on the base portion of the second connecting part and the bottom surface on the first basic body of the first connecting part face each other.

For example, in the connected position, there can be contact between the base surface and the bottom surface. When the connecting parts rotate about the closing direction relative to each other, the base surface and the bottom surface are therefore moved in a sliding manner on each other.

However, this is not compulsory. It is also conceivable that, in the connected position, there is a distance (and thus no contact) between the base surface and the bottom surface.

In one embodiment, the base portion is tiltable with respect to the first connecting part about a tilting axis perpendicular to the closing direction and to the engagement direction in order to tilt the connecting parts relative to each other. The connecting parts are therefore tilted, in order to separate the connecting parts from each other, by the fact that the base portion is tilted about a tilting axis relative to the first basic body of the first connecting part. The tilting axis can be defined here by a contact line between the base portion and the first basic body. However, it is also conceivable for the tilting axis to correspond to an imaginary line which extends through the base portion or outside the base portion and corresponds to a line about which the base portion is pivoted when the connecting parts are tilted relative to each other.

In one embodiment, the first basic body has an entry opening in which a portion of the base portion can enter when the second connecting part is tilted in the closing direction relative to the first connecting part. The entry opening can be formed in particular in a front region of the first basic body (with respect to the engagement direction) and can be formed, for example, as a depression on the first basic body. The base portion can enter the entry opening, in particular by means of a front edge portion, when the connecting parts are tilted with respect to each other (during the connection or separation).

The entry opening can be formed, for example, as a depression relative to the bottom surface of the first basic body. In this case, the entry opening adjoins the bottom surface, for example, but is recessed in relation to the bottom surface and therefore set back along the closing direction. The entry opening can extend here in particular below the at least one engagement protrusion and therefore, in the region of the at least one engagement protrusion, can provide a space, into which the base portion of the second connecting part can enter by means of the edge portion when the connecting parts are attached to each other in order to close the connecting apparatus and also when the connecting parts are separated from each other in order to open the connecting apparatus.

If the engagement portion is formed spatially separated from the base portion, the entry opening can, however, also be formed, for example, as a depression radially outside the at least one engagement protrusion and can provide a space for entry of an edge of the base portion.

In general, by means of play between the engagement portion of the second connecting part and the at least one engagement protrusion of the first connecting part, tilting of the connecting parts relative to each other in order to produce the connection and also for separation can be facilitated. Alternatively, a space for providing play can be provided, for example, by a bevel or rounded portion on the engagement portion, which makes it possible to tilt the engagement portion relative to the at least one engagement protrusion.

In particular if the engagement portion is formed on an encircling edge portion of the base portion, the entry opening is formed, for example, as a depression relative to a bottom surface of the first connecting part and adjoins the bottom surface in a region facing the support portion. The entry opening can be extended, for example, between the support portion and the bottom surface.

If the engagement portion is formed on a pin below the base portion and the base portion protrudes radially over the engagement portion, the entry opening is formed on the first basic body preferably radially outside the at least one engagement protrusion.

The entry opening can be designed as a depression or as a passage opening on the first basic body.

In one embodiment, the first basic body has a positive locking portion on which the base portion lies in the connected position of the first connecting part and the second connecting part in order to counteract tilting of the second connecting part relative to the first connecting part. The positive locking portion is formed in particular in a front region of the first basic body with respect to the engagement direction and is formed rigidly on the first basic body. The base portion is supported on the positive locking portion, in particular in the closing direction, and therefore tilting of the second connecting part relative to the first connecting part is at least made difficult by the support on the positive locking portion.

During the tilting in order to separate the connecting parts from each other, the second basic body is brought out of interaction with the positive locking portion on the first basic body by a slight movement counter to the engagement direction within the scope of play. In this case, play between the second connecting part and the blocking portion of the first connecting part, which permits a (slight) displacement movement of the second connecting part counter to the engagement direction, or play between the second connecting part and the at least one engagement protrusion, which permits a (slight) tilting movement and a subsequent displacement movement of the second connecting part counter to the engagement direction, can be provided. By means of the movement within the scope of the play, the second basic body passes out of operative connection with the positive locking portion, for example by the second basic body being conducted away from the positive locking portion, which is formed, for example, in the manner of a step. Subsequently, the connecting parts can be tilted (more strongly) with respect to each other, and therefore the connecting parts can be separated from each other.

The depth of the engagement protrusion, as measured along the engagement direction, can be greater here than the depth, as measured along the engagement direction, of the supporting surface provided by the positive locking portion, and therefore the third region is first of all conducted away from the positive locking portion and only subsequently, upon further movement counter to the engagement direction, does the engagement portion of the second connecting part become disengaged from the at least one engagement protrusion on the first connecting part.

The positive locking portion can be formed, for example, by a step on which the base portion rests in the connected position. The positive locking portion here can have in particular a surface portion which is directed perpendicular or obliquely to the closing direction and provides a support of the base portion.

In another embodiment, the positive locking portion can also be formed as an engagement opening, for example in the form of a notch, on the support portion. Via the positive locking portion, a support on the base portion perpendicular to the engagement direction, namely along the closing direction, is provided, and therefore the connecting parts in the connected position cannot readily tilt undesirably with respect to each other in the event of loading, but rather are supported against an (undesired) tilting via the positive locking portion.

In one embodiment, the positive locking portion, as viewed along the closing direction, is spaced apart from the at least one engagement protrusion. The positive locking portion can extend here, as viewed along the closing direction, above or below the at least one engagement protrusion.

In addition or alternatively, the positive locking portion, as viewed along the engagement direction, can be spaced apart from the at least one engagement protrusion. The positive locking portion is therefore located, with respect to the engagement direction, at a different location from the at least one engagement protrusion. In particular, the positive locking portion can be mounted upstream of the at least one engagement protrusion in the engagement direction, and therefore the positive locking portion is arranged radially outside the at least one engagement protrusion. In this way, a favorable support can be provided via the positive locking portion against tilting of the connecting parts with respect to each other by the base portion being able to enter, with a favorable lever arm, into contact with the positive locking portion when loading forces act between the connecting parts.

In one embodiment, the second connecting part has a blocking element, which is arranged rigidly on the second basic body, for interaction with the blocking portion of the first connecting part. The blocking element can be formed, for example, on the base portion and can protrude from the base portion along the closing direction. In the connected position, the blocking element interacts with the blocking portion of the first connecting part, and therefore a movement of the connecting parts with respect to each other counter to the engagement direction is blocked. However, by tilting of the connecting parts with respect to each other, the blocking element can be lifted over the blocking portion in order thereby to remove the blocking and to move the connecting parts relative to each other by tilting counter to the engagement direction such that the engagement between the engagement portion of the second connecting part and the at least one engagement protrusion of the first connecting part can be removed and the connecting parts can be separated from each other.

For example, the blocking element can be formed cylindrically and can have a circular shape, as viewed in a cross-sectional plane perpendicular to the closing direction. In the connected position, the blocking element is rotatable here about the closing direction with respect to the blocking portion, thus enabling the connecting parts to be rotatable relative to each other, wherein, in the event of rotation, the blocking of the engagement of the engagement portion with the at least one engagement protrusion remains, however.

In one embodiment, the first basic body has a recess which is delimited at least in sections by the blocking portion. In the connected position, the blocking element lies in the recess such that the engagement of the engagement portion with the at least one engagement protrusion is blocked counter to the engagement direction. The recess can be formed, for example, as a depression on a bottom surface of the first basic body of the first connecting part. The recess is therefore formed in the bottom surface. The blocking element is brought into engagement with the recess when the connecting parts are attached to each other, and therefore, by means of the engagement, the second connecting part is held on the at least one engagement protrusion of the first connecting part.

In one embodiment, the recess (in a cross-sectional plane perpendicular to the closing direction) is delimited by at least one boundary wall which realizes the blocking portion and extends along an arc of a circle. The recess can have, for example, a circular basic shape, in which the at least one boundary wall is extended in an arcuate manner along an (imaginary) circle which is centered with respect to an axis.

For example, the recess is delimited by two arcuate boundary walls which together form the blocking portion and, in the connected position, receive the blocking element of the second connecting part between them and thus block a movement counter to the engagement direction of the second connecting part relative to the first connecting part. The one or more boundary walls are arranged here, for example, at a right angle to the bottom surface and therefore provide support surfaces for the blocking element, and therefore, in the event of loading, the blocking element is supported on the boundary walls and is therefore blocked relative to the first connecting part.

In one embodiment, the blocking portion has a run-on slope. The run-on slope is designed to provide a sliding guide for the blocking element counter to the engagement direction when the second connecting part is tilted relative to the first connecting part. When the connecting parts are tilted relative to each other, for example, a blocking element of the second connecting part can enter into contact with the run-on slope such that the blocking element can run onto the run-on slope and therefore be moved beyond the blocking portion. By means of such a run-on slope, the separation of the connecting parts from each other can therefore be facilitated.

In one embodiment, the at least one engagement protrusion has, for example, a sliding slope which serves as a guide slope in order to guide the connecting parts, during the attachment to each other, in such a manner that the connecting parts can be brought into engagement with each other in an easy, preferably very substantially automatic manner. The sliding slope is preferably designed to guide the second connecting part, during attachment to the first connecting part, along the closing direction on the at least one engagement protrusion in such a manner that the second connecting part is offset with respect to the first connecting part counter to the engagement direction and, as a result, is moved past the at least one engagement protrusion. After it moves past, the second connecting part can then be brought in the engagement direction into engagement with the at least one engagement protrusion of the first connecting part. By sliding on the at least one engagement protrusion, the second connecting part is thus guided relative to the first connecting part in such a manner that the second connecting part is moved past the at least one engagement protrusion. If the second connecting part with its engagement portion has passed the at least one engagement protrusion, the engagement portion can be brought into engagement in the engagement direction with the at least one engagement protrusion on the first connecting part.

In one embodiment, a webbing fastener has a connecting apparatus as claimed in the proposed solution. In particular, the second connecting part can be connected here to a strap or belt, wherein the strap or belt can be arranged fixedly and nonadjustably, but optionally also adjustably, on the second connecting part.

The first connecting part can likewise be connected to a strap or belt, but can also be arranged fixedly on an associated assembly, for example a textile object or another object.

In one embodiment, during use of the connecting apparatus on a webbing fastener, the first connecting part has two engagement protrusions which are spaced apart from each other transversely with respect to the closing direction and transversely with respect to the engagement direction in such a manner that, in the connected position of the first connecting part and the second connecting part, the strap or belt can be guided through between the engagement protrusions. The strap or belt is therefore received between the engagement protrusions such that support of the second connecting part with respect to the first connecting part is provided on both sides of the strap or belt via the engagement protrusions.

In a different use, an object fastening device for fastening an object to an assembly can have a connecting apparatus of the described type. The object can be arranged here, for example, on one of the connecting parts, for example can be integrated in the connecting part. By contrast, the other of the connecting parts is arranged on the assembly, and therefore, by connection of the connecting parts, the object can be secured on the assembly.

The use possibilities listed below are intended to illustrate the versatility of the connecting apparatus, but should not be understood as limiting and in particular also not as conclusive. The connecting apparatus can thus be used for:

a helmet fastener,
a horse halter,
a removable (neck) pouch,
bags, rucksacks for rolltops, for closing with an (elastic) webbing
jacket fasteners (e.g. on the sleeve, lapel, button strip, or for tying up shirt sleeves)
roller blinds in motorhomes, privacy screens in caravans
convertible tops
awnings, tarpaulins, camping tents, guy ropes for tents
fastening or closing luggage bags or saddlebags (bike, motorcycle)
securing luggage and loads, or securing a bicycle/buggy in and to public transport vehicles
a sorting and securing system for use by tradespeople in a vehicle
a band fastener, restraint systems and fastening apparatuses for carrying devices,
chest straps, hip belts, shoulder straps
removable handgrips or carrying straps on bags
a sunshade for unfolding, e.g. on buggies
a movable and removable or openable connection of rucksack carrying straps
hanging means for clothes hangers
items of furniture, for example for fastening seat elements
sleeping bags, thermal mats, yoga mats (for rolling up and fastening)
a hand towel holder
a key holder
a belt
a tradesman belt with means for clipping on tools
removable carrying straps, e.g. on tools and garden equipment, handles for bags and electrical appliances
gloves, shoes, golf bags (for closing or fastening to one another)
mosquito protection in a buggy or tent
a suitcase strap, for example as a means of fastening items in a bicycle basket
for components and accessories on a bicycle (tacho, light, computer, electronic devices, etc.).

BRIEF DESCRIPTION OF THE DRAWINGS

The concept underlying the solution will be discussed in more detail below on the basis of the exemplary embodiments illustrated in the figures.

DESCRIPTION OF THE INVENTION

Figure 1:
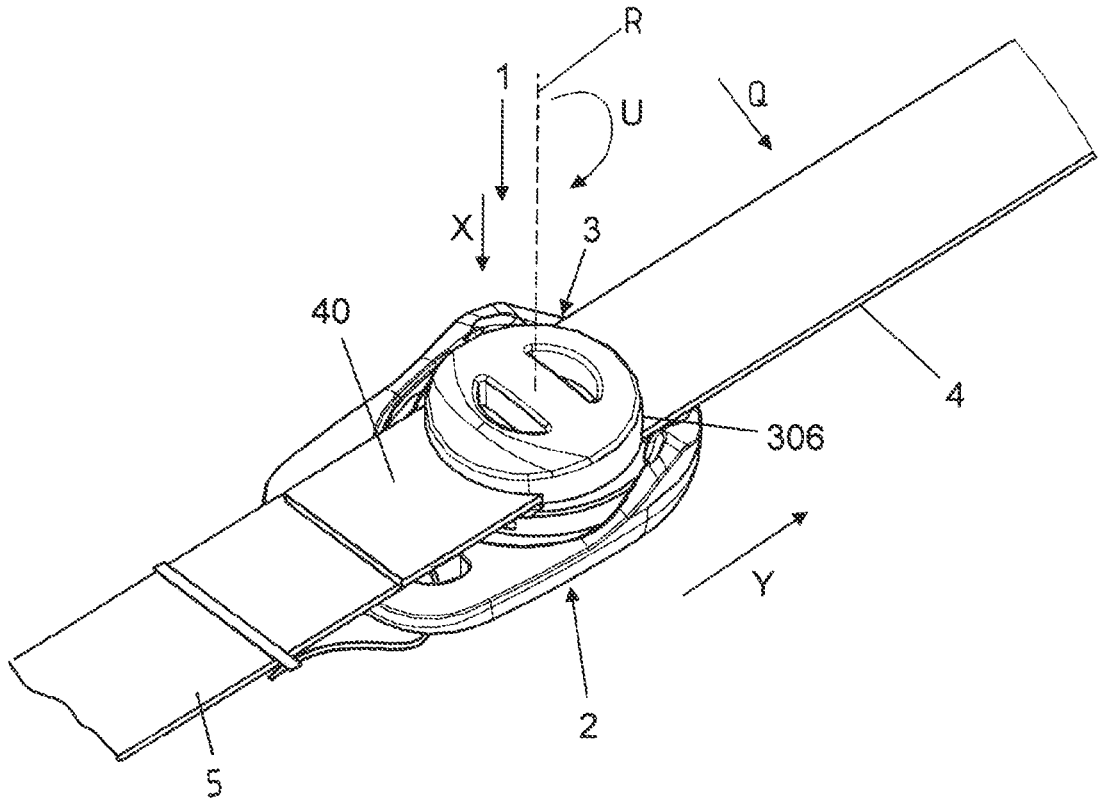
FIG. 1 shows a view of an exemplary embodiment of a connecting apparatus.

In an exemplary embodiment which is illustrated in FIGS. 1 to 12F, a connecting apparatus 1 has a first connecting part 2 (what is referred to as a female part) and a second connecting part 3 (what is referred to as a male part) which is to be attached to the first connecting part 2.

The connecting parts 2, 3 can generally be attached to each other along a closing direction X, the connecting parts 2, 3 each having a magnetic device 21, 31 in the form of a permanent magnet (or alternatively firstly in the form of a permanent magnet and secondly in the form of a magnetic armature) which interact in a magnetically attracting manner and draw the connecting parts 2, 3 toward each other along the closing direction X.

It should be noted that the attachment of the connecting parts 2, 3 may also be possible in a direction deviating from the closing direction X, for example directed obliquely to the closing direction X. The magnetic devices 21, 31 interact in a magnetically attracting manner along the closing direction X and draw the connecting parts 2, 3 toward each other along the closing direction X.

Figure 2A:
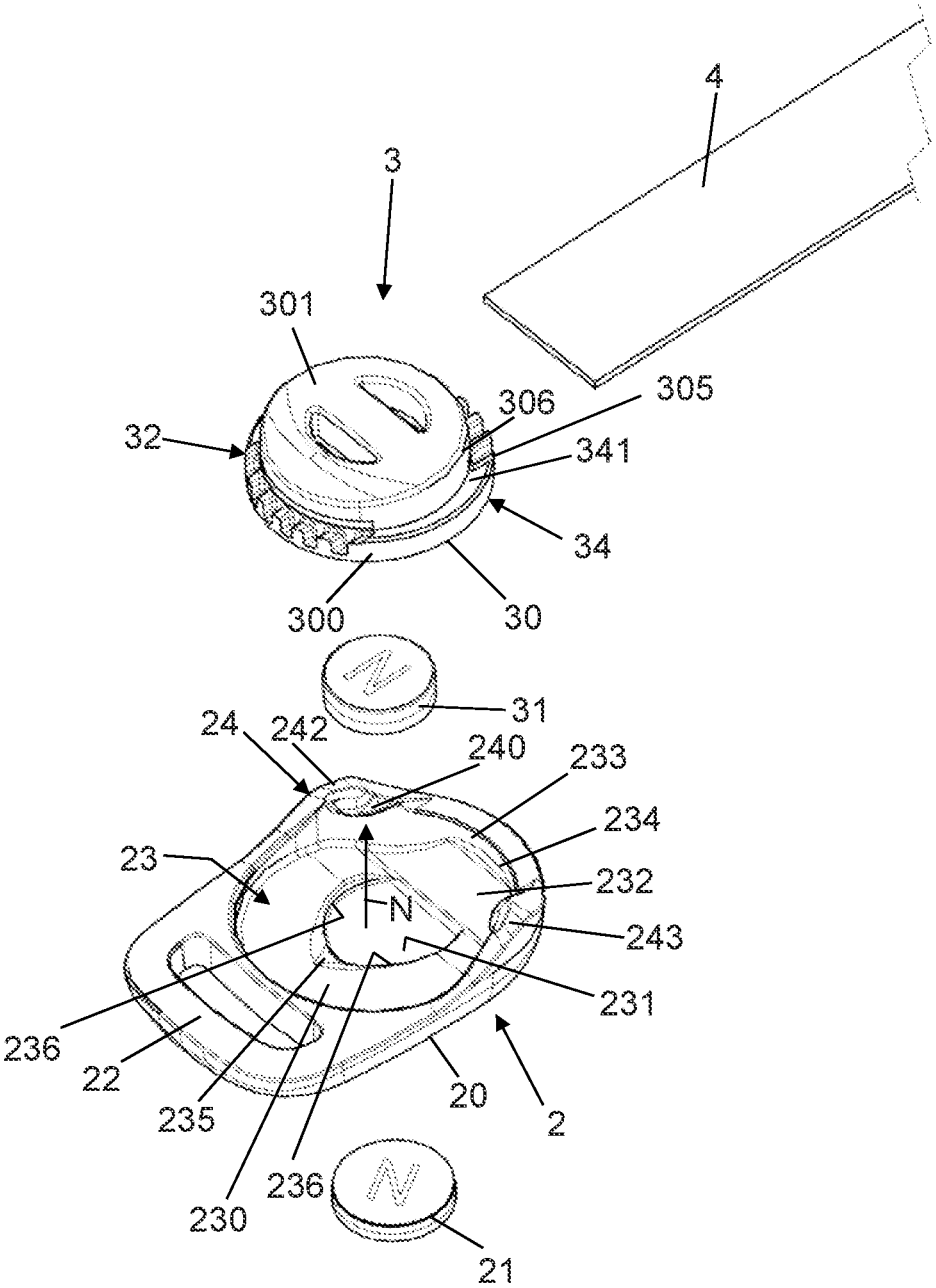
FIG. 2A shows an exploded view of the connecting apparatus.
Figure 2B:
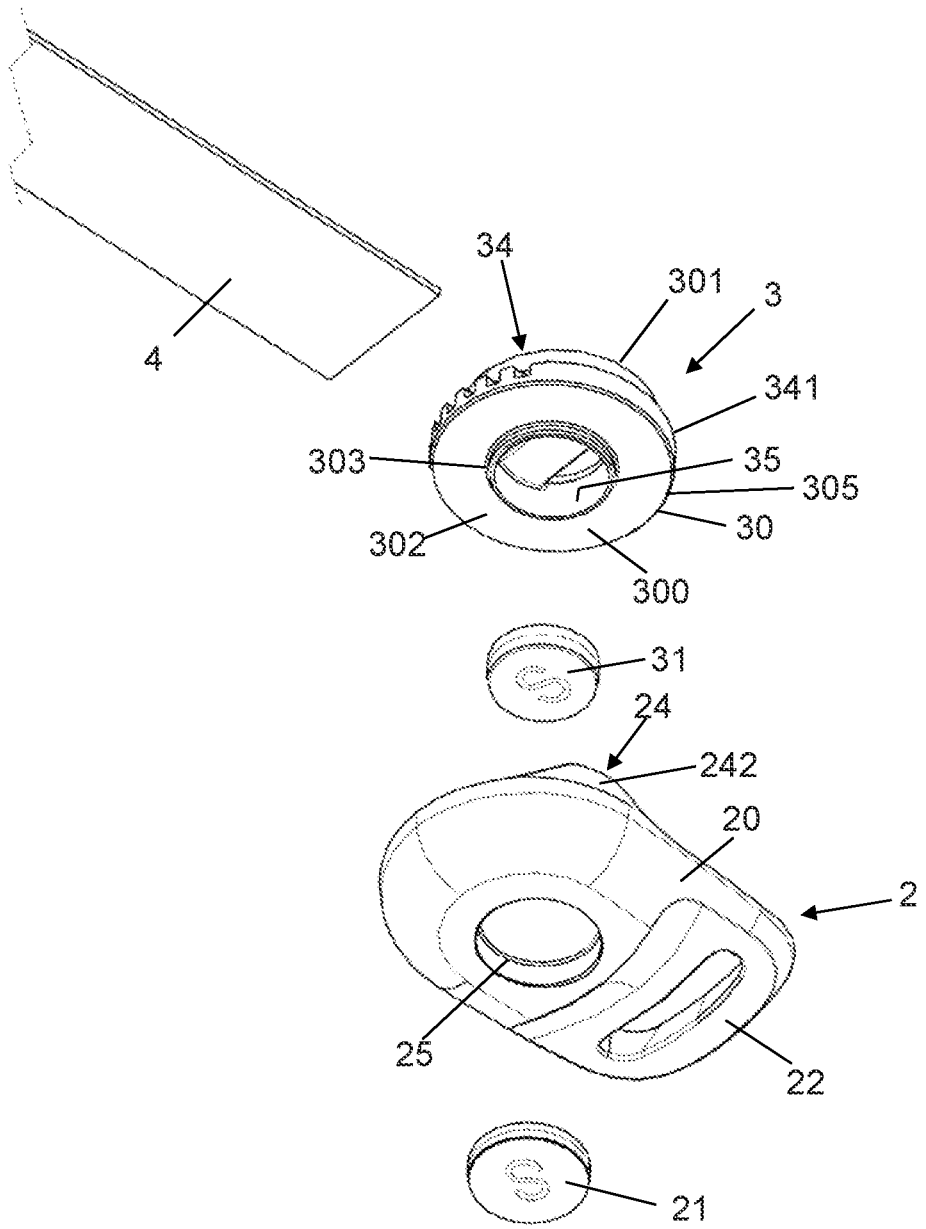
FIG. 2B shows the exploded view in a different perspective illustration.
Figure 3A:
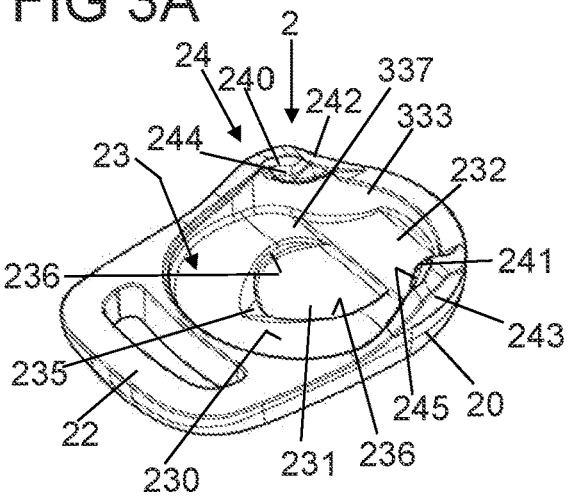
FIG. 3A shows a separate view of a first connecting part of the connecting apparatus.
Figure 3B:
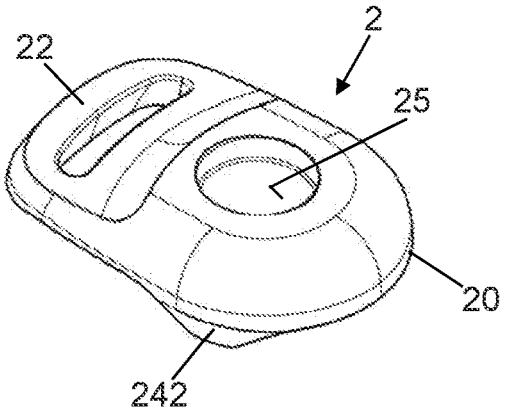
FIG. 3B shows a different view of the first connecting part.
Figure 4B:
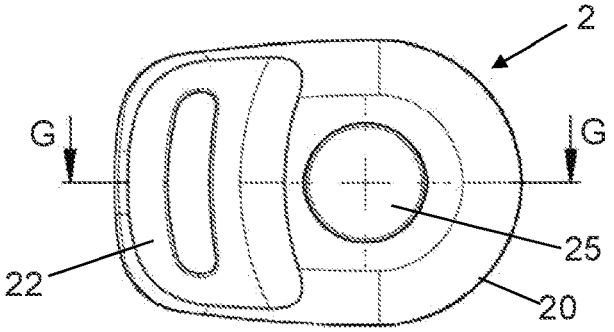
FIG. 4B shows a view of the first connecting part from below.
Figure 4C:
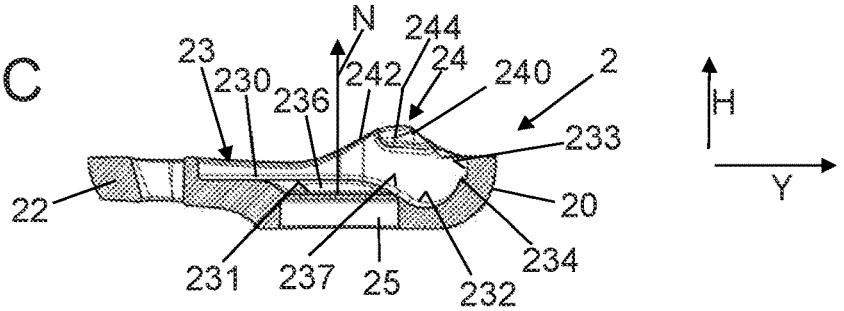
FIG. 4C shows a sectional view along the line G-G according to FIG. 4B.
Figure 4A:
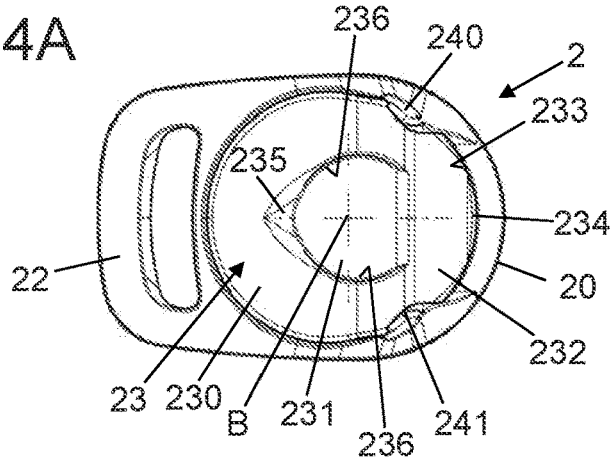
FIG. 4A shows a top view of the first connecting part.
Figure 5A:
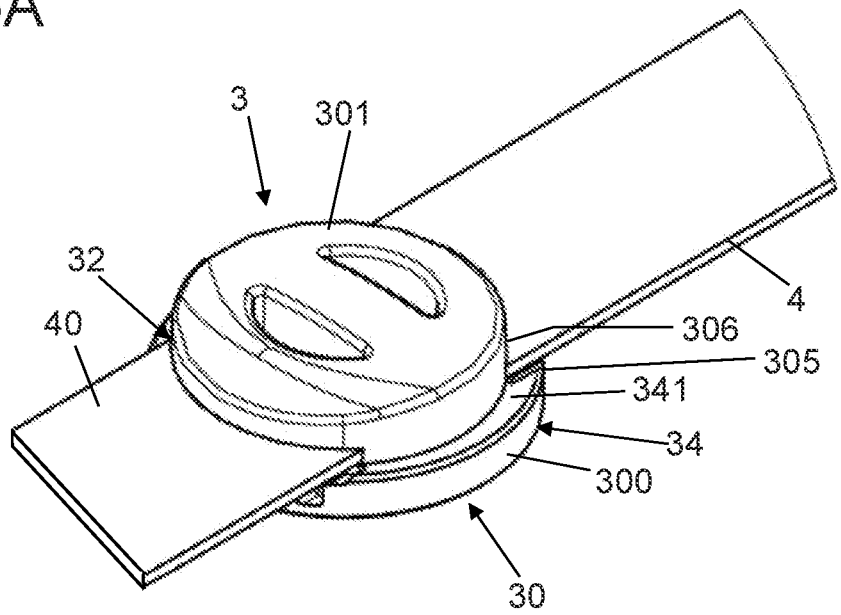
FIG. 5A shows a view of a second connecting part with a belt or strap arranged thereon.
Figure 5B:
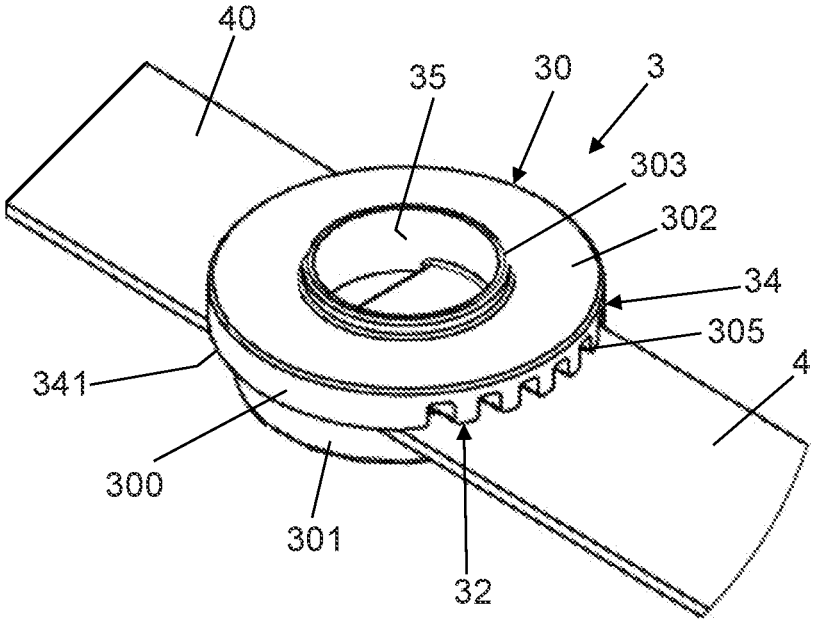
FIG. 5B shows a different view of the second connecting part with the belt or strap arranged thereon.

As can be seen from the exploded views according to FIGS. 2A and 2B and the separate views according to FIGS. 3A, 3B and 4A-4C, the first connecting part 2 has a basic body 20 which forms a receiving opening 23 for receiving the second connecting part 3. On the basic body 20 there is arranged a webbing receptacle 22 in the form of a web and an adjoining opening, to which a belt or strap 5 can be fastened or is fastened. On a side facing away from the receiving opening 23, the basic body 20 forms a fastening opening 25 for receiving the magnetic device 21.

The receiving opening 23 is formed as a depression on the basic body 20. Inside the receiving opening 23 there is formed a bottom surface 230 in the form of a flat surface which extends perpendicular to the closing direction X and with which the second connecting part 3 can be brought into planar contact upon insertion into the receiving opening 23 in order to produce a connection of the connecting parts 2, 3.

A recess 231 in the form of a depression is formed in the bottom surface 230, in which recess—as will also be described below—in the connected position of the connecting elements 2, 3 a blocking element 303 on a base portion 300 of the second connecting part 3 engages.

The receiving opening 23 is bounded at a front end by a support portion 233 serving as a support and load absorption for the second connecting part 3 in the connected position. An entry opening 232 is formed between the support portion 233 and the bottom surface 230 and serves to facilitate the production of the connection and the separation of the connecting parts 2, 3 by an edge portion 305 of the base portion 300 of the second connecting part 3 being able to enter the entry opening 232 during the production of the connection and also during the separating of the connection, as can be seen, for example, in FIG. 10B and will also be described below.

The entry opening 232 is formed as a depression relative to the bottom surface 230 and adjoins the bottom surface 230 in such a manner that the entry opening 232 is positioned between the support portion 233 and the bottom surface 230. At the transition between the entry opening 232 and the bottom surface 230, a beveled transition surface 237 is formed which serves as a guide for the second connecting part 3 for producing the connection and during the separation of the connection.

On the rigidly formed basic body 20 there are arranged engagement protrusions 240, 241 which are formed rigidly with the basic body 20 on two lateral, raised portions 242, 243 and which—as viewed along a vertical direction H pointing along the closing direction X—are positioned above the bottom surface 230 and serve to produce a positive locking or non-positive locking connection between the connecting parts 2, 3 in the connected position. The engagement protrusions 240, 241 are spaced apart from each other along a transverse direction Q. The engagement protrusions 240, 241 together form an engagement device 24 which permits a positive locking or non-positive locking engagement with the second connecting part 3. As will also be explained below, in the connected position, the base portion 300 of the second connecting part 3 with an engagement portion 341 formed thereon is received between the engagement protrusions 240, 241 and the bottom surface 230 and, in addition, is supported at a front edge 305 on the support portion 233 such that the connecting parts 2, 3 are thereby held securely and reliably on each other.

Sliding slopes 244, 245 are formed on the engagement protrusions 240, 241, the sliding slopes being inclined obliquely to the vertical direction H and bringing about sliding of the second connecting part 3 counter to an engagement direction Y when the connecting parts 2, 3 are attached to each other along the closing direction X.

The recess 231 is delimited laterally by arcuate boundary walls 236 which together realize a blocking portion of the first connecting part 2 and are oriented perpendicular to a bottom of the recess 231 and also to the bottom surface 230. The boundary walls 236 extend in the form of an arc of a circle about a central axis B of the recess 231, which axis is oriented along a normal direction N of the bottom surface 230.

A run-on slope 235 is formed between the boundary walls 236, the run-on slope being arranged on the recess 231 to the rear of the support portion 233 and providing a sliding surface in order to facilitate sliding of the blocking element 303 into the recess 231 and also release of the blocking element 303 from the recess 231.

The bottom surface 230 extends flat along a plane perpendicular to the normal direction N.

As is apparent from the exploded views according to FIGS. 2A and 2B and the separate views according to FIGS. 5A, 5B and 6A-6C, the second connecting part 3 is connected fixedly to a strap or belt 4. The second connecting part 3 has a basic body 30 on which the strap or belt 4 is arranged fixedly and non-adjustably by the strap or belt 4 lying in a webbing receptacle 32, which is formed between a base portion 300 and a fastening portion 301, and is thereby arranged fixedly on the basic body 30.

The basic body 30 can be formed in one piece and integrally, for example, with the base portion 300 and the fastening portion 301, by means of plastics injection molding, wherein the strap or belt 4 is insert molded in sections and is therefore connected fixedly and non-adjustably to the basic body 30.

The base portion 300 has a circular-cylindrical basic shape and, on a side facing the first connecting part 2 (during the production of the connection), forms a base surface 302 which extends flat and, when the second connecting part 3 is attached to the first connecting part 2, enters into contact in a planar manner with the bottom surface 230 in the receiving opening 23.

From the base surface 302, there protrudes a cross-sectionally circular blocking element 303 which is concentric with respect to the circular-cylindrical base portion 300 and serves for engaging in the recess 231 on the bottom surface 230 of the basic body 20 of the first connecting part 2.

A fastening opening 35 which serves for receiving the magnetic device 31, for example in the form of a permanent magnet, of the second connecting part 3 and within which the magnetic device 31 is fastened is formed within the blocking element 303.

The base portion 300 forms an engagement device 34 of the second connecting part 3 with an engagement portion 341 which serves for interaction with the engagement protrusions 240, 241 of the engagement device 24 of the first connecting part 2 and passes under the engagement protrusions 240, 241 during the production of the connection such that a positive locking or non-positive locking connection is produced between the connecting parts 2, 3.

In the exemplary embodiment illustrated, the engagement portion 341 is formed by an encircling edge of the base portion 300, which edge protrudes radially in relation to the fastening portion 301 and thus forms an undercut via which the engagement portion 341 can be brought into engagement with the engagement protrusions 240, 241, which likewise form undercuts, of the first connecting part 2 in order to connect the connecting parts 2, 3 to each other.

A process of connecting the connecting apparatus 1 is illustrated with reference to FIGS. 7A to 11D.

The connecting parts 2, 3 are attached to each other generally along the closing direction X, along which the magnetic devices 21, 31 interact in a magnetically attracting manner and therefore draw the connecting parts 2, 3 toward each other in a magnetically attracting manner. The connecting parts 2, 3 can be brought toward each other here by hand, with, after a certain approximation, the magnetic attraction force automatically draws the connecting parts 2, 3 into engagement and thus brings about production of the connection of the connecting apparatus 1. An imprecise attachment of the connecting parts 2, 3 to each other is therefore sufficient, with the connection then being produced very substantially automatically.

Figure 7A:
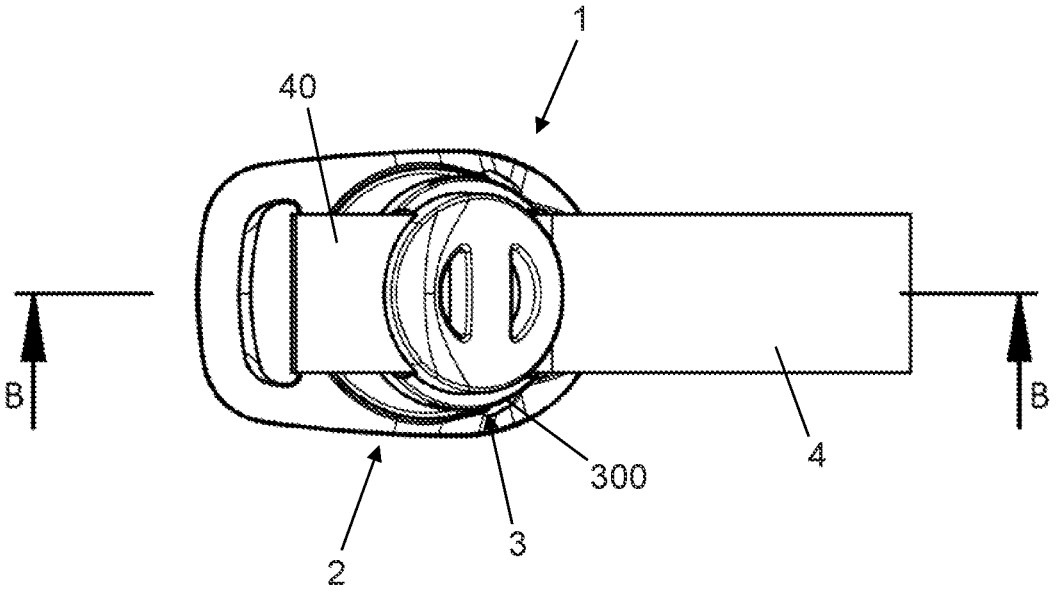
FIG. 7A shows a view of the connecting apparatus during the production of the connection of the connecting parts.
Figure 7B:
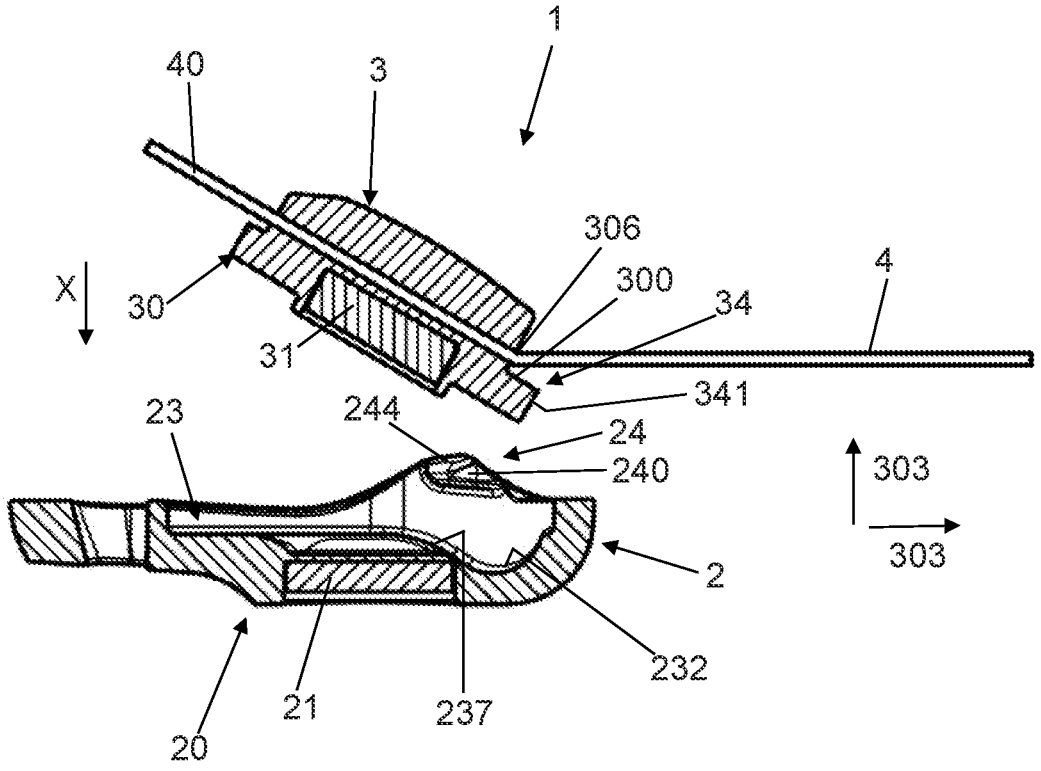
FIG. 7B shows a sectional view along the line B-B according to FIG. 7A.
Figure 8A:
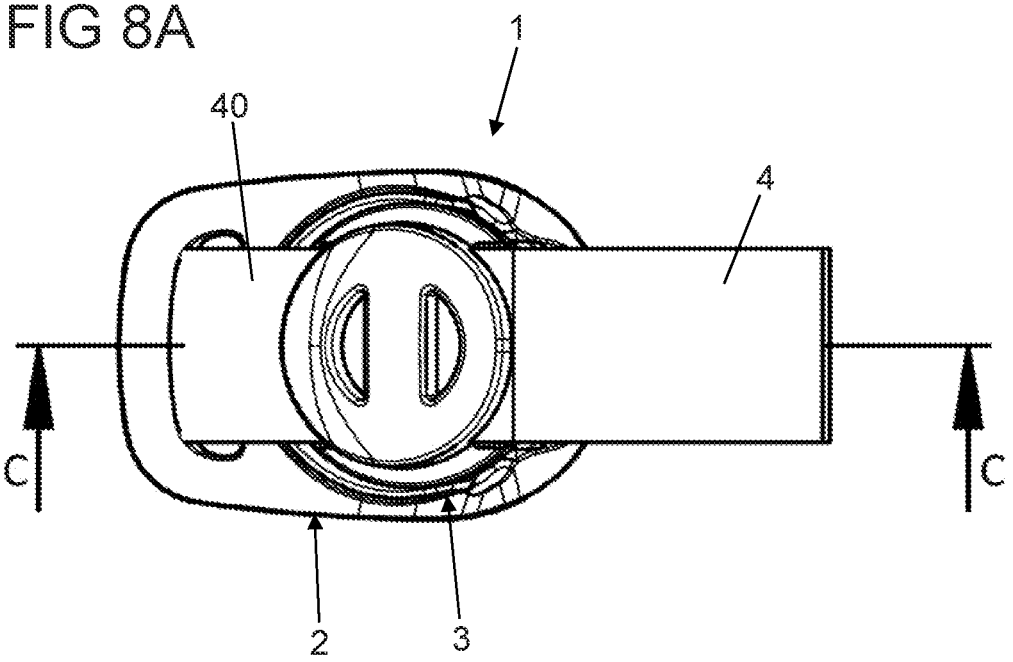
FIG. 8A shows a view of the connecting apparatus during the further closing.
Figure 8B:
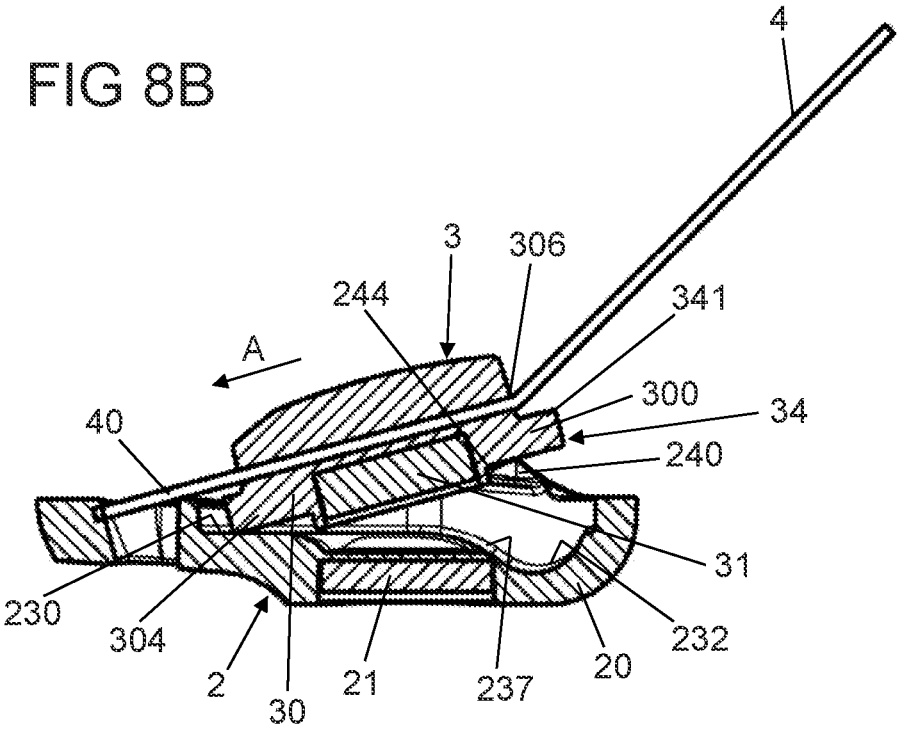
FIG. 8B shows a sectional view along the line C-C according to FIG. 8A.
Figure 9A:
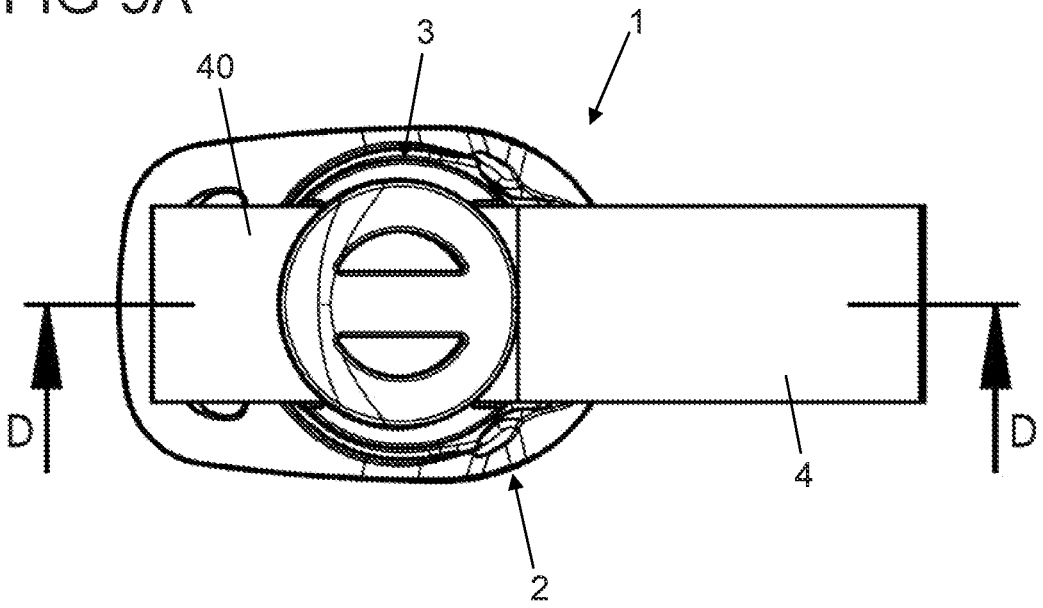
FIG. 9A shows a view of the connecting apparatus during the further closing.
Figure 9B:
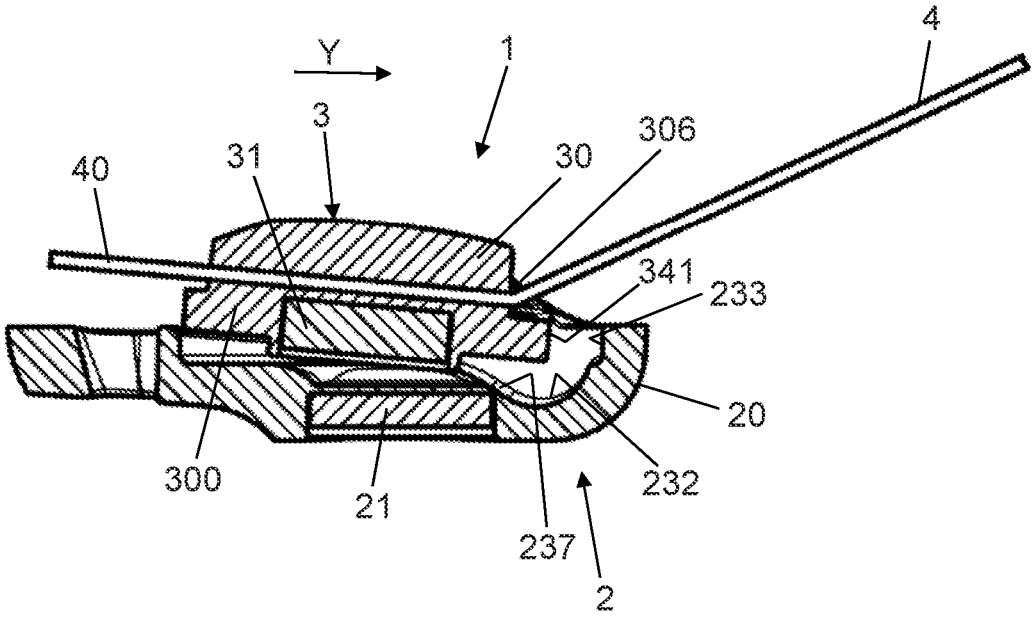
FIG. 9B shows a sectional view along the line D-D according to FIG. 9A.

If the connecting parts 2, 3 are brought toward each other, as is apparent from FIGS. 7A and 7B, the base portion 300 of the basic body 30 of the second connecting part 3 passes from above along the closing direction X into contact with the engagement protrusions 240, 241, as is apparent from FIGS. 8A and 8B. Owing to the inclined sliding slopes 244, 245 formed on the engagement protrusions 240, 241, the base portion 300 slides here along a sliding direction A on the engagement protrusions 240, 241, with the base portion 300 being able to enter into contact by way of a rear edge 304, which can be seen in FIG. 8B, with the bottom surface 230 in the receiving opening 23 of the first connecting part 2 and thereby sliding in a guided manner along the bottom surface 230 without the blocking element prematurely interlocking.

When the base portion 300 has slid along the engagement protrusions 240, 241 and the base portion 300 has therefore passed the engagement protrusions 240, 241 in the closing direction X, the engagement portion 341, which is formed on the encircling edge of the base portion 300, now slides, assisted by the magnetic attraction of the magnetic devices 21, 31, into engagement in an engagement direction Y with the engagement protrusions 240, 241, as is apparent from FIGS. 9A, 9B and 10A, 10B. This movement (approximately) along the engagement direction Y is undertaken with magnetic assistance, with a load force (introduced via the strap or belt 4) additionally being able to assist the engagement operation.

When the engagement portion 341 has moved into engagement in the engagement direction Y with the engagement protrusions 240, 241, the blocking element 303 slides into the recess 231 in the receiving opening 23 of the first connecting part 2, as is apparent in the transition from FIGS. 10A, 10B to FIGS. 11A-11D.

Figure 11A:
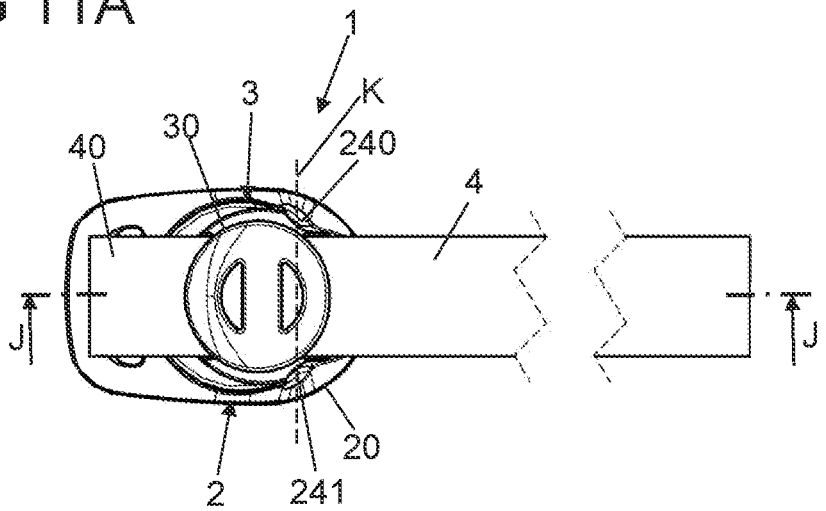
FIG. 11A shows a view of the connecting apparatus in a connected position of the connecting parts.
Figure 11B:
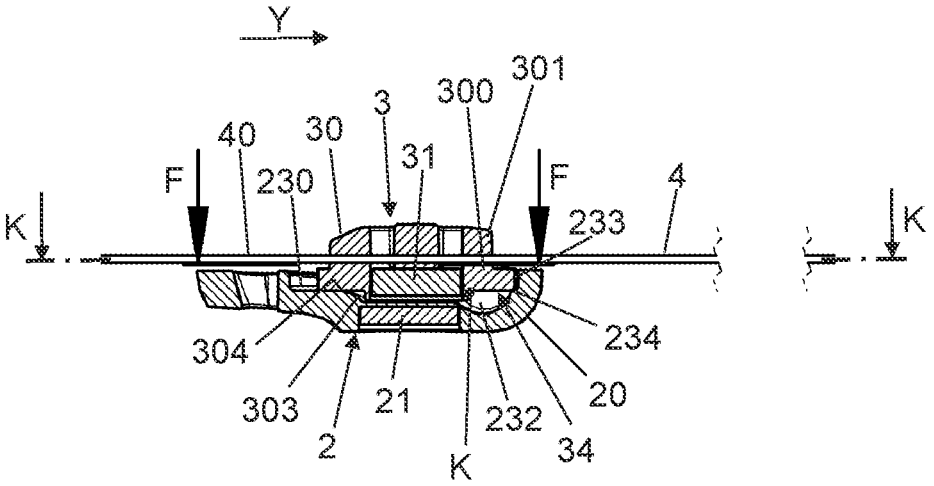
FIG. 11B shows a sectional view along the line J-J according to FIG. 11A.

In the connected position which is apparent in FIGS. 11A-11D, the blocking element 303 lies in the recess 231, and the base portion 300 lies by means of the base surface 302, which is formed thereon, in a planar manner on the bottom surface 230 within the receiving opening 23 of the first connecting part 2, as is apparent in particular from the sectional view according to FIG. 11B.

In the connected position, the base portion 300, by means of a (front) edge portion 305, faces the support portion 233 and lies supported against the support portion 233. If a force is introduced into the second connecting part 3 via the strap or belt 4, this force is absorbed and conducted away by the supporting contact of the base portion 300 on the support portion 233.

Figure 11C:
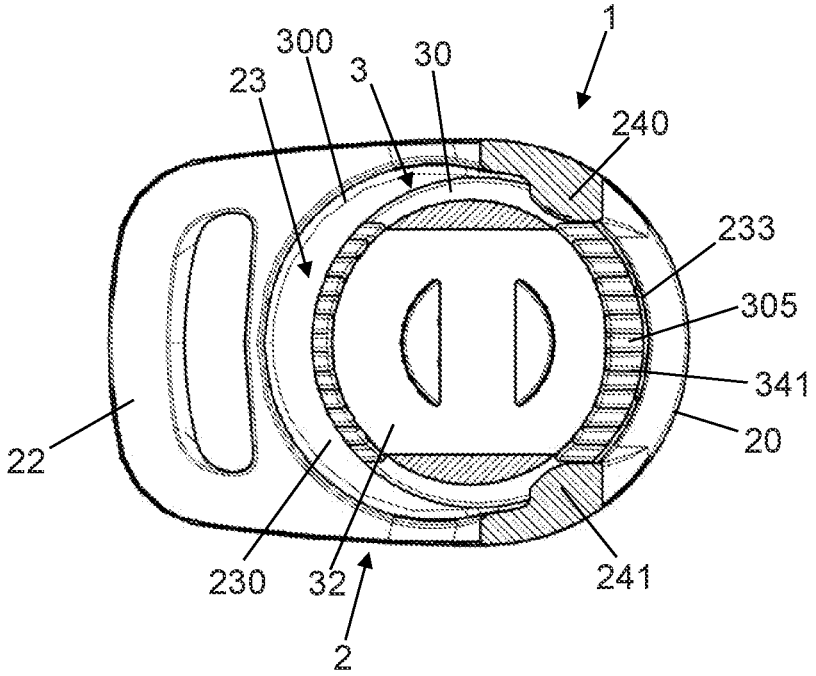
FIG. 11C shows a sectional view along the line K-K according to FIG. 11B.
Figure 11D:
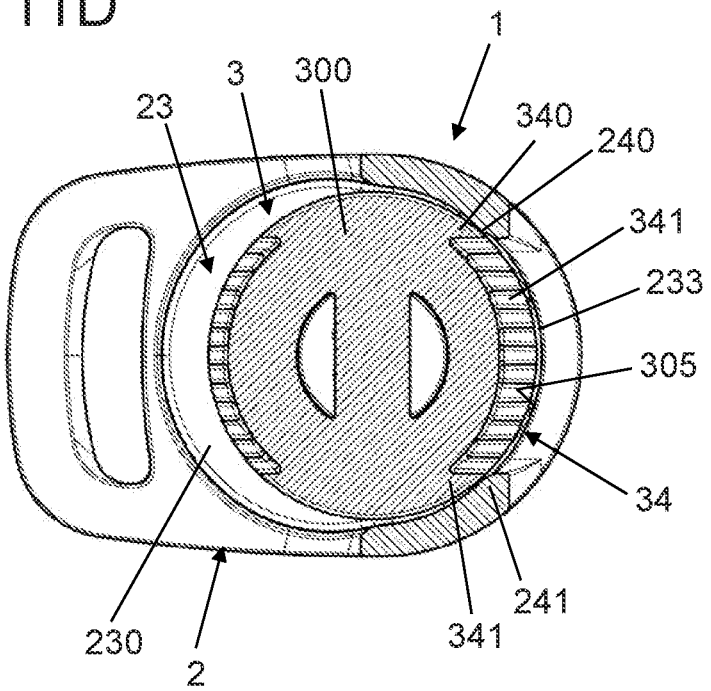
FIG. 11D shows a sectional view along the line F-F according to FIG. 11B.

As is apparent from FIGS. 11C and 11D, the support portion 233 is curved arcuately here about the closing direction X, in accordance with the curvature of the circular-cylindrical base portion 300, such that there is contact along an arcuate support line or support surface between the edge portion 305 on the base portion 300 and the support portion 233.

The support portion 233 is arranged here with a central portion, as viewed along the transverse direction Q, between the engagement protrusions 240, 241 and, at the central portion, is spaced apart along the engagement direction Y from the engagement protrusions 240, 241. The support portion 233 extends in an arcuate manner here, in the cross-sectional plane according to FIG. 11D, to under the engagement protrusions 240, 241 and beyond the latter such that a planar support is provided for the base portion 300 centrally between the engagement protrusions 240, 241 and also directly in the region of the engagement protrusions 240, 241.

In the connected position, the strap or belt 4 is arranged on the connecting part 3 approximately level with the engagement protrusions 240, 241 on the connecting part 2 or below the engagement protrusions 240, 241. This has the effect that strap or belt forces introduced via the strap or belt 4 cannot tilt the connecting part 3 in the receiving opening 23 or can produce only a small tilting moment, with the engagement protrusions 240, 241 securing the position of the connecting part 3 on the connecting part 2, in particular along the vertical direction H.

In the connected position and in the event of load effects between the connecting parts 2, 3, the strap or belt 4 lies between the raised portions 242, 243 and is therefore arranged between the engagement protrusions 240, 241 such that the engagement protrusions 240, 241 provide support which is symmetrical with respect to the strap or belt 4 when force is introduced via the strap or belt 4.

In the connected position, the magnetic devices 21, 31 interact in a magnetically attracting manner and therefore hold the connecting parts 2, 3 in the connected position.

In addition, owing to the engagement of the blocking element 303 in the recess 231, a tangential displacement of the connecting parts 2, 3 with respect to each other counter to the engagement direction Y is blocked. In the connected position, the blocking element 303 lies in the recess 231 in such a manner that the blocking element 303 is received between the boundary walls 236, which realize the blocking portion, and is in blocking contact with the arcuate blocking walls 236 such that the blocking element 303 cannot be moved with respect to the boundary walls 236 counter to the engagement direction Y.

Owing to the rotationally symmetrical shape of the blocking element 303 and the circular-cylindrical shape of the base portion 300, the connecting part 3 in the connected position can be rotated along a circumferential direction U (see FIG. 1) about any desired angle about an axis of rotation R within the receiving opening 23 of the connecting part 2, while maintaining the connecting engagement between the connecting parts 2, 3 and also the blocking of the blocking element 303 in the recess 231.

This rotatability also permits the connecting parts 2, 3 to be attached to each other in any desired rotational position, wherein, in the event of loading via the strap or belt 4, the connecting parts 2, 3 are aligned with respect to each other in such a manner that the strap or belt 4 comes to lie between the engagement protrusions 240, 241 and therefore the connecting part 3 is supported symmetrically on the connecting part 2. Owing to the rotatability, the connecting parts 2, 3 can be attached in a position-tolerant manner to each other, which makes the production of the connection simple and comfortable.

Figure 10A:
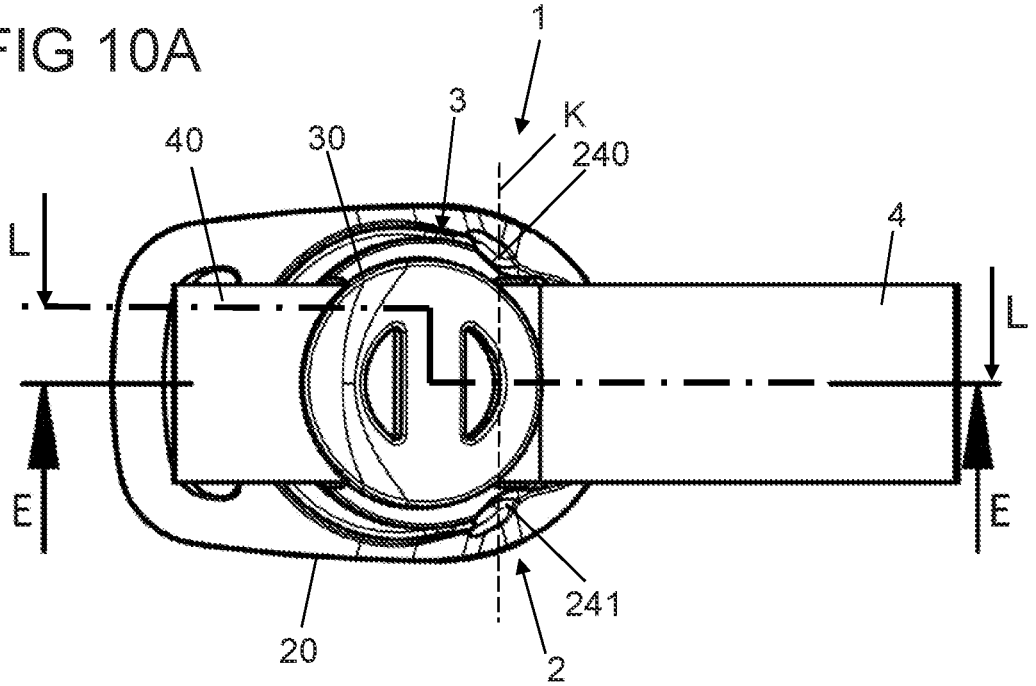
FIG. 10A shows a view of the connecting apparatus during the further closing.
Figure 10B:
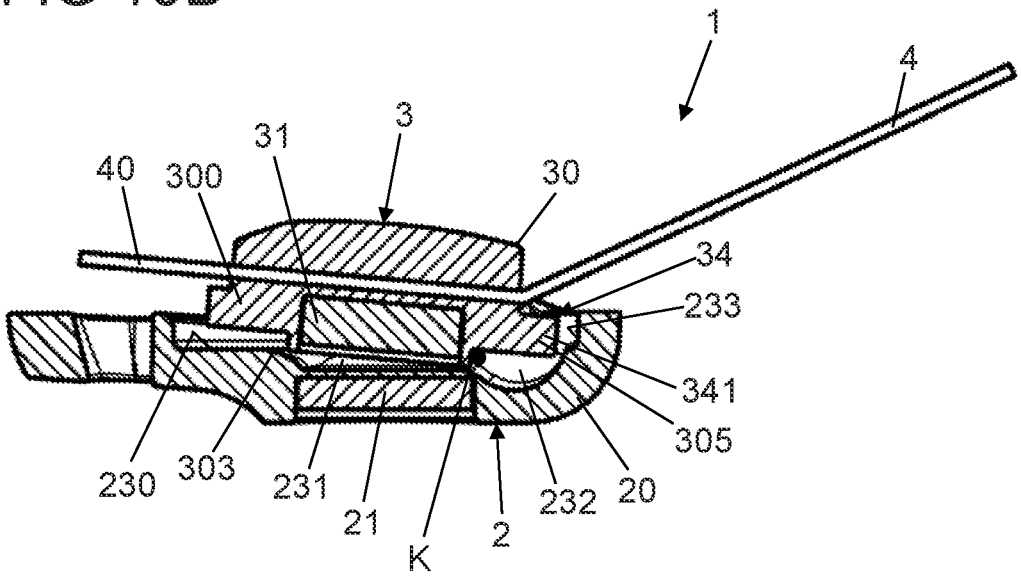
FIG. 10B shows a sectional view along the line E-E according to FIG. 10A.
Figure 10C:
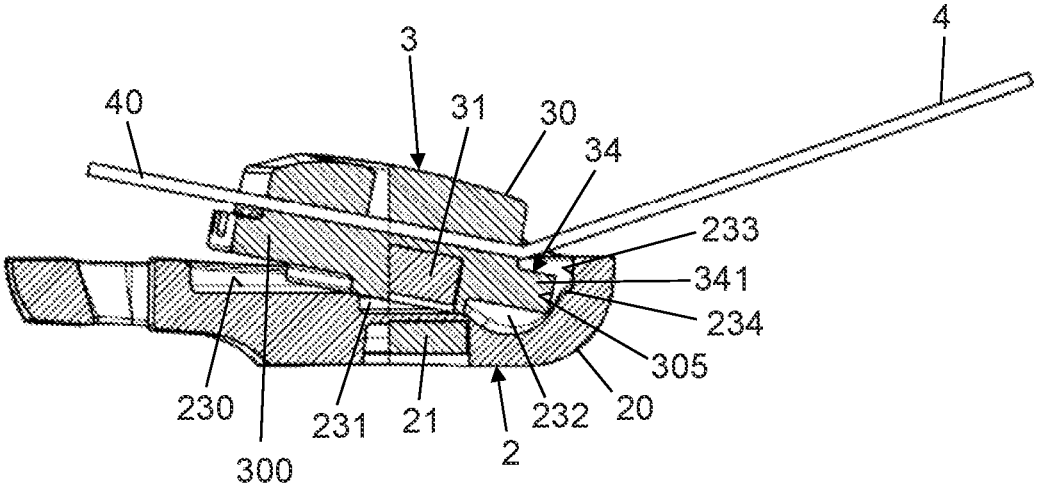
FIG. 10C shows a sectional view along the line L-L according to FIG. 10A.

As is apparent from FIGS. 10A-10C, the base portion 300 by means of a front edge portion 305 passes under the engagement protrusions 240, 241 when sliding into the entry opening 232 which is formed in a recessed manner both with respect to the bottom surface 230 and with respect to the recess 231. Entry of the edge portion 305 into the entry opening 232 can make it possible for the blocking element 303 to slide into the recess 231 and for the engagement of the engagement portion 341, which is formed on the base portion 300, with the engagement protrusions 240, 241 to be produced. In addition, the angular range of an opening force, which is applied to the actuating portion 40 (tab) can be increased and jamming of the edge portion 305 during the opening prevented.

In the connected position, the front edge portion 305 of the base portion 300 then rests on a positive locking portion in the form of a step 234, which is formed between the entry opening 232 and the support portion 233 and is positioned level with the bottom surface 230, as is apparent in particular from FIG. 11B. By contact of the base portion 230 on the step 234, the connecting part 3 is additionally supported against tilting with respect to the connecting part 2.

The positive locking portion can alternatively also be formed, for example, by a notch or the like on the support portion 233, in which the base portion 300 engages by means of the edge portion 305 and is thereby supported on the support portion 233 against tilting, which is associated with a movement of the edge portion 305 on the support portion 233 downward in the closing direction X.

By means of the positive locking portion in the form of the step 234, in the connected position according to FIGS. 11A to 11D, in particular tilting in the event of loading on the strap or belt 4 is counteracted. In the connected position, the second connecting part 3 thus rests with its basic body 30 in a first region, formed by the rear region (with respect to the engagement direction Y), on the bottom surface 230 of the basic body 20 of the first connecting part 2. In a second region adjoining the engagement direction Y, formed by the region above the entry opening 232, the second basic body 30 of the second connecting part 3, by contrast, does not lie against the first basic body 20 of the first connecting part 2.

The second basic body 30 rests on the step 234 by means of a third region which adjoins the second region in the engagement direction Y and is formed by the front edge portion 305 of the base portion 300, and therefore, in the connected position, a support is provided in the manner of a two-point support, with a clearance provided in between in the region of the entry opening 232.

In the loaded position, the base portion 300 is loaded with the front edge portion 305 against the support portion 233 and therefore kept in contact with the step 234 in a self-reinforcing manner.

If the connecting parts 2, 3 are to be separated from each other, the movement sequence according to FIGS. 7A to 11D proceeds substantially conversely. In particular, in order to separate the connecting parts 2, 3, a user can grasp an actuating portion in the form of a tab 40 (formed by a protruding portion of the strap or belt 4) on a rear side of the connecting part 3 facing away from the engagement protrusions 240, 241, and can thereby lift the connecting part 3 at its rear end from the bottom surface 230 and therefore tilt the connecting part 3 with respect to the connecting part 2 out of the connected position according to FIGS. 11A-11D in such a manner that the base portion 300 slides by means of the front edge portion 305 from the step 234 and the blocking element 303 is lifted out of the recess 231, as is apparent from FIGS. 10A and 10B. In this way, the blocking between the connecting parts 2, 3 counter to the engagement direction Y is removed, and therefore the connecting part 3 can be pulled out of engagement from the connecting part 2 counter to the engagement direction Y and the connecting parts 2, 3 can therefore be released from each other.

The tilting is undertaken here in a tilting plane which is directed perpendicular to the bottom surface 230, namely is spanned by the closing direction X and the engagement direction Y. The tilting takes place here approximately about a tilting axis K (see FIGS. 10A and 10B) in such a manner that the connecting part 3 carries out a pivoting movement in the tilting plane perpendicular to the tilting axis K and therefore the blocking element 303 is lifted out of the recess 231 such that the connecting parts 2, 3 can be moved counter to the engagement direction Y with respect to each other and can therefore be separated from each other.

If, in particular when the connecting apparatus 1 is not loaded, the connection of the connecting parts 2, 3 is to be released, the connecting parts 2, 3 are tilted with respect to each other and in particular also moved counter to the engagement direction Y with respect to each other such that the front edge portion 305 (forming the third region) of the base portion 300 slides from the step 234 and enters the region of the entry opening 232, as is apparent from FIG. 10B. The positive locking portion created by the step 234 therefore does not counteract tilting (any longer), and therefore the connecting parts 2, 3 can be comfortably and simply separated from each other during tilting via the actuating portion 40.

FIGS. 12A to 12F show the connecting apparatus 1 in a rotated position of the second connecting part 3 relative to the first connecting part 2. The second connecting part 3 can be attached here to the first connecting part 2 in a (any desired) rotated position, and, in any desired rotational position, the engagement portion 341 of the second connecting part 3 can be brought into engagement with the engagement protrusions 240, 241 of the first connecting part 2. In the connected position, the second connecting part 3 is rotatable along a circumferential direction U about the axis of rotation R relative to the first connecting part 2 with the engagement of the engagement portion 341 with the engagement protrusions 240, 241 being maintained and with engagement of the blocking element 303 in the recess 231.

Under load, if, in the connected position of the connecting apparatus 1, strap or belt forces act between the straps or belts 4, 5, the strap or belt 4 lies between the engagement protrusions 240, 241, as is apparent from FIG. 1. In this case, the engagement protrusions 240, 241 are arranged to the side of the strap or belt 4, and therefore the strap or belt 4 extends between the engagement protrusions 240, 241 (as viewed along the transverse direction Q pointing from the engagement protrusion 240 to the engagement protrusion 241).

Figure 12A:
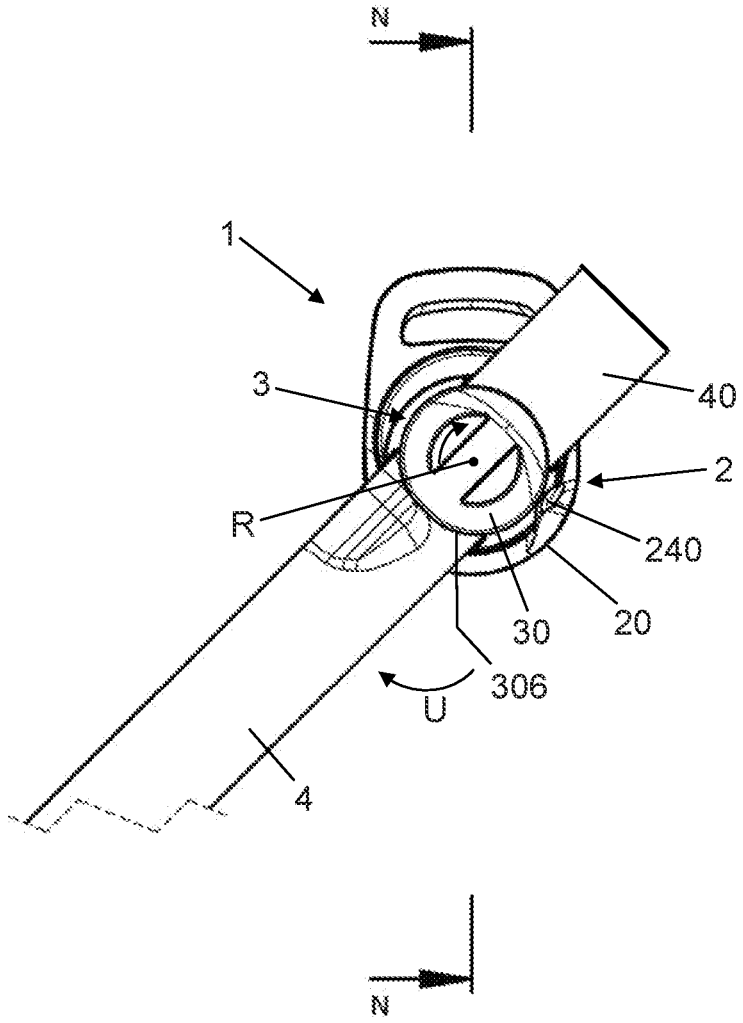
FIG. 12A shows a top view of the connecting apparatus in a position of the second connecting part rotated in relation to the first connecting part.
Figure 12B:
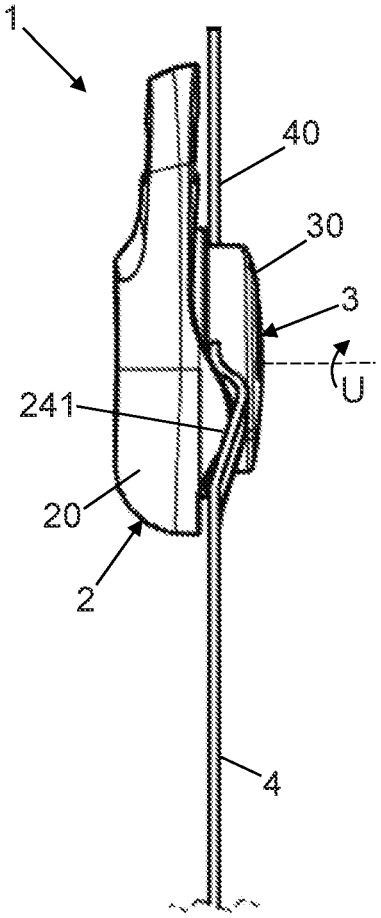
FIG. 12B shows a side view of the arrangement according to FIG. 12A.
Figure 12C:
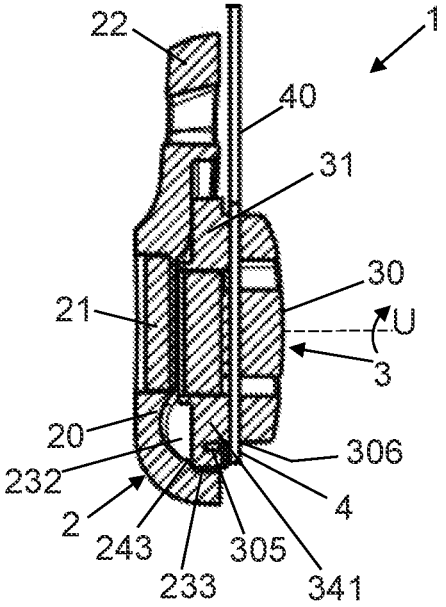
FIG. 12C shows a sectional view along the line N-N according to FIG. 12A.
Figure 12D:
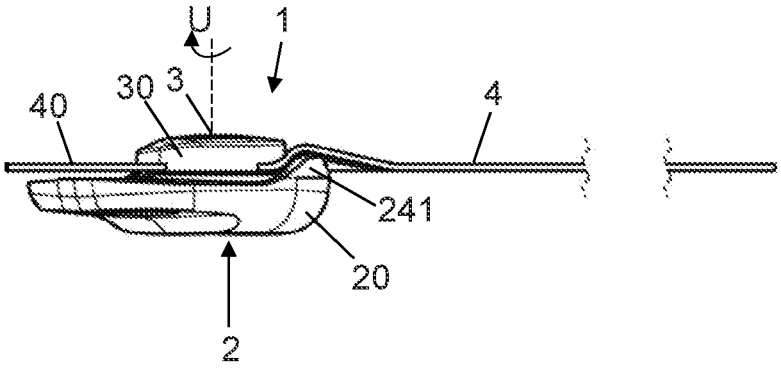
FIG. 12D shows a side view of the connecting apparatus obliquely from the rear.
Figure 12E:
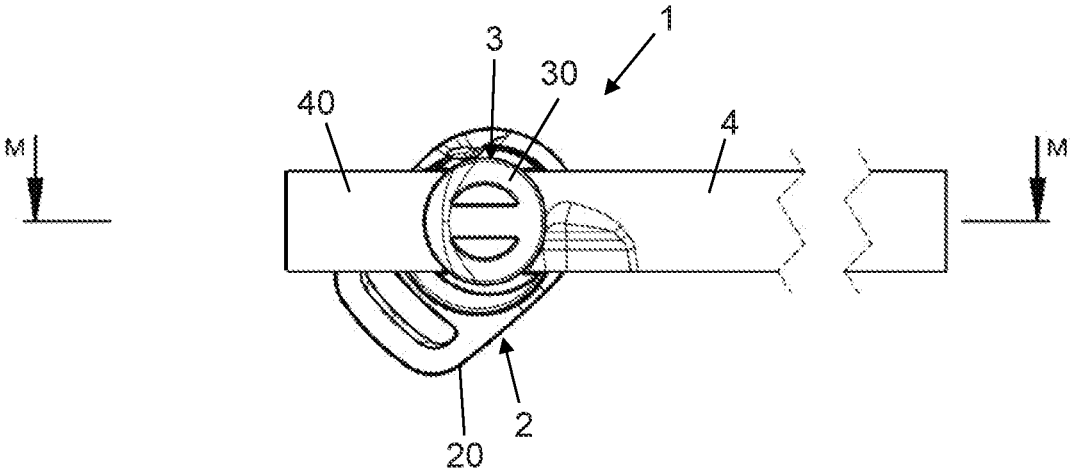
FIG. 12E shows a top view of the connecting apparatus.
Figure 12F:
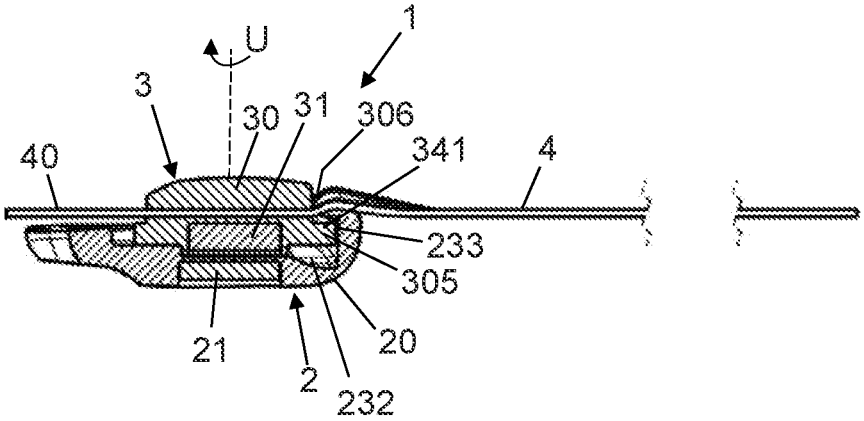
FIG. 12F shows a sectional view along the line M-M according to FIG. 12E.
Figure 13A:
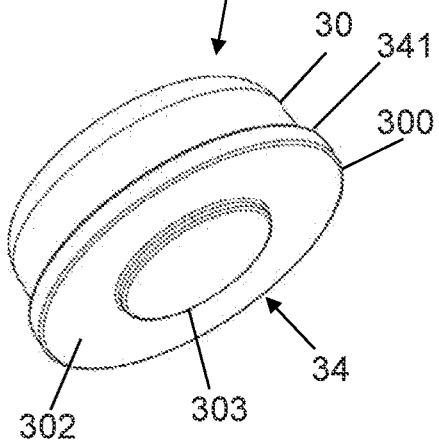
FIG. 13A shows a view of a second connecting part, according to another exemplary embodiment of a connecting apparatus.
Figure 13B:
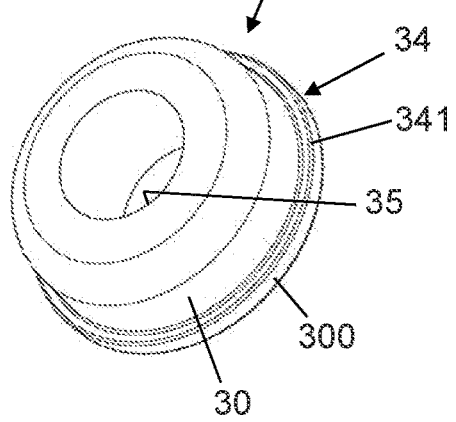
FIG. 13B shows a different perspective view of the second connecting part.
Figure 14A:
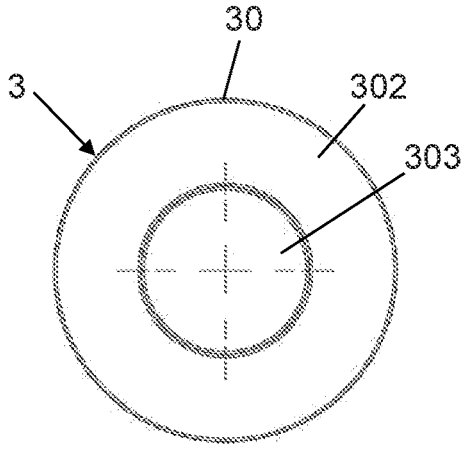
FIG. 14A shows a view of the second connecting part from below.
Figure 14B:
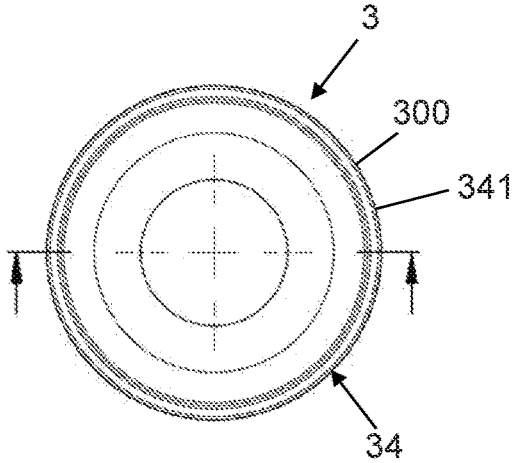
FIG. 14B shows a top view of the second connecting part.
Figure 14C:
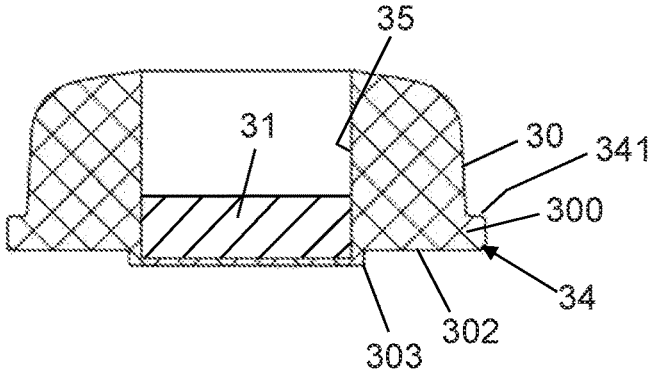
FIG. 14C shows a sectional view along the line E-E according to FIG. 14B.
Figure 15A:
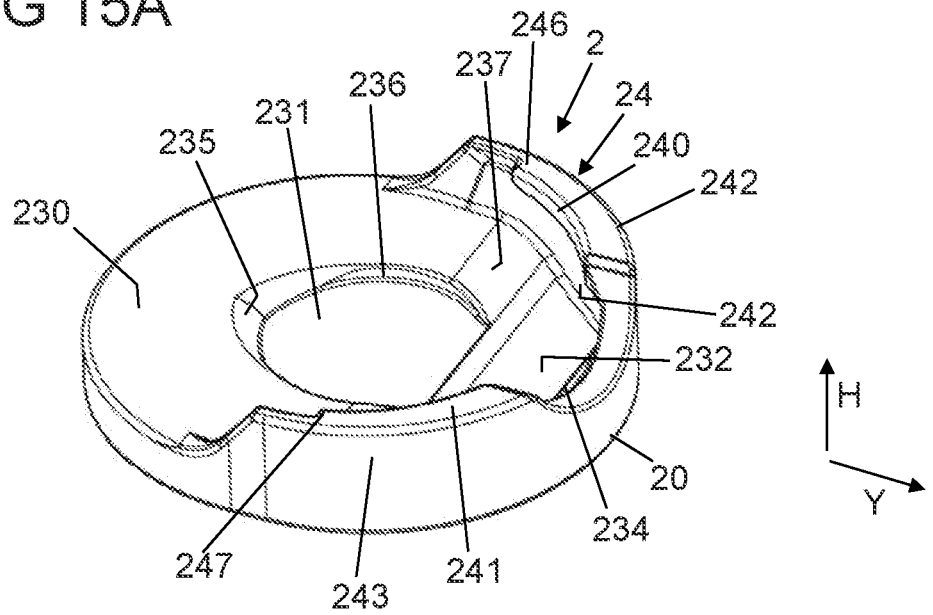
FIG. 15A shows a view of a first connecting part to which the second connecting part according to FIGS. 13A, 13B and 14A-14C is attachable.
Figure 15B:
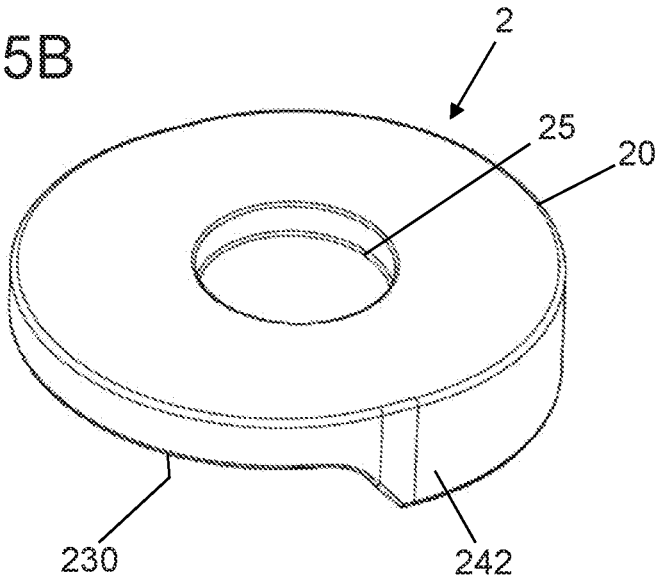
FIG. 15B shows a different view of the first connecting part.
Figure 16A:
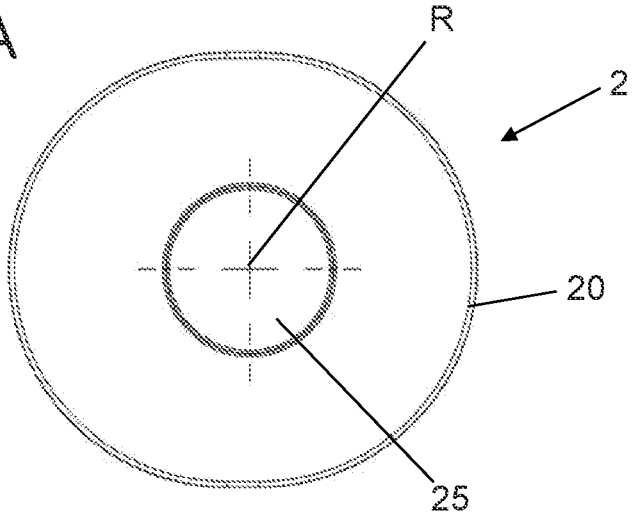
FIG. 16A shows a view of the first connecting part from below.
Figure 16B:
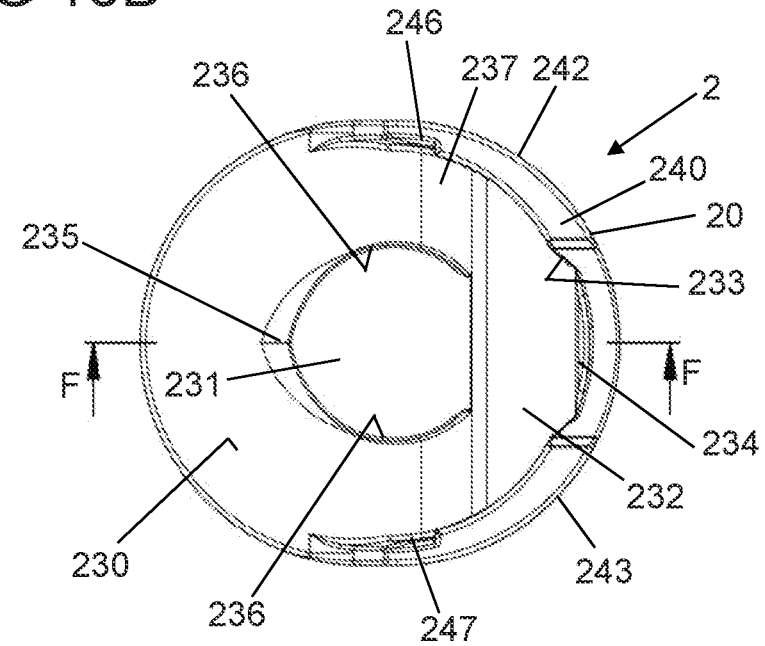
FIG. 16B shows a top view of the first connecting part.
Figure 16C:
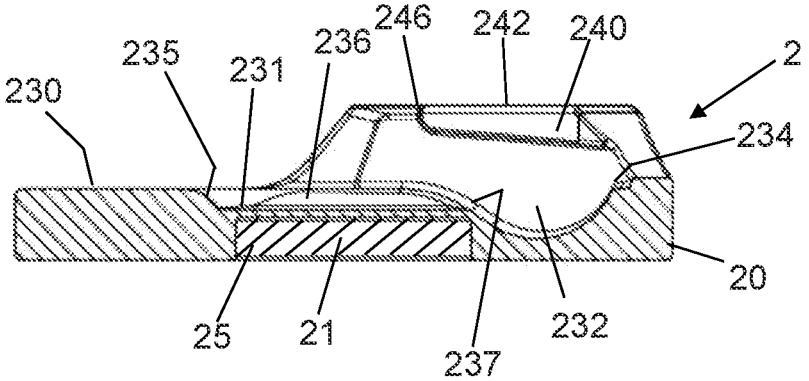
FIG. 16C shows a sectional view along the line F-F according to FIG. 16B.

If, by contrast, as is apparent from FIGS. 12A to 12F, the second connecting part 3 is rotated along the circumferential direction U about the axis of rotation R with respect to the first connecting part 2, the strap or belt 4 can extend beyond one of the engagement protrusions 240, 241, with flexible, flexurally slack deformation of the strap or belt 4, as is apparent in particular from FIGS. 12B and 12D. During the rotation, the strap or belt 4 slides onto one of the engagement protrusions 240, 241 (depending on the direction of rotation) and is thereby deformed such that the strap or belt 4 can be moved beyond the respective engagement protrusion 240, 241.

Figure 6A:
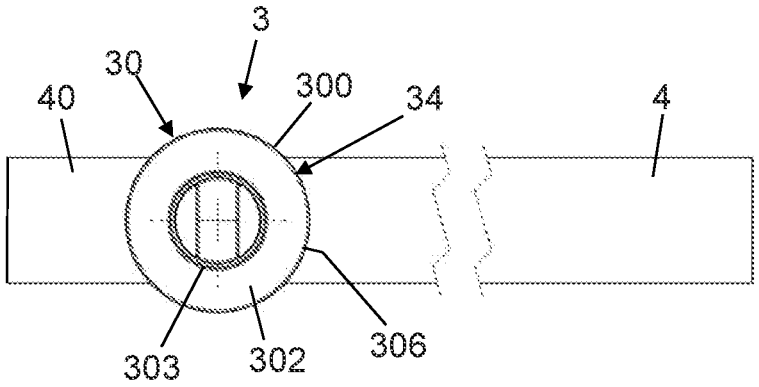
FIG. 6A shows a view of the second connecting part from below.
Figure 6B:
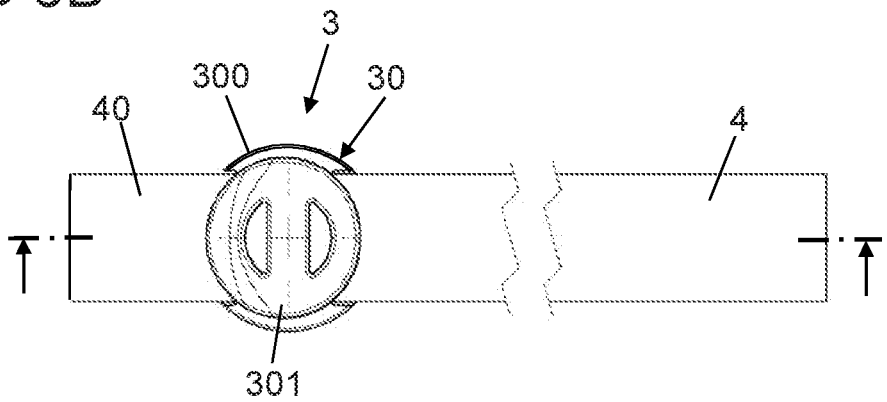
FIG. 6B shows a top view of the second connecting part.
Figure 6C:
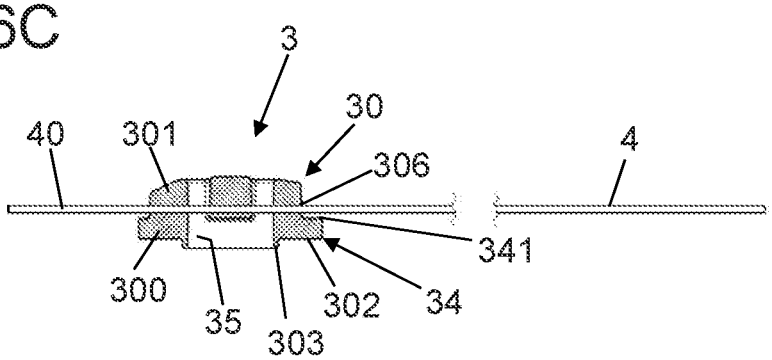
FIG. 6C shows a sectional view along the line I-I according to FIG. 6B.

As is apparent from FIG. 1, for example, together with FIG. 6C, the strap or belt 4 emerges from the fastening portion 301 above the base portion 300 on an outlet line 306 which is curved in accordance with the cylindrical shape of the fastening portion 301. On the far side of the outlet line 306, i.e. outside the fastening portion 301, the strap or belt 4 is not connected here to the base portion 300 in the region of the protruding edge portion forming the engagement portion 341, but rather can be moved freely in relation to the base portion 300 and in particular lifted off from the base portion 300, which permits the deformation of the strap or belt 4 for smoothly sliding onto the engagement protrusion 240, 241 during the rotation of the connecting part 3 relative to the connecting part 2.

The outlet line 306 is offset radially inward in relation to the end-side edge portion 305 of the base portion 300 and therefore spaced apart radially from the edge portion 305. The strap or belt 4 therefore emerges from the fastening portion 301 along a line set back in relation to the edge portion 305.

From the position according to FIGS. 12A to 12F, the connecting part 3 can also be rotated even further. In principle, the connecting part 3 can be rotated about any desired angle with respect to the connecting part 2.

Under load between the straps or belts 4, 5, the connecting parts 2, 3 move automatically back into the position according to FIG. 1.

The attachment or release of the connecting part 3 to or from the connecting part 2 is also basically possible in any desired rotational position.

In the exemplary embodiment according to FIGS. 1 to 12F, the connecting apparatus 1 realizes a webbing fastener via which straps or belts can be connected to each other. In the connected position, a load direction determined by the straps or belts is directed substantially along the engagement direction Y.

In another exemplary embodiment which is illustrated in FIGS. 13A to 20D, the connecting apparatus 1 is configured as an object fastening device and serves for fastening an object to an associated assembly. The object can be arranged here, for example, on a (second) connecting part 3 or integrated in the connecting part 3. In this way, for example, an electrical or electronic device, for example a communication device, a light or the like, can be arranged on an associated assembly, for example on a helmet or another item of sports equipment.

In the exemplary embodiment illustrated, the (second) connecting part 3 is formed rotationally symmetrically and forms a base portion 300 which is arranged on a basic body 30 and has a circular-cylindrical shape, as is apparent from FIGS. 13A, 13B and 14A-14C. A base surface 302 from which a cross-sectionally circular blocking element 303 which is concentric with respect to the base surface 302 protrudes is formed on an underside of the base portion 300.

A fastening opening 35 for receiving a magnetic device 31 is formed on a housing portion which is raised in relation to the base portion 300.

The (second) connecting part 3 according to FIGS. 13A, 13B and 14A-14C can be attached to a (first) connecting part 2 which is illustrated in FIGS. 15A, 15B and 16A-16C and which has a basic body 20 on which a bottom surface 230 is formed which extends in a planar and flat manner on a side of the basic body 20 facing the connecting part 3 (when the connecting parts 2, 3 are attached to each other) and with which the base surface 302 on the base portion 300 of the connecting part 3 enters into contact in a planar manner when the connecting parts 2, 3 are connected to each other.

As has been explained with reference to the exemplary embodiment described above, a recess 231 which serves for receiving the blocking element 303 of the connecting part 3 is formed in the bottom surface 230. In addition, the bottom surface 230 is adjoined by an entry opening 232 which is placed between the bottom surface 230 and a support portion 233 formed in a front region of the basic body 20.

Engagement protrusions 240, 241 which are formed rigidly with the basic body 20 and are arranged above the bottom surface 230, as viewed along a vertical direction H, are arranged on raised portions 242, 243. In the connected position of the connecting parts 2, 3, an engagement portion 341, which is formed by an encircling, radially protruding edge of the base portion 300 of the connecting part 3, is received between the bottom surface 230 and the engagement protrusions 240, 241.

At the rear of the bottom surface 230, the basic body 20 forms a fastening opening 25 in which a magnetic device 21 for magnetically interacting with the magnetic device 31 of the connecting part 3 is arranged.

The operation to connect the connecting parts 2, 3, illustrated in FIGS. 17A, 17B to 20A-20D, proceeds as has been described previously for the exemplary embodiment according to FIGS. 1 to 12A-12F.

Figure 17A:
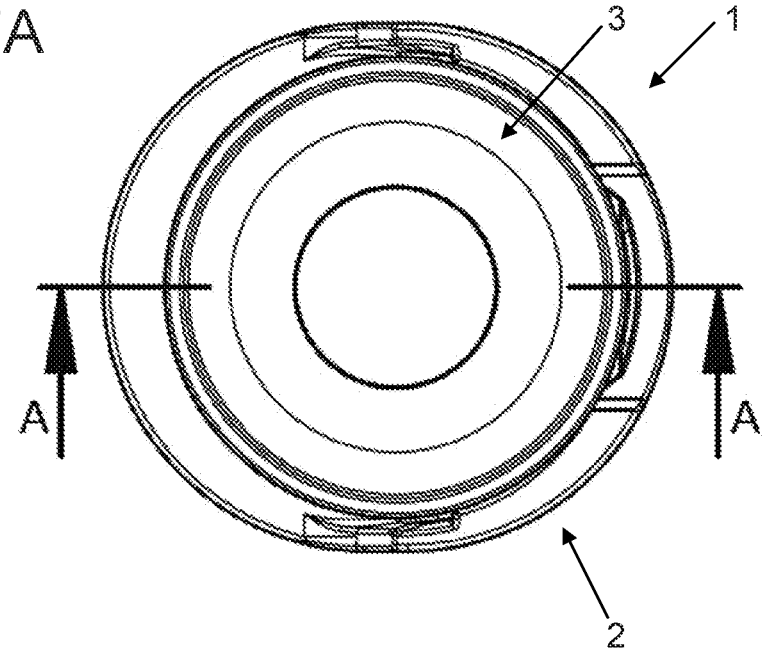
FIG. 17A shows a view of the connecting apparatus during the closing.
Figure 17B:
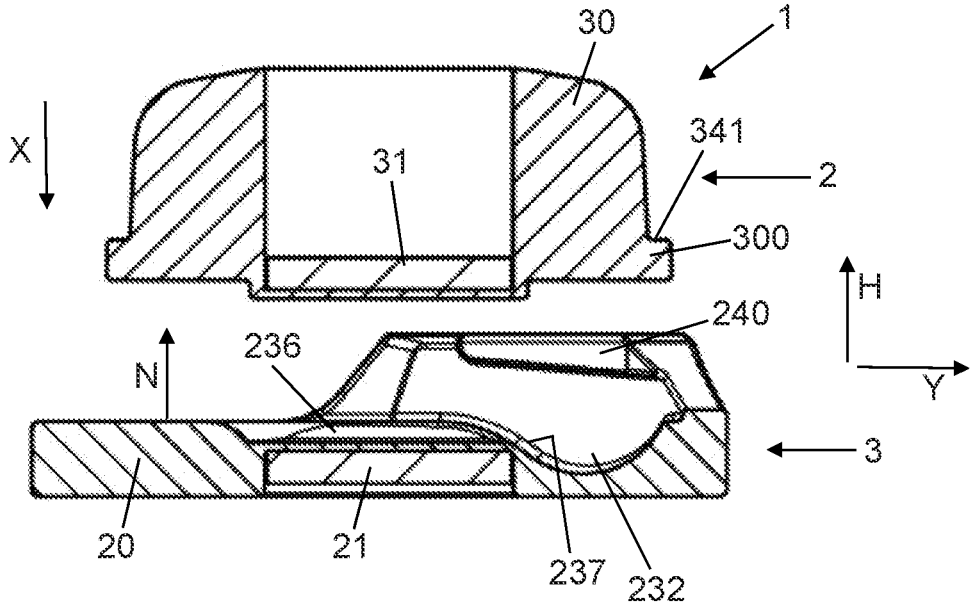
FIG. 17B shows a sectional view along the line A-A according to FIG. 17A.
Figure 18A:
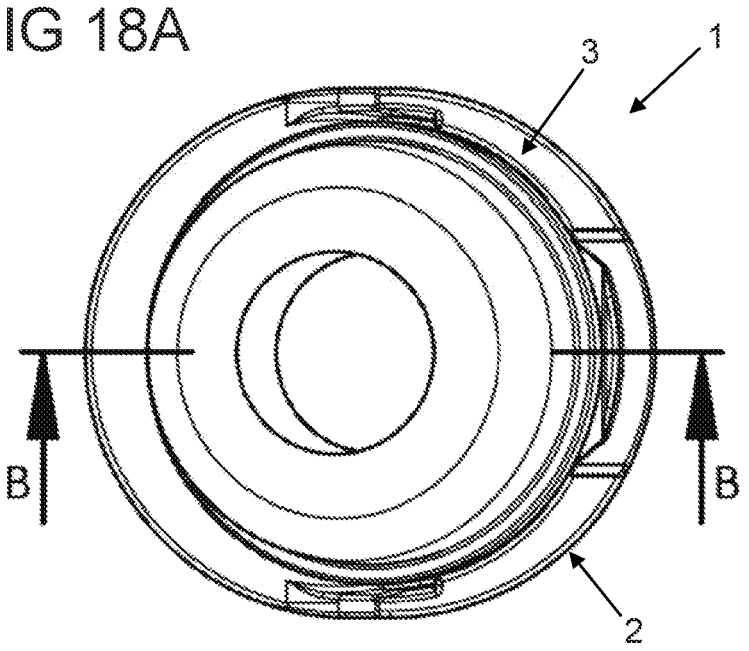
FIG. 18A shows a view of the connecting apparatus during the further closing.
Figure 18B:
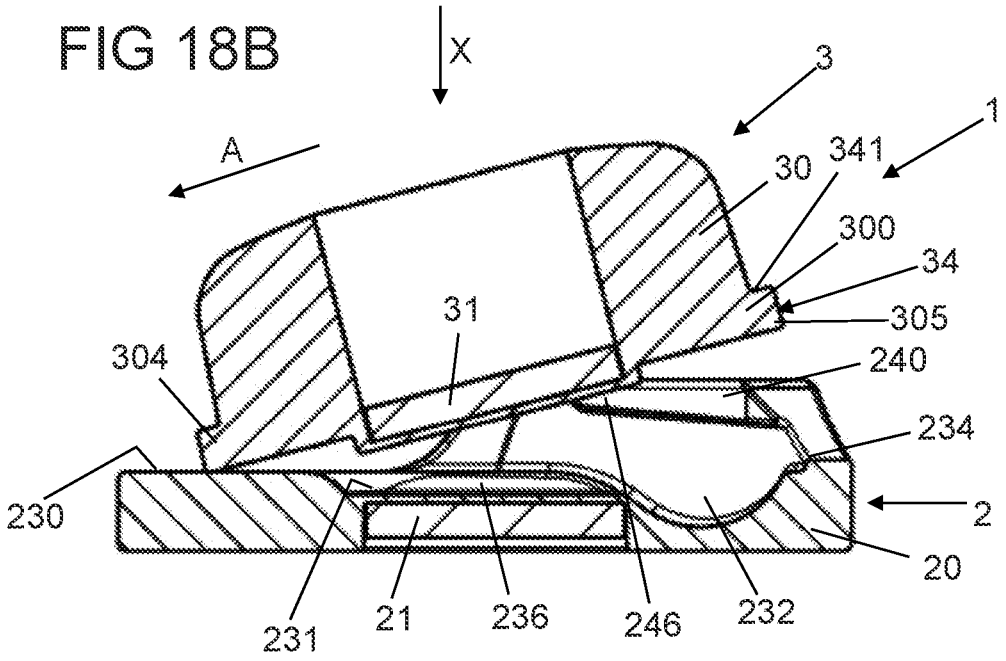
FIG. 18B shows a sectional view along the line B-B according to FIG. 18A.

Thus, the connecting parts 2, 3 are brought toward each other, for example, along a closing direction X which is directed along the vertical direction H, as is apparent from FIGS. 17A and 17B. The magnetic devices 21, 31 interact here in a magnetically attracting manner and draw the connecting parts 2, 3 toward each other along the closing direction X such that the connecting part 3 runs onto the engagement protrusions 240, 241 and slides off at rear ends 246, 247 of the engagement protrusions 240, 241, as is apparent from FIGS. 18A and 18B. The base portion 300 enters here by means of a rear edge portion 304 into contact with the bottom surface 230 such that the connecting part 3 slides along a sliding-off direction A with respect to the connecting part 2 and the base portion 300 is therefore moved on the engagement protrusions 240, 241 until the base portion 300 can pass the engagement protrusions 240, 241 and the connecting part 3 therefore passes into the position according to FIGS. 19A, 19B with respect to the connecting part 2 and the blocking portion is held above the recess 231 such that the connecting parts 2, 3 do not prematurely interlock.

If the base portion 300 has been moved past the engagement protrusions 240, 241 along the closing direction X, the engagement portion 341, which is formed on the base portion 300, slides into engagement in an engagement direction Y with the (rigid) engagement protrusions 240, 241, as is apparent in the transition from FIGS. 19A, 19B to FIGS. 20A, 20B. In the process, the blocking element 303 slides into the recess 231, with magnetic assistance by means of the magnetically attracting effect of the magnetic devices 21, 31.

In the connected position according to FIGS. 20A-20D, the base portion 300 lies with the base surface 302 on the bottom surface 230 of the connecting part 2 in a planar manner. The blocking element 303 lies in the recess 231. A front edge portion 305 of the base portion 300 is in contact with the support portion 233, with the front edge portion 305 also resting on a step 234 between the entry opening 232 and the support portion 233, as is apparent from FIG. 19B. Owing to the fact that the engagement portion 341, which is formed on the base portion 300, is in engagement here with the engagement protrusions 240, 241, the connecting part 3 is held on the connecting part 2 in a positive locking or non-positive locking manner, with the position of the connecting parts 2, 3 being secured by the magnetic devices 21, 31, and, in addition, a disengagement counter to the engagement direction Y is blocked by the blocking element 303.

Owing to the rotational symmetry of the connecting part 3, the connecting part 3 in the connected position can be rotated on the connecting part 2.

In addition, owing to the rotational symmetry, the connecting part 3 can be arranged on the connecting part 2 in any desired rotational position, which permits simple and comfortable connection of the connecting parts 2, 3 to each other.

Figure 19A:
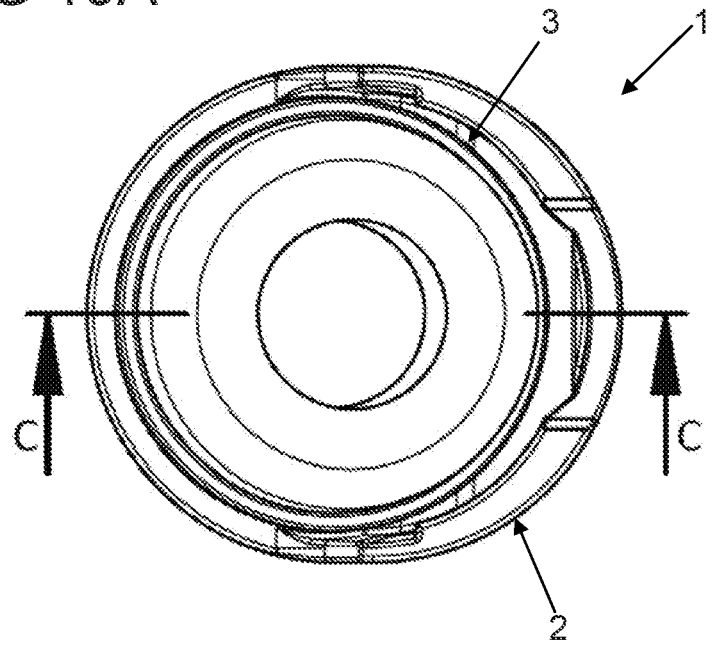
FIG. 19A shows a view of the connecting apparatus during the further closing.
Figure 19B:
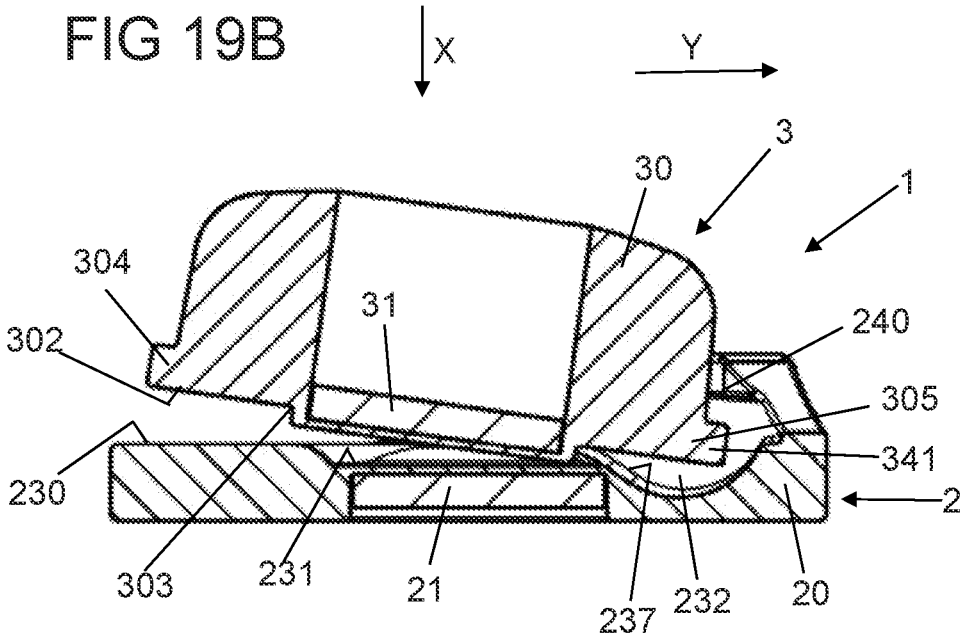
FIG. 19B shows a sectional view along the line C-C according to FIG. 19A.
Figure 20A:
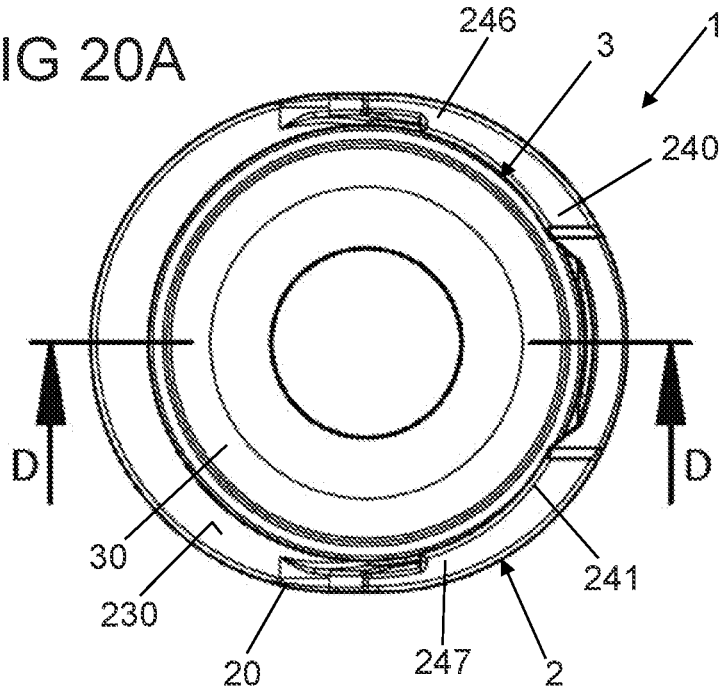
FIG. 20A shows a view of the connecting apparatus in a connected position of the connecting parts.
Figure 20B:
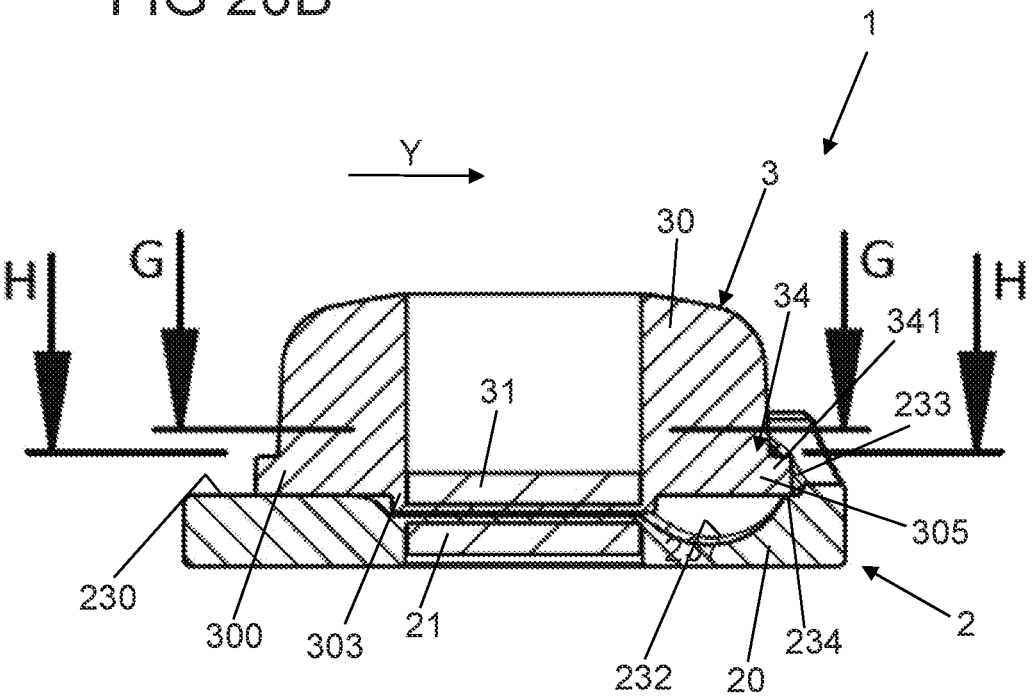
FIG. 20B shows a sectional view along the line D-D according to FIG. 20A.
Figure 20C:
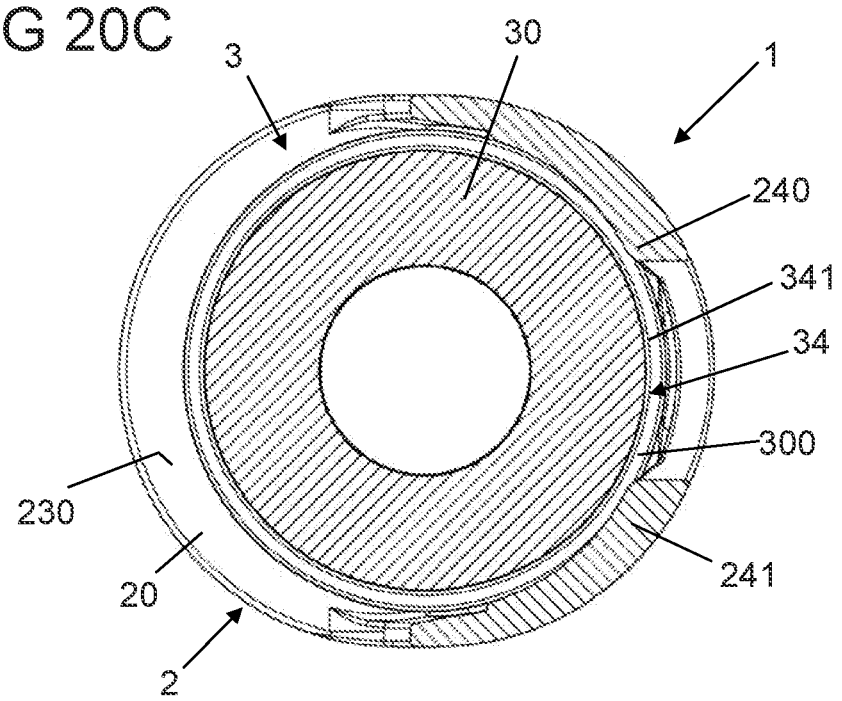
FIG. 20C shows a sectional view along the line G-G according to FIG. 20B.
Figure 20D:
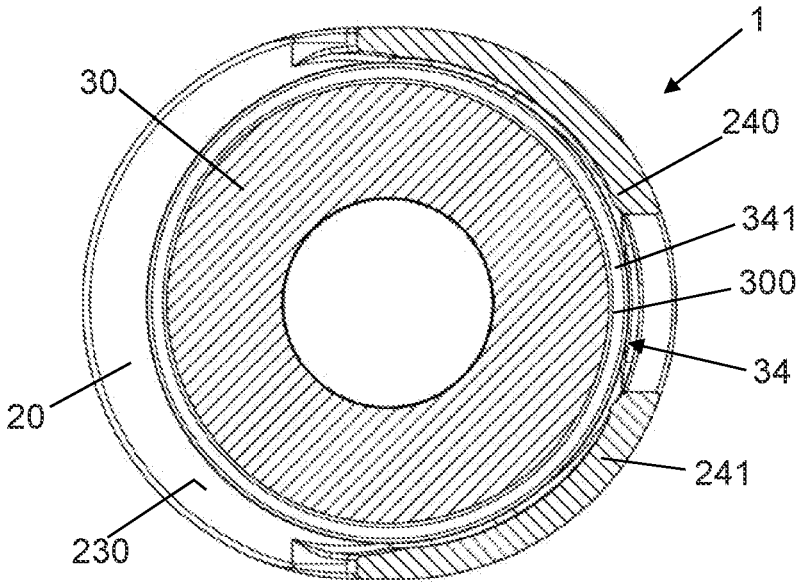
FIG. 20D shows a sectional view along the line H-H according to FIG. 20B.
Figure 21:
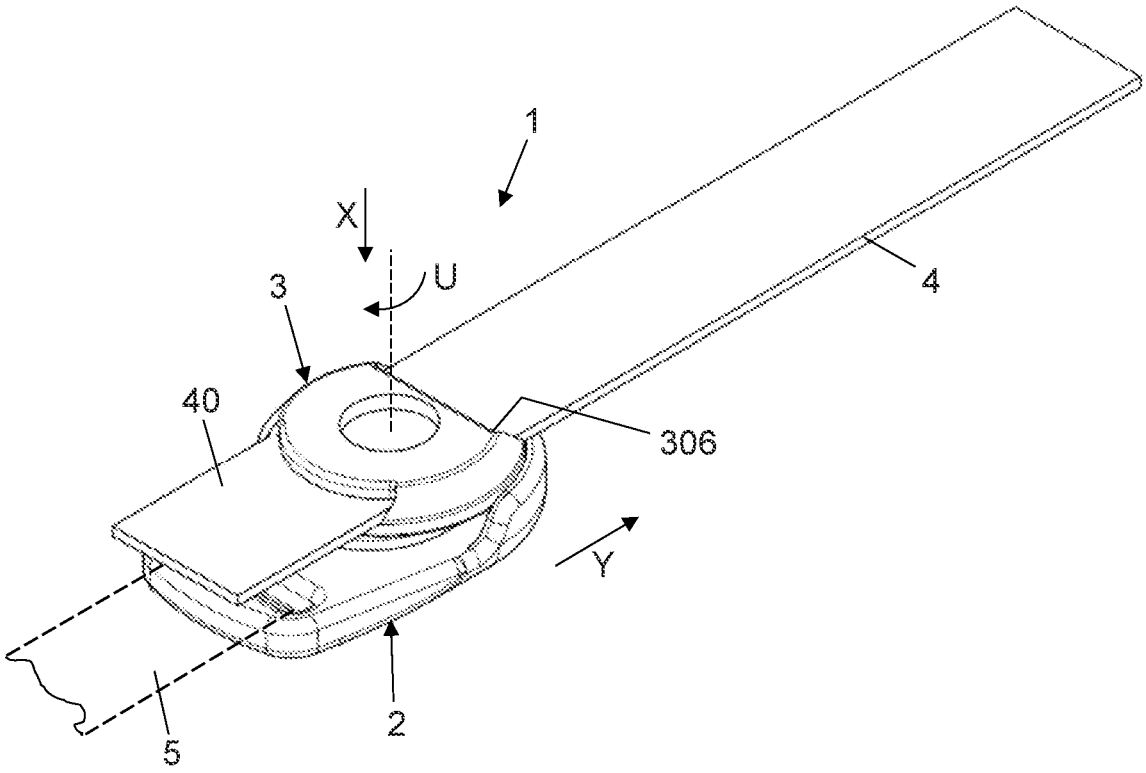
FIG. 21 shows a view of a different exemplary embodiment of a connecting apparatus.
Figure 22A:
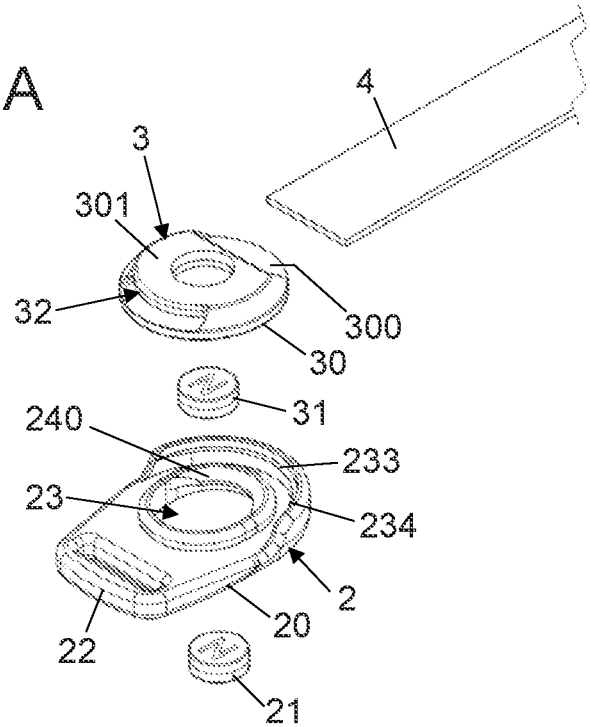
FIG. 22A shows a perspective exploded view of the connecting apparatus.
Figure 22B:
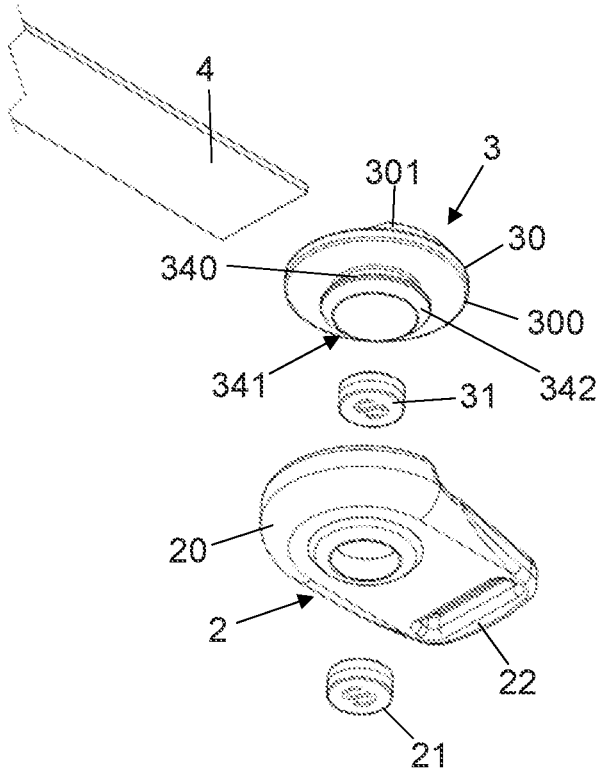
FIG. 22B shows a different exploded view of the connecting apparatus.
Figure 23A:
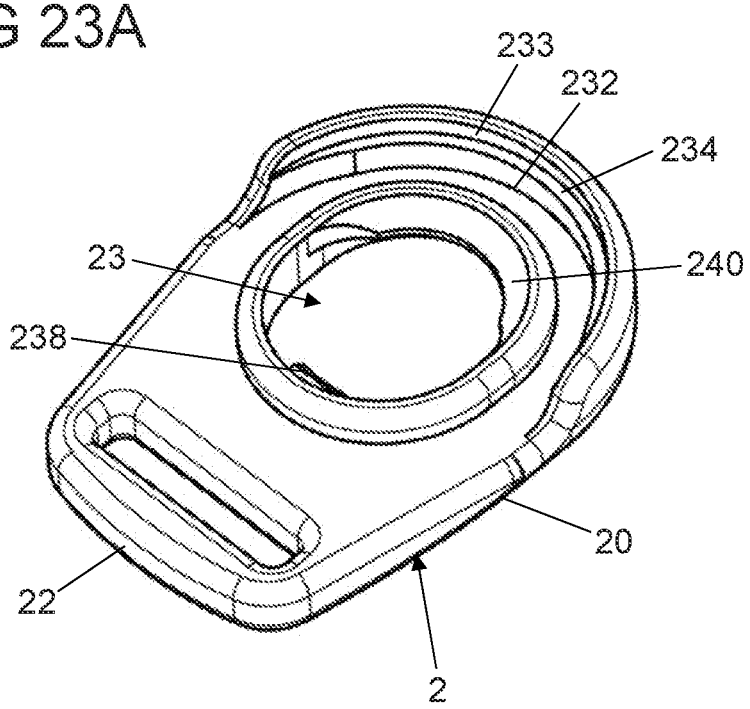
FIG. 23A shows a separate view of a first connecting part of the connecting apparatus.
Figure 23B:
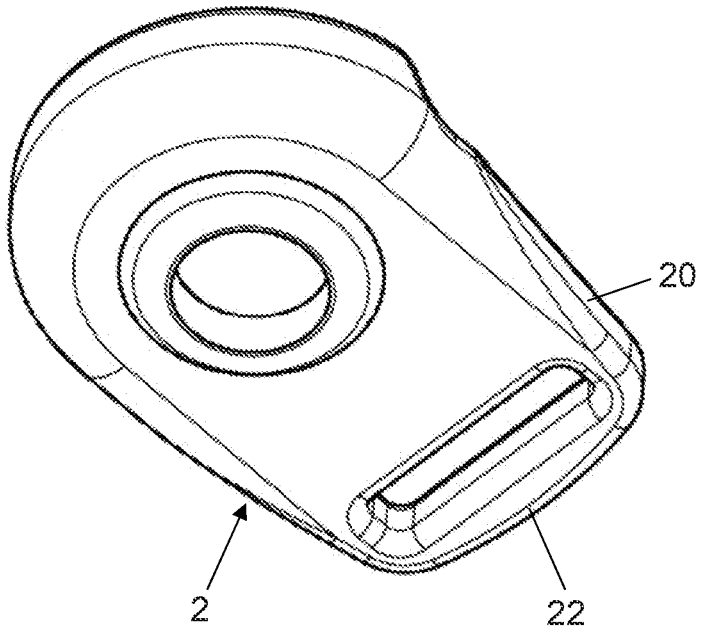
FIG. 23B shows a different view of the first connecting part.

To release the connection 2, 3, the connecting part 3 can be tilted with respect to the connecting part 2 in a tilting plane, which is spanned by the closing direction X and the engagement direction Y, with the engagement portion 341, which is formed by the edge of the base portion 300, entering the entry opening 232, analogously as is apparent from FIG. 19B. The blocking of the blocking element 303 in the recess 231 is therefore removed, and therefore the connecting parts 2, 3 can be removed from each other.

In a further exemplary embodiment, illustrated in FIGS. 21 to 30D, in the form of a webbing fastener, a first connecting part 2 has a basic body 20 on which a receiving opening 23 is formed. A second connecting part 3 can be attached to the first connecting part 2 by a pin element 340, which is formed on a base portion 300 of a basic body 30 of the second connecting part 3, being inserted into the receiving opening 23 and being brought into engagement via an encircling engagement portion 341 with an arcuate engagement protrusion 240 on a wall portion of the receiving opening 23 of the first connecting part 2.

In the exemplary embodiment illustrated, a strap or belt 4 is fixedly connected to the basic body 30 of the connecting part 3 via a fastening portion 301 formed on the base portion 300. The base portion 300 has a circular-cylindrical, disk-shaped basic shape and forms a base surface 302 on a side facing the connecting part 2.

From the base surface 302 there protrudes a pin element 340 which has a mushroom shape and carries the engagement portion 341, which extends in an encircling manner about the closing direction X and realizes an engagement device 34. In the exemplary embodiment illustrated, the engagement portion 341 is therefore spatially separated from the base portion 300 by the engagement portion 341 being spaced apart along the closing direction X from the base portion 300.

In the exemplary embodiment illustrated, there is formed on the engagement portion 341 an oblique surface 342 in the form of a conical surface, with which the engagement portion 341 runs onto the engagement protrusion 240 within the receiving opening 23, when the connecting part 3 is attached to the connecting part 2, and therefore the connecting part 3 is offset with respect to the connection part 2 counter to the engagement direction Y, and the engagement portion 341 is moved past the engagement protrusion 240 until the engagement portion 341 can be brought into engagement with the engagement portion 240 in the engagement direction Y.

The connecting parts 2, 3 each have a magnetic device 21, 31 (see FIGS. 22A, 22B) which are opposite each other in a magnetically attracting manner along the closing direction X and therefore magnetically assist the attachment of the connecting parts 2, 3 in the closing direction X.

In the exemplary embodiment illustrated, the disk-shaped base portion 300 protrudes radially over the engagement portion 341 on the pin element 340, as is apparent from FIGS. 25A, 25B and 26A-26B.

Figure 28A:
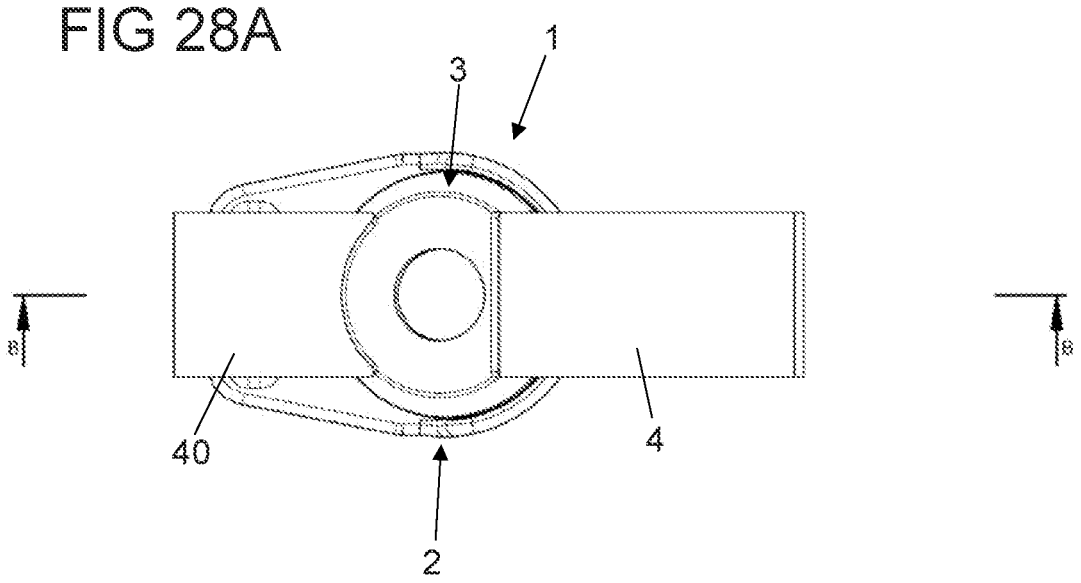
FIG. 28A shows a view of the connecting apparatus during the further closing.
Figure 28B:
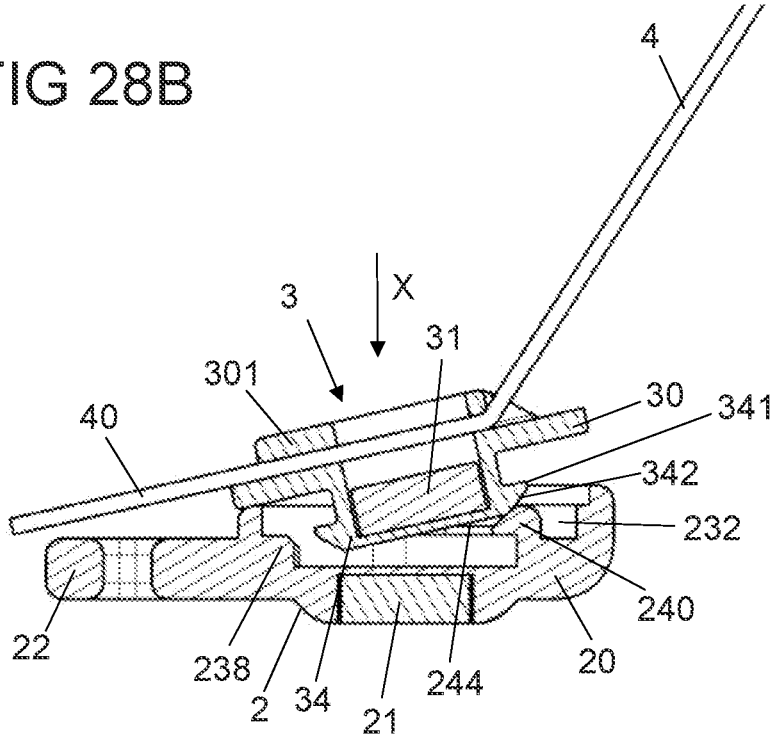
FIG. 28B shows a sectional view along the line B-B according to FIG. 28A.

When the connecting parts 2, 3 are attached to each other, illustrated in the sequence according to FIGS. 27A to 30D, the connecting part 3 is brought toward the connecting part 2 in the closing direction X, with the connecting part 3 being able to execute a wobbling movement in such a manner that first of all the engagement portion 341 comes into contact by means of the oblique surface 342 formed thereon with the engagement protrusion 240 in the receiving opening 23, as is apparent from FIG. 28B, and, by sliding off is moved past the engagement protrusion 240, as is apparent in the transition from FIGS. 28A to 29B.

If the engagement portion 341 has moved past the engagement protrusion 240, the engagement portion 341 enters into engagement in the engagement direction Y with the engagement protrusion 240 because of the magnetic attraction between the magnetic devices 21, 31, and therefore the connecting parts 2, 3 pass into the connected position according to FIGS. 30A-30D.

In the connected position, the engagement portion 341 on the pin element 340 is in engagement with the arcuately curved engagement protrusion 240 on the wall of the receiving opening 23. On a side facing away from the engagement protrusion 240, the engagement portion 341 here faces a blocking portion 238 in the form of a protrusion element projecting into the receiving opening 23 in the engagement direction Y. The blocking portion 238 thereby prevents a tangential movement of the pin element 340 in the receiving opening 23 counter to the engagement direction Y such that the engagement between the engagement portion 341 and the engagement protrusion 240 is blocked.

Figure 30A:
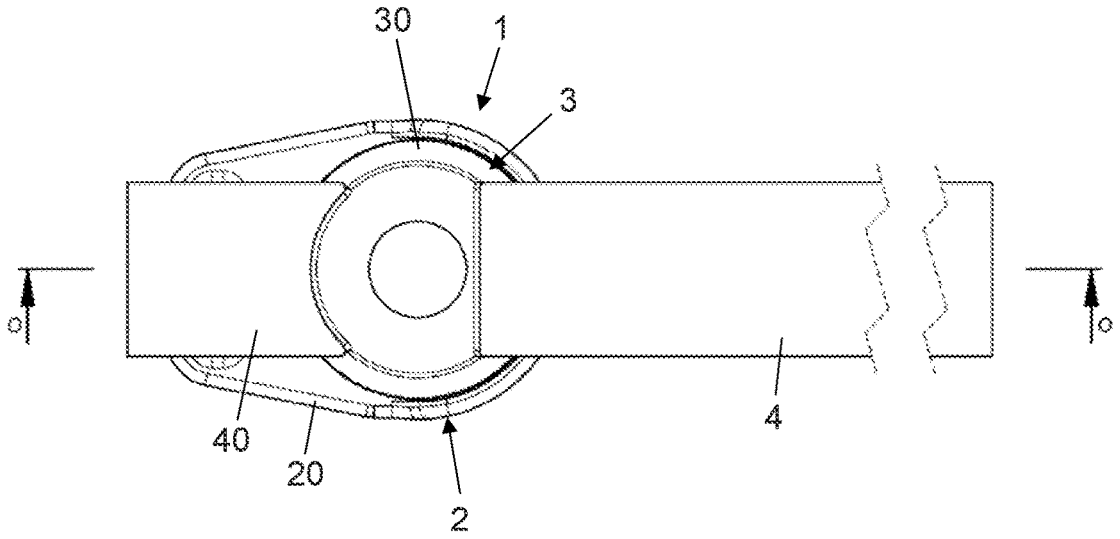
FIG. 30A shows a view of the connecting apparatus in a connected position of the connecting parts.
Figure 30B:
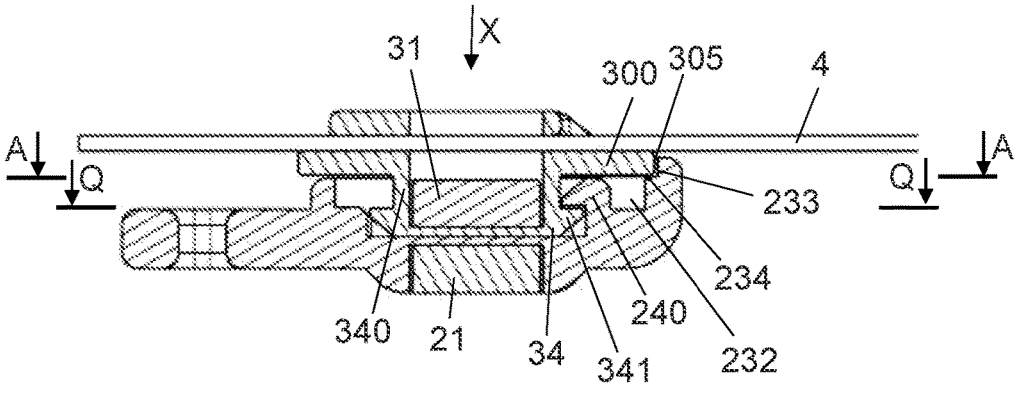
FIG. 30B shows a sectional view along the line O-O according to FIG. 30A.
Figure 30C:
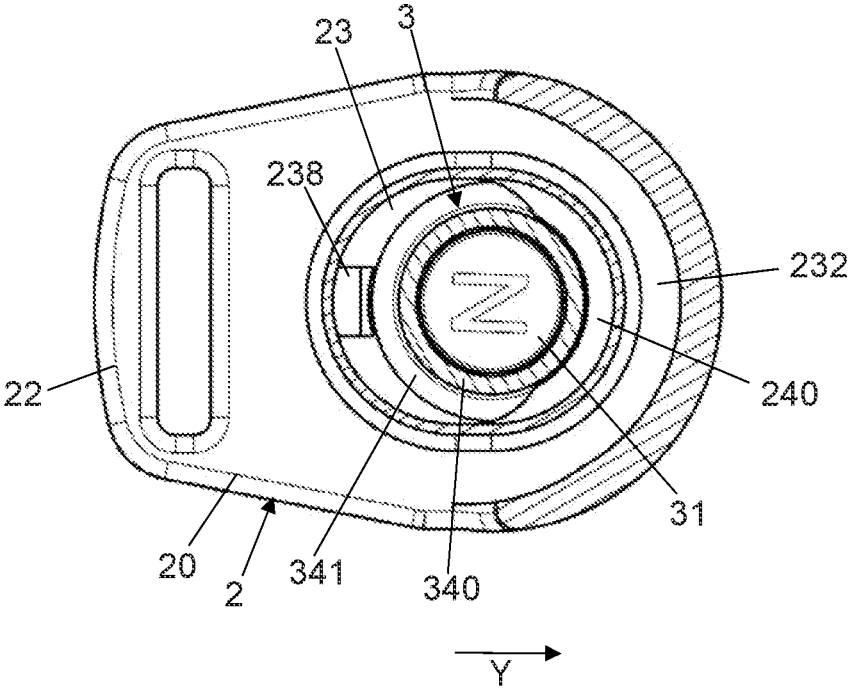
FIG. 30C shows a sectional view along the line A-A according to FIG. 30B.
Figure 30D:
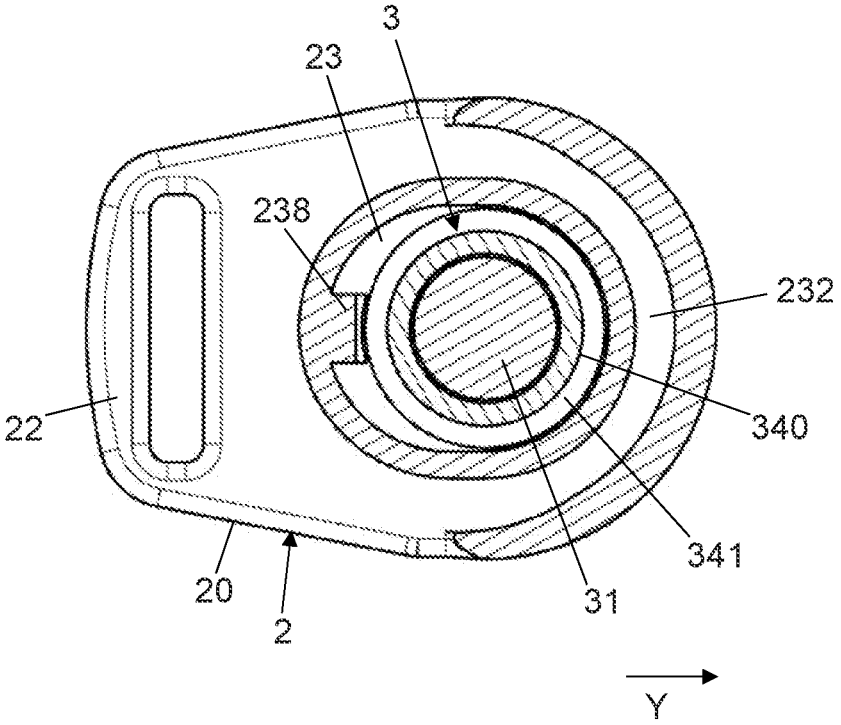
FIG. 30D shows a sectional view along the line Q-Q according to FIG. 30B.

In the connected position, the base portion is in contact by means of a circumferential, outer edge portion 305 with a support portion 233 which is mounted upstream of the engagement protrusion 240 in the engagement direction Y, as is apparent from FIG. 30B. Support is therefore provided on the base portion 300 in the engagement direction Y via the support portion 233 such that, in the event of loading between the connecting parts 2, 3, forces along the load direction corresponding to the engagement direction Y are absorbed and conducted away on the support portion 233.

As is also apparent from FIG. 30B, a positive locking portion 234 is formed in the region of the support portion 233 in the form of a step on which the base portion 300 rests by means of the edge portion 305 in the closing direction X. Via the step, tilting of the base portion 300 and therefore of the connecting part 3 in relation to the connecting part 2 is counteracted in order to exclude an inadvertent release of the connecting parts 2, 3 under load.

Figure 29A:
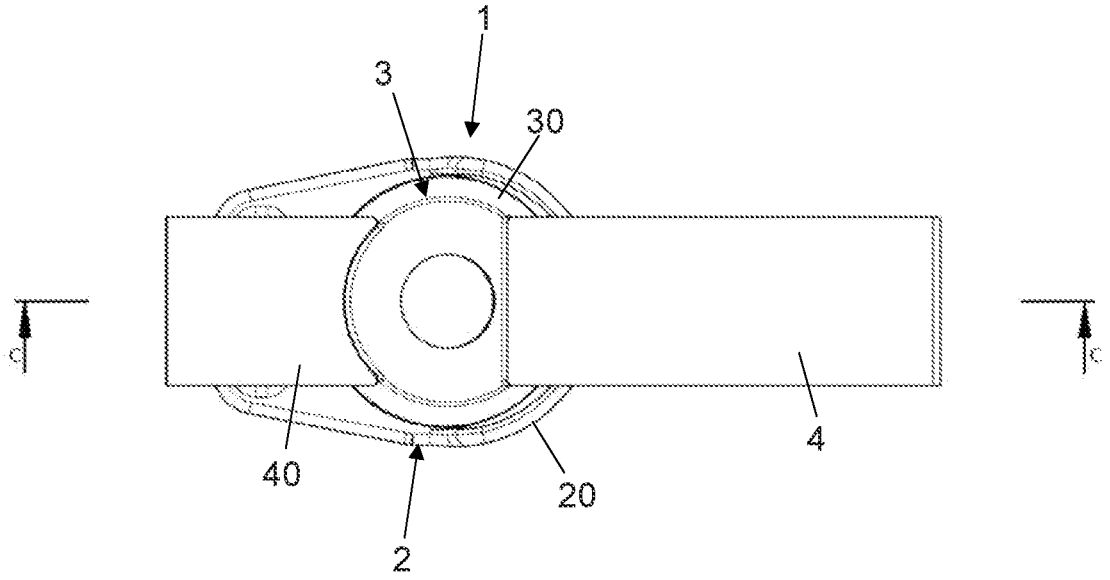
FIG. 29A shows a view of the connecting apparatus during the further closing.
Figure 29B:
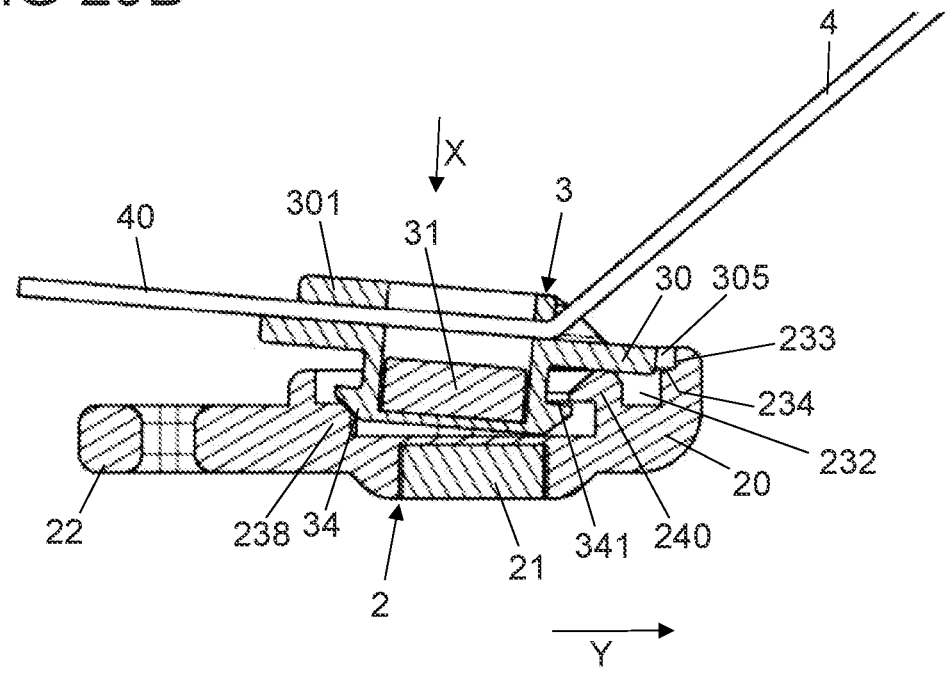
FIG. 29B shows a sectional view along the line C-C according to FIG. 29A.

As is apparent from FIG. 30B together with FIG. 29B, the step 234 is adjoined by an entry opening 232 which serves to provide a clearance in which the base portion 300 can enter during tilting relative to the connecting part 2, 3, as is apparent from FIG. 29B.

If the connecting parts 2, 3 are to be separated from each other, a user can pull on an actuating portion in the form of a tab 40 on the rear side of the connecting part 3 and can therefore lift the pin element 340 out of the receiving opening 23 on a side facing away from the engagement protrusion 240, as is apparent from FIG. 29B. The base portion 300 enters the entry opening 232 by means of a front region facing the support portion 233, which facilitates tilting of the connecting part 3 in relation to the connecting part 2 in order to release the connecting parts 2, 3 from each other.

In the connected position, analogously to in the starting example according to FIGS. 1 to 12F, tilting in the event of loading is counteracted by the support against the step 234. The entry opening 232 is used here, in a region adjoining the step 234 counter to the engagement direction Y, to provide a clearance in which the base portion 300 can enter by means of its encircling edge portion when the connecting parts 2, 3 are tilted with respect to each other in order to separate the connection.

In the exemplary embodiment illustrated in FIGS. 21 to 30D, the engagement portion 341 is not formed on the disk-shaped base portion 300, but rather on the pin element 340 protruding from the base portion 300 along the closing direction X, and therefore the engagement portion 341 is spaced apart from the base portion 300 along the closing direction X and, in addition, the encircling edge portion 305 of the base portion 300 is arranged radially outside the engagement portion 241.

The engagement portion 341 is therefore spatially separated from the base portion 300. In addition, the production of a positive lock or non-positive lock via the engagement portion 341 is functionally separate from the support of the base portion 300 on the support portion 233 and the positive locking portion 234. This can, for example, promote the support of the base portion 300 for load absorption on the support portion 233 and, in addition, for counteracting tilting via the positive locking portion 234 by the base portion 300 being able to provide a comparatively large lever arm in comparison to the engagement portion 341 for support purposes.

Figure 24A:
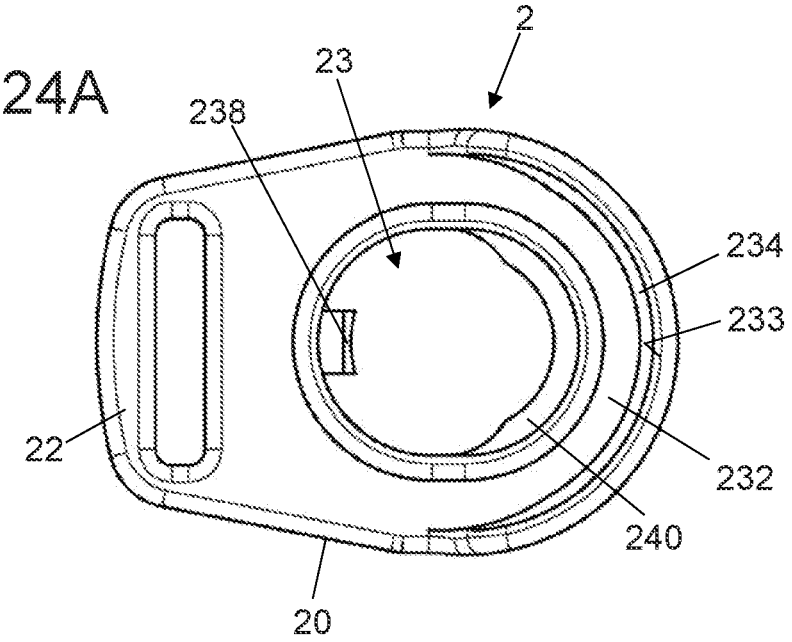
FIG. 24A shows a top view of the first connecting part.
Figure 24B:
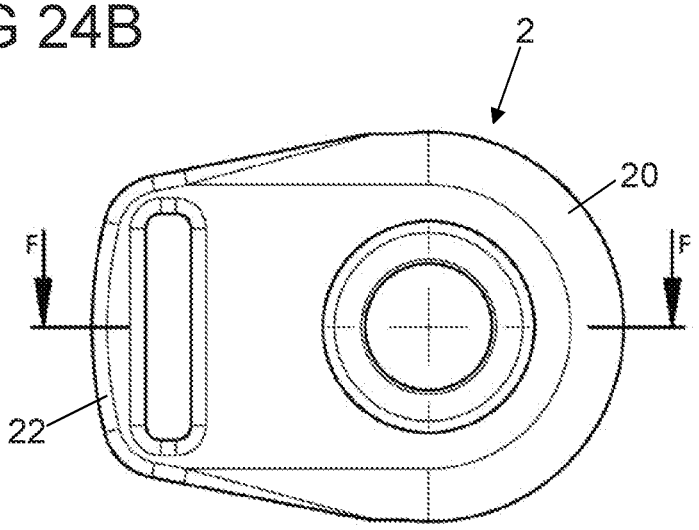
FIG. 24B shows a view of the first connecting part from below.
Figure 24C:
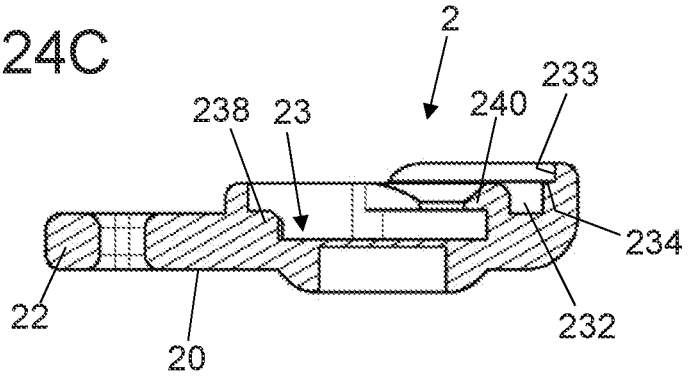
FIG. 24C shows a sectional view along the line F-F according to FIG. 24B.
Figure 25A:
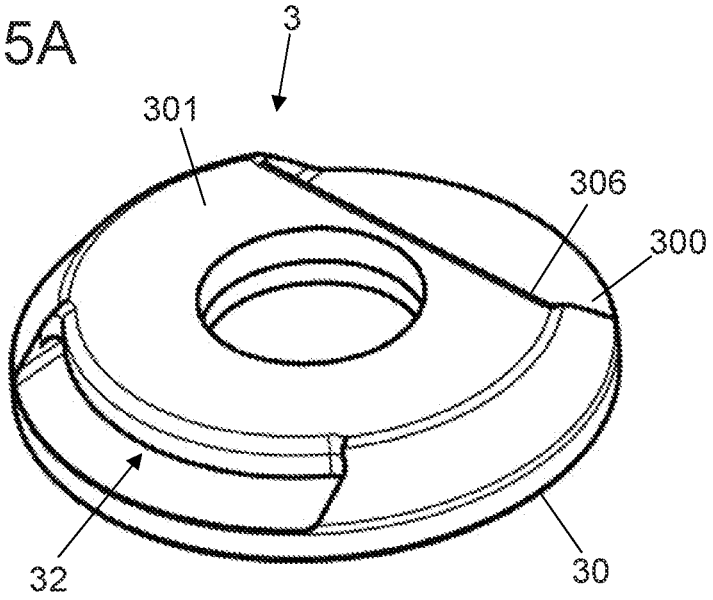
FIG. 25A shows a view of a second connecting part of the connecting apparatus.
Figure 25B:
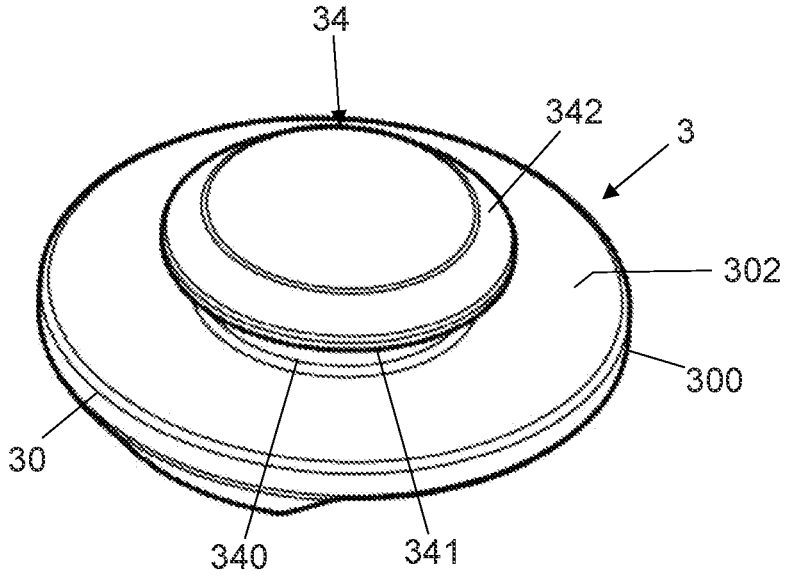
FIG. 25B shows a different view of the second connecting part.
Figure 26A:
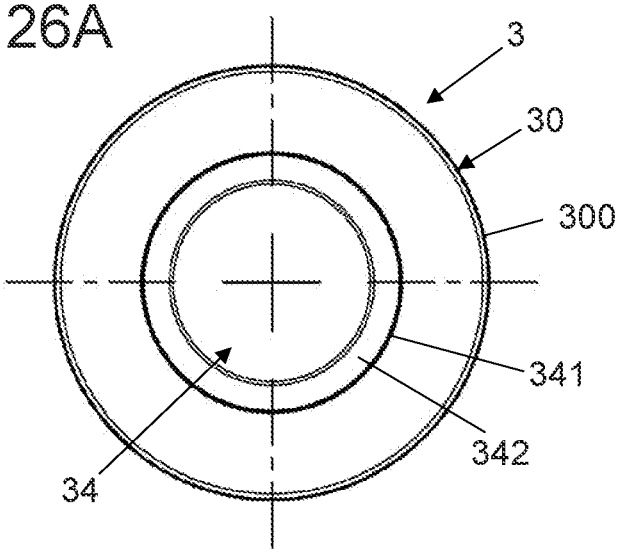
FIG. 26A shows a view of the second connecting part from below.
Figure 26B:
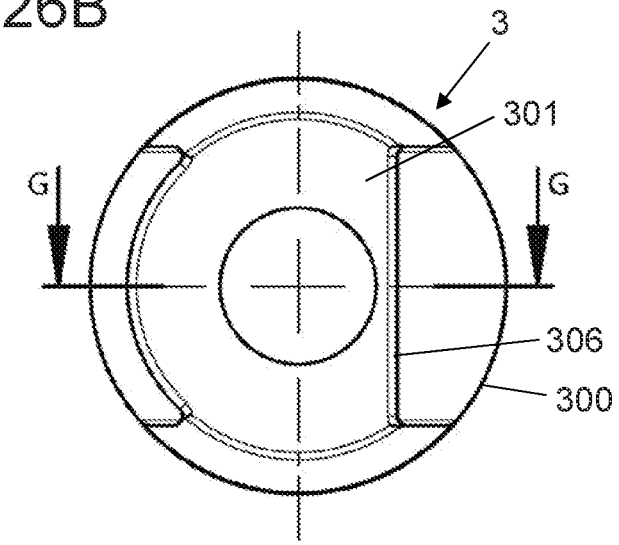
FIG. 26B shows a top view of the second connecting part.
Figure 26C:
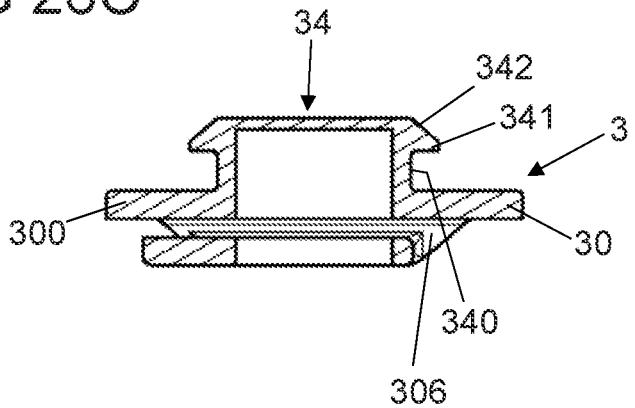
FIG. 26C shows a sectional view along the line G-G according to FIG. 26B.
Figure 27A:
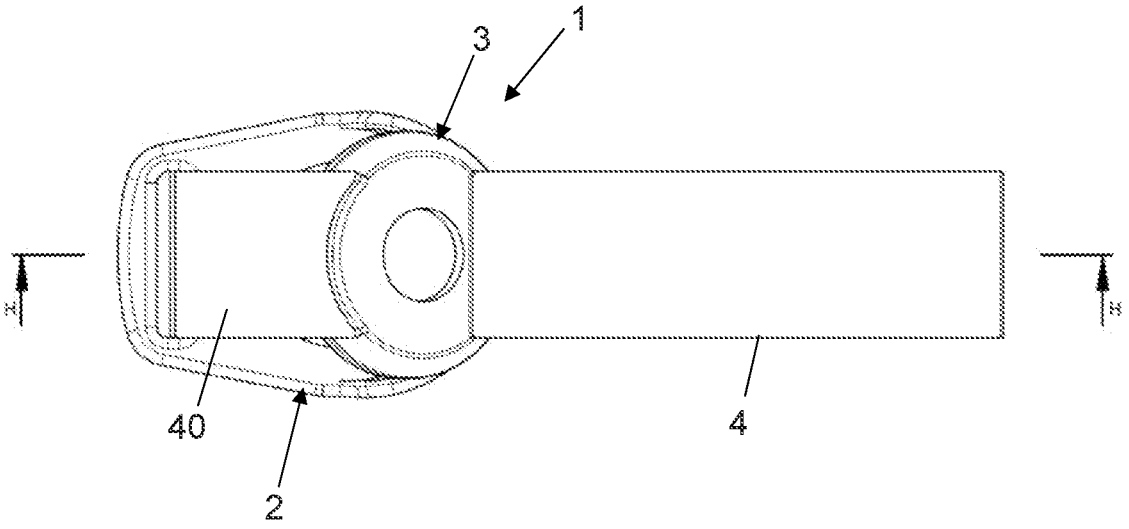
FIG. 27A shows a view of the connecting apparatus during the closing.
Figure 27B:
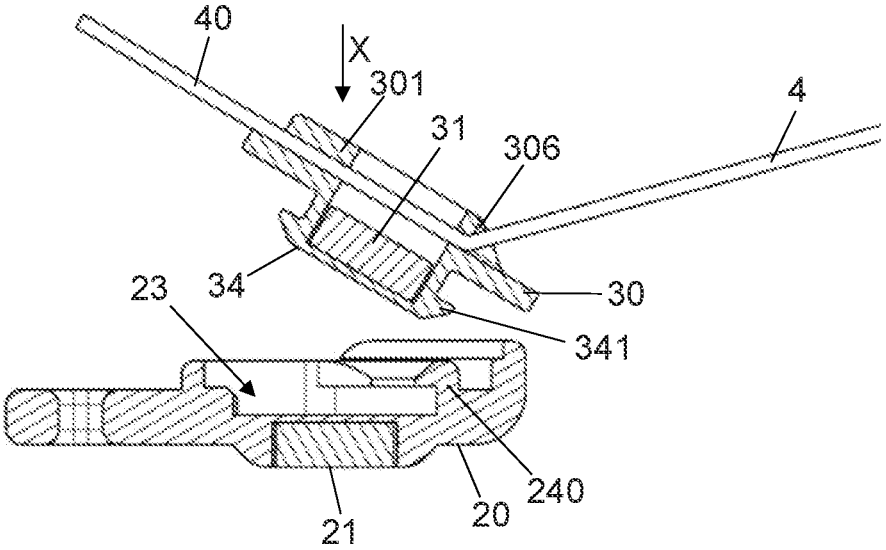
FIG. 27B shows a sectional view of the connecting apparatus along the line A-A according to FIG. 27A.

In the exemplary embodiment according to FIGS. 21 to 30D, the support portion 233 is formed rigidly on the basic body 20 of the connecting part 2 by a surface portion which extends perpendicular to a direction radial to the closing direction X and is curved arcuately about the closing direction X, as is apparent from FIG. 30B in conjunction with FIG. 24A. The positive locking portion 234 in the form of the step is likewise curved arcuately and therefore forms a support for the edge portion 305 of the base portion 300.

Figure 31A:
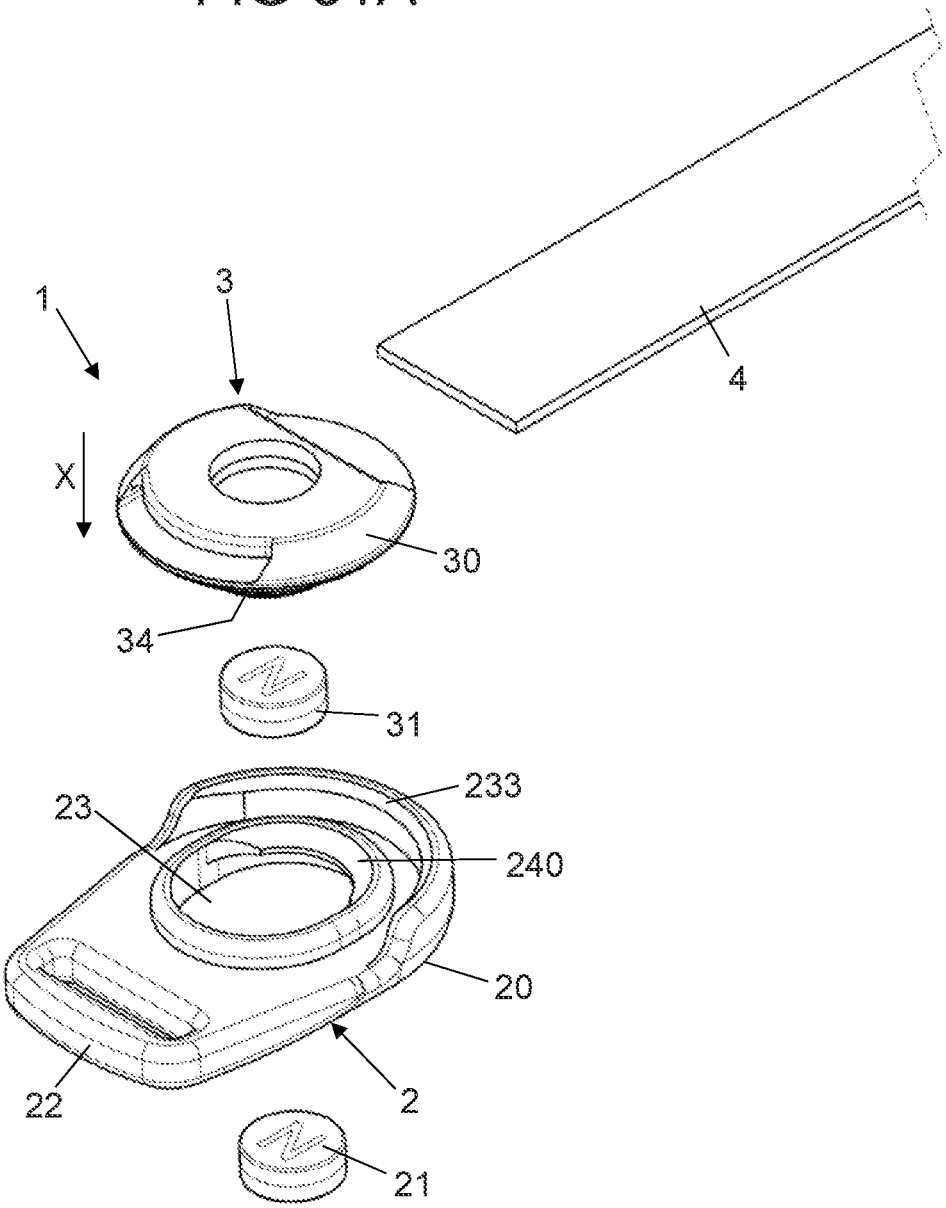
FIG. 31A shows an exploded view of yet another exemplary embodiment of a connecting apparatus.
Figure 31B:
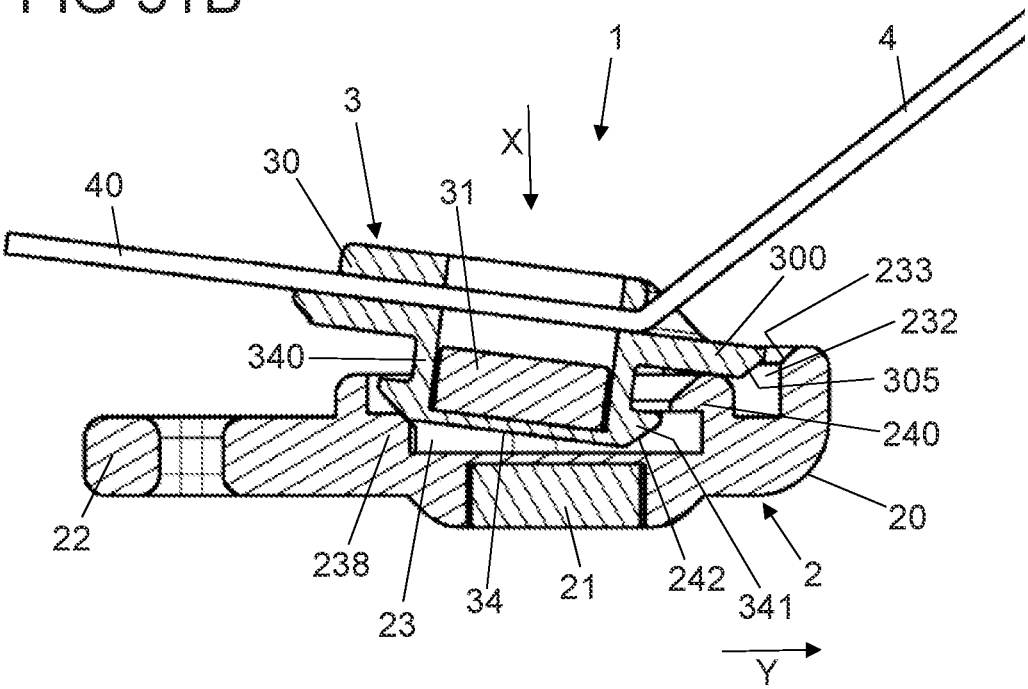
FIG. 31B shows a sectional view of the connecting apparatus during the closing, corresponding to the sectional view according to FIG. 29B.
Figure 31C:
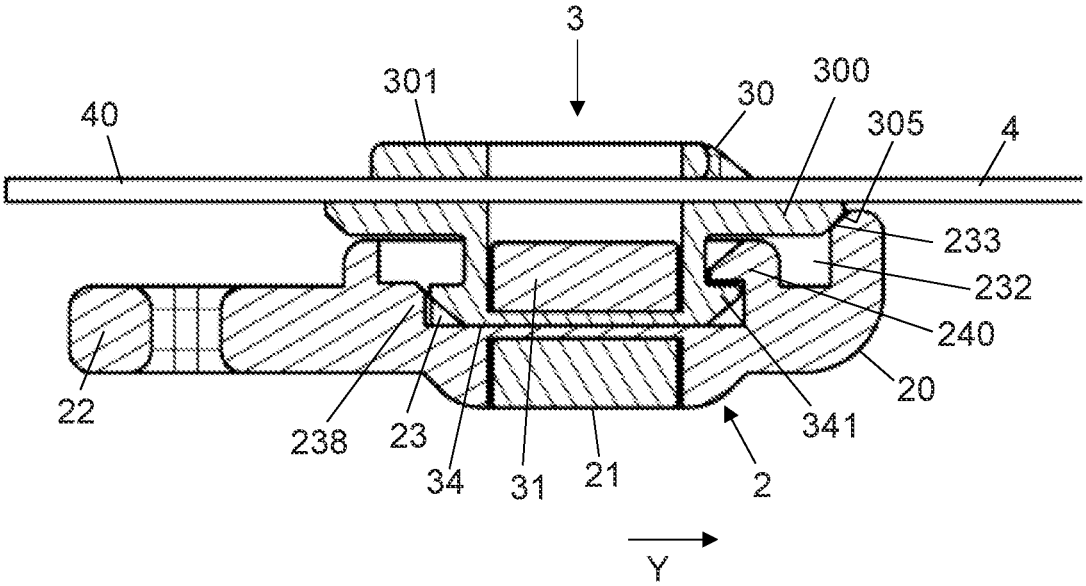
FIG. 31C shows a sectional view of the connecting apparatus in a connected position of the connecting parts, corresponding to the sectional view according to FIG. 30B.
Figure 32:
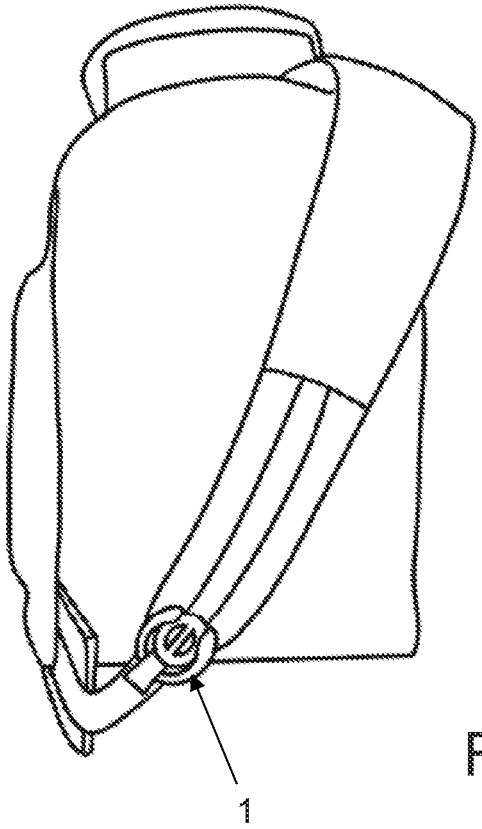
FIGS. 32 to 58 show views of different possible uses of the connecting apparatus.
Figure 33:
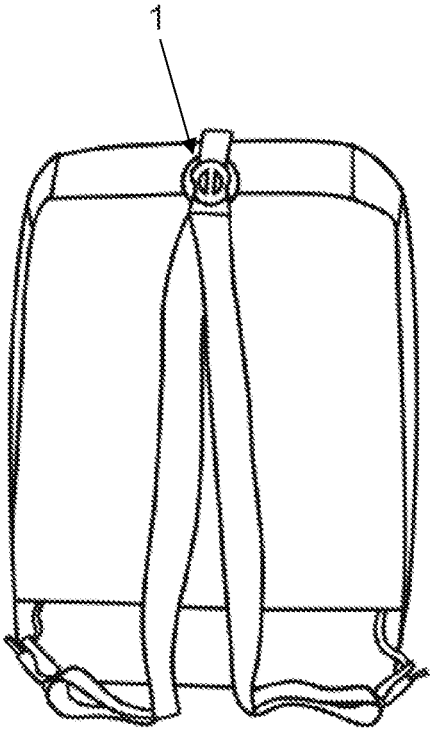
Figure 34:
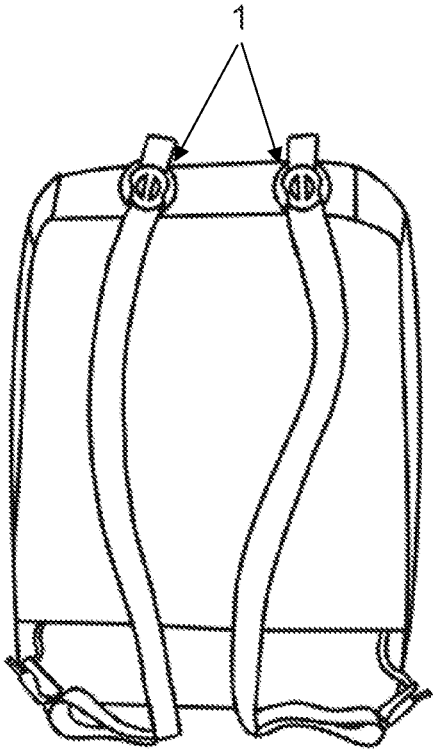
Figure 35:
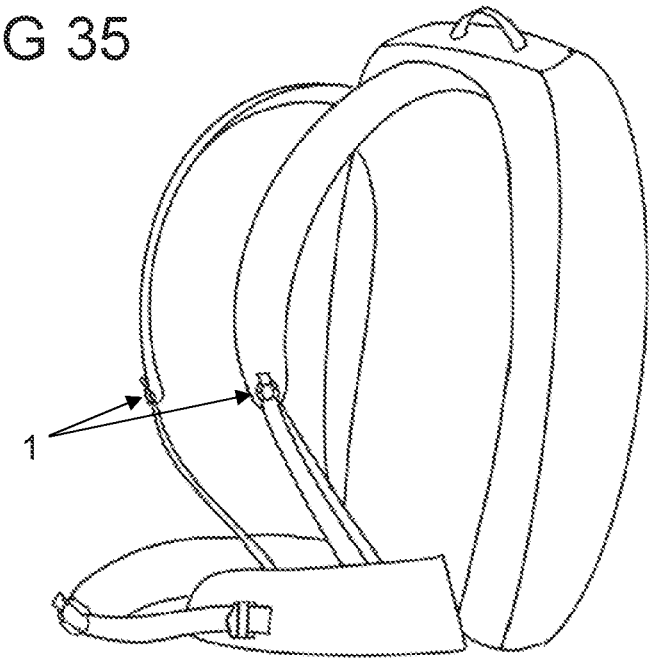
Figure 36:
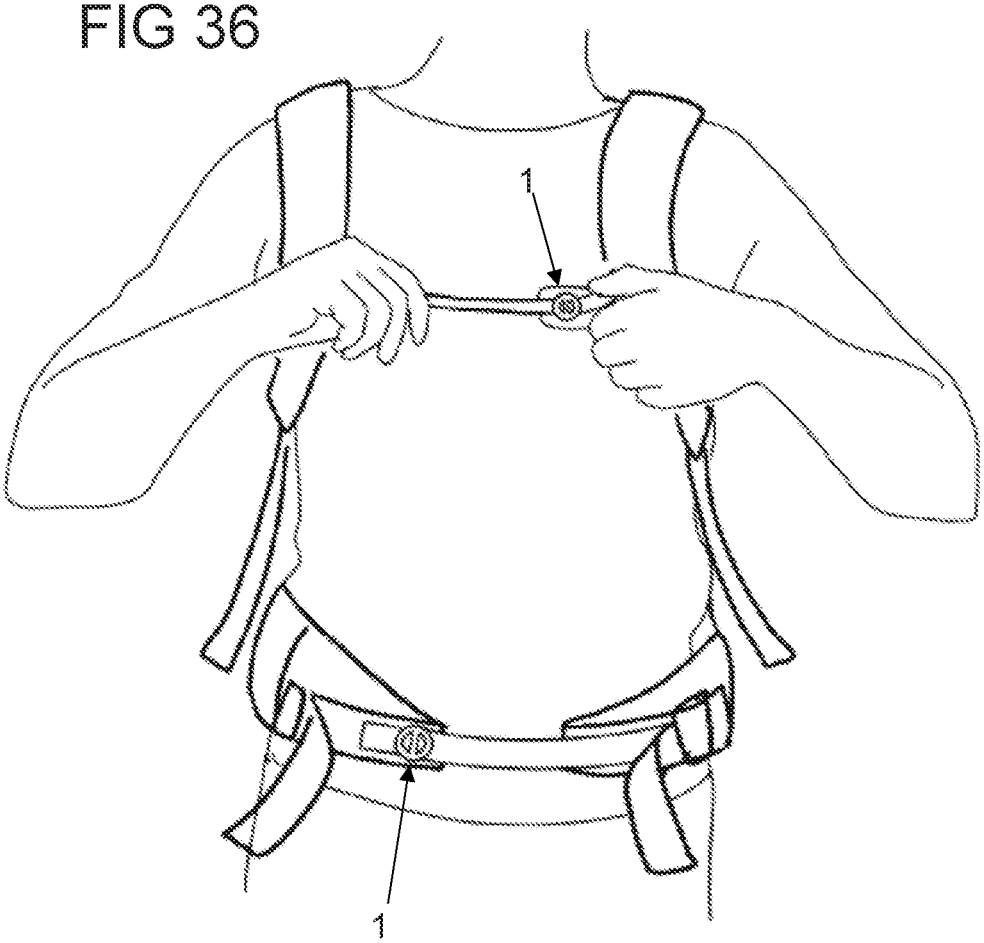

In a modified exemplary embodiment illustrated in FIGS. 31A-31C, an arcuate support portion 233, which extends obliquely to the closing direction X, by contrast jointly carries out the function of the support portion 233 and of the positive locking portion 234 of the exemplary embodiment according to FIGS. 21 to 30D. The obliquely extending support portion 233 of the exemplary embodiment according to FIGS. 31A-31C forms a support for an oblique edge portion 305 of the base portion 300 of the connecting part 3, and therefore the support portion 233 is used to provide support in the engagement direction Y and also support against tilting, i.e. counter to a movement of the base portion 300 in the front region in the closing direction X.

Otherwise the exemplary embodiment according to FIGS. 31A-31C is identical to the exemplary embodiment according to FIGS. 21 to 30D, and therefore reference should also be made to the previous explanations.

FIGS. 32-58 show exemplary uses of a connecting apparatus 1 as has been described with reference to the exemplary embodiments according to FIGS. 1-31.

Figure 37:
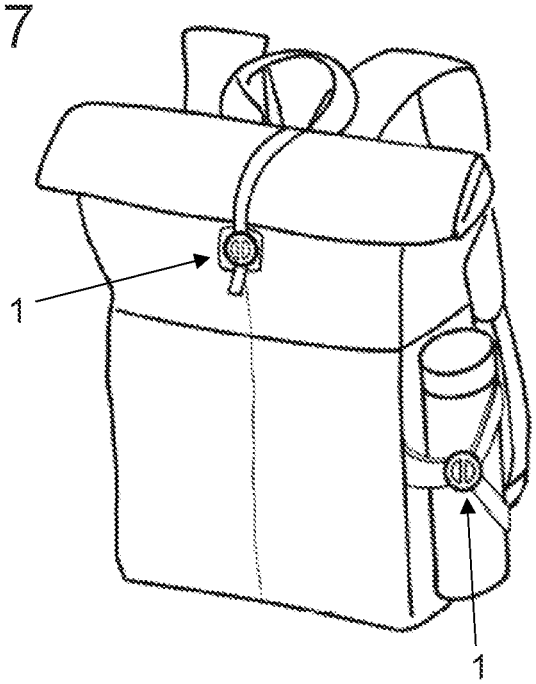
Figure 38:
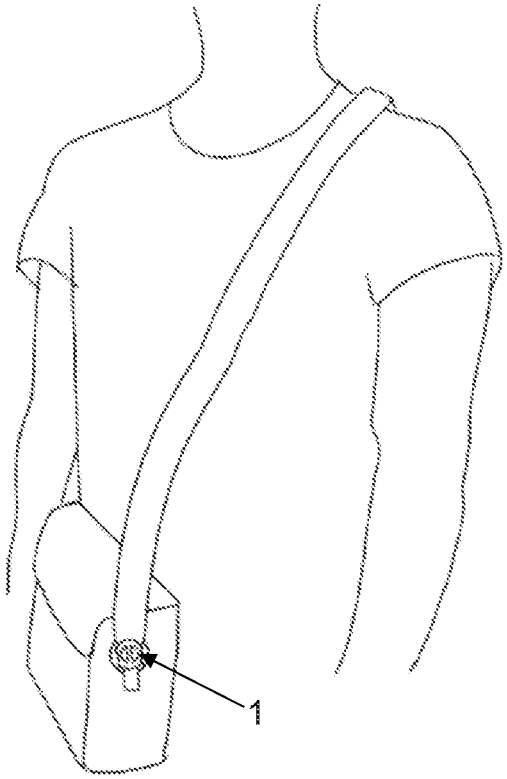
Figure 39:
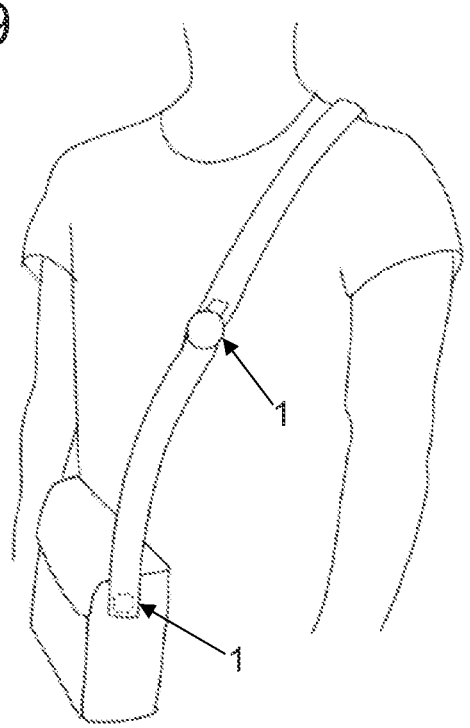
Figure 40:
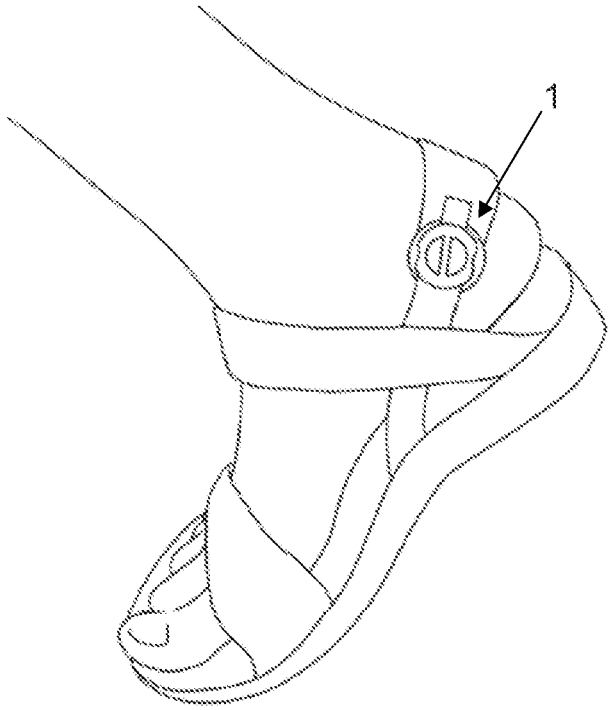
Figure 41:
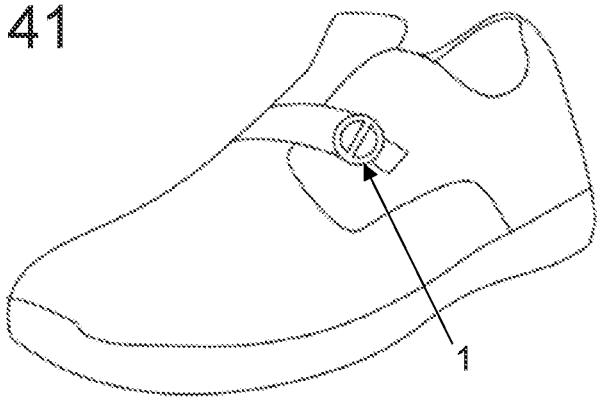
Figure 42:
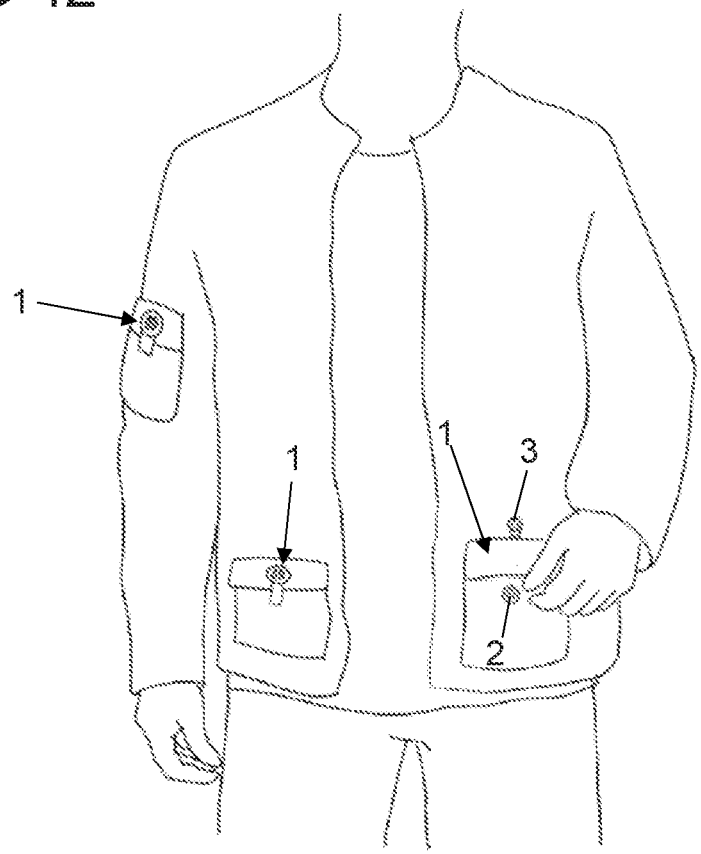

A connecting apparatus 1 can be used, for example, on a bag or a rucksack, as illustrated in FIGS. 32-39. The connecting apparatus 1 can be used here for connecting strap ends (FIGS. 32, 35, 36 and 39), for connecting straps to a bag body (FIGS. 33, 34 and 38) or for closing a cover of a bag or of a rucksack or for attaching an object to the bag or to the rucksack (FIG. 37).

Figure 43:
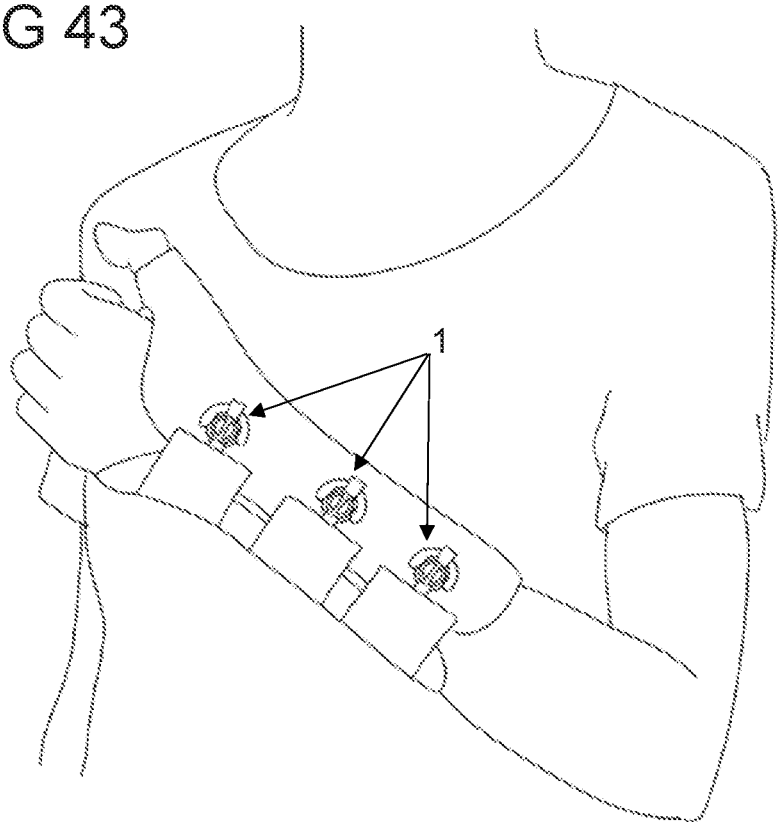
Figure 44:
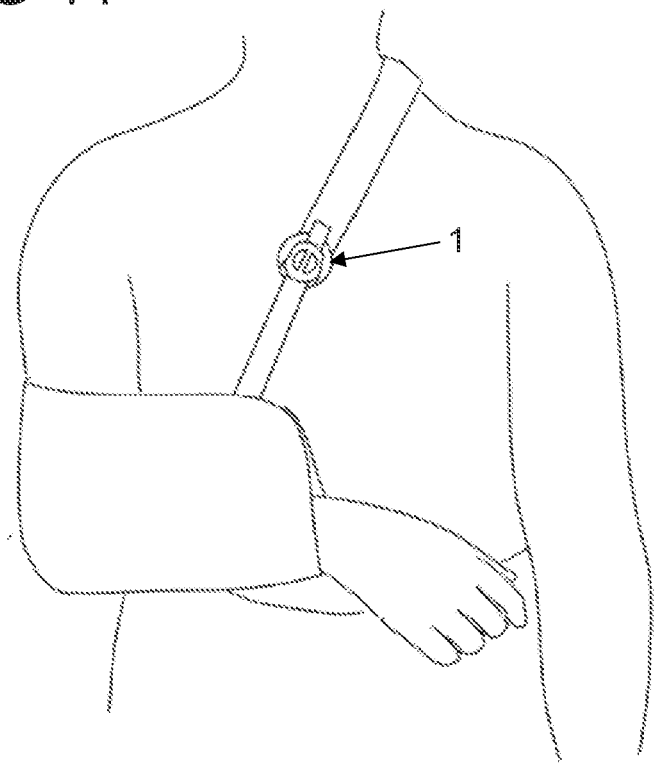
Figure 45:
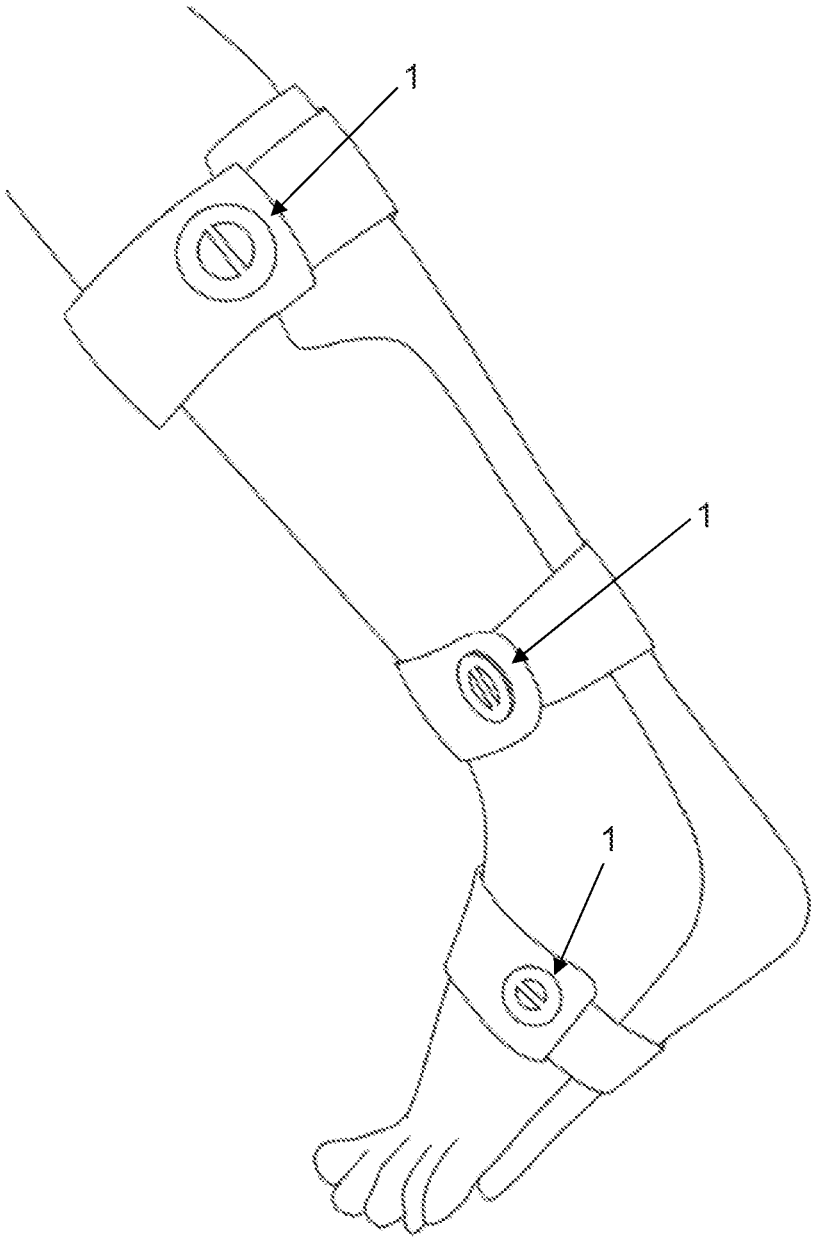
Figure 46:
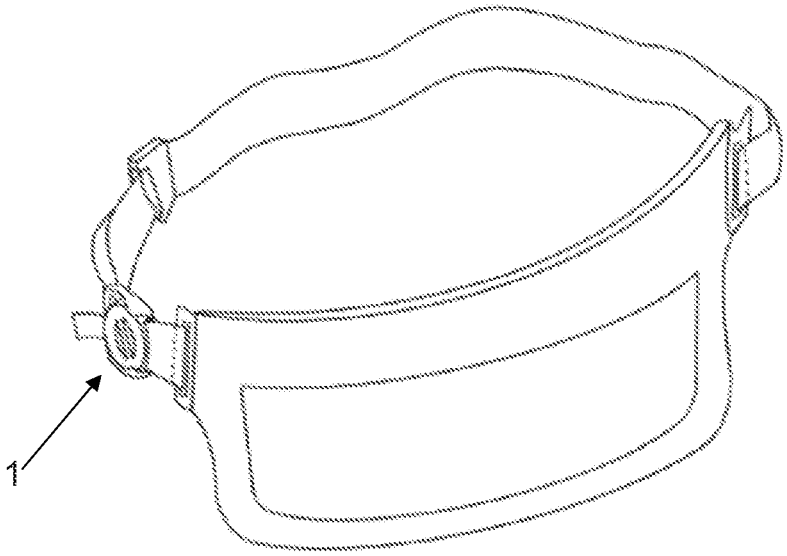

The connecting apparatus 1 can be used as a fastener for a shoe (FIGS. 40 and 41), as a fastener for pockets on a textile object, for example a jacket or waistcoat (FIG. 42), or as a fastener for a medical bandage (FIGS. 43-45).

Figure 47:
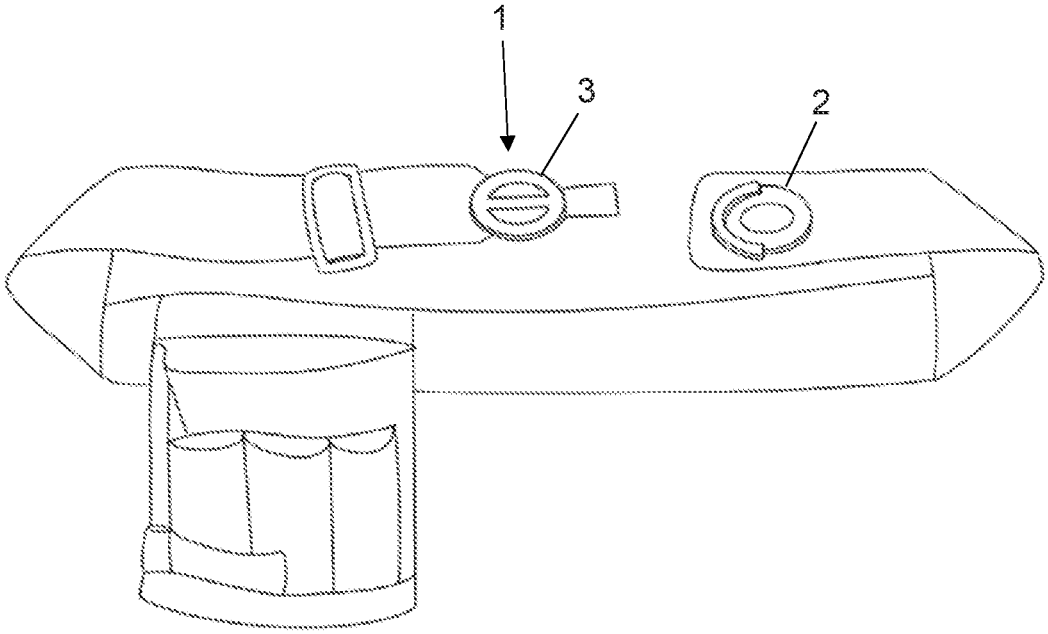

The connecting apparatus 1 can be used as a fastener for a belt bag (FIG. 46) or for a tool-holding belt (FIG. 47).

Figure 48:
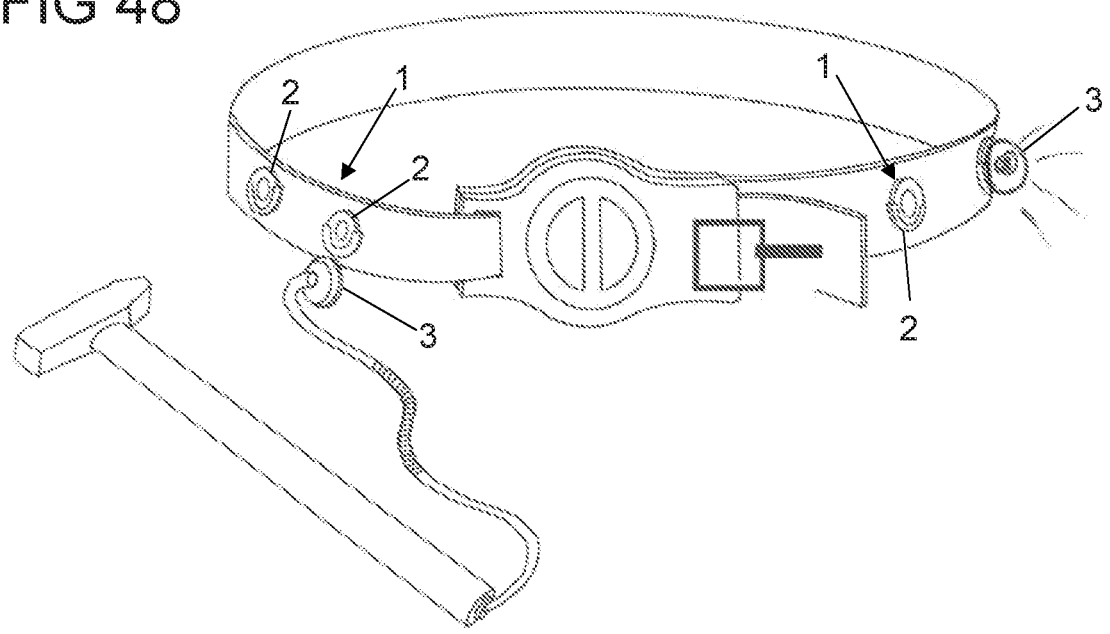

Equally, the connecting apparatus 1 can be used as a holder for objects, in particular tools or objects, for example an electronic appliance, a light or the like, on a belt, in particular a tool belt (FIG. 48).

Figure 49:
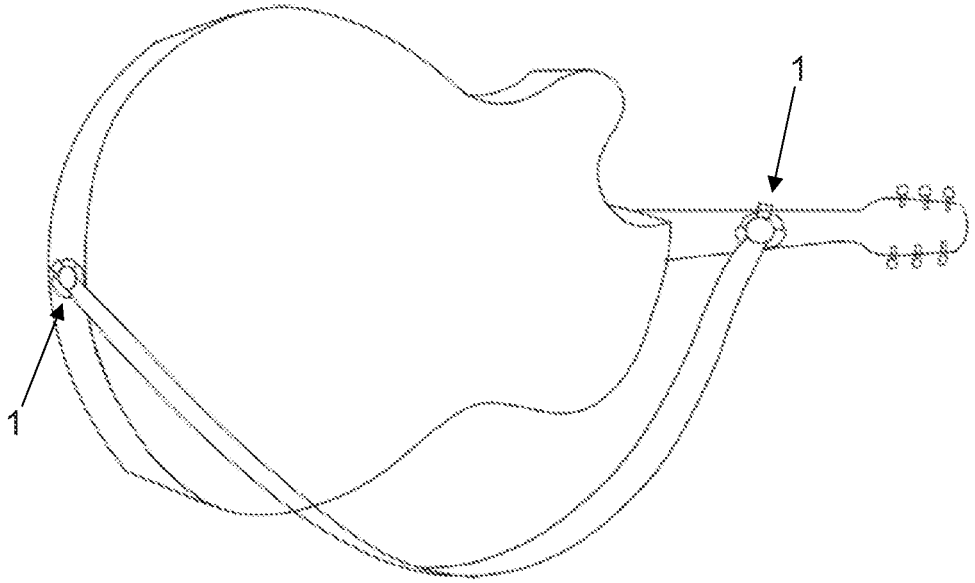

The connecting apparatus 1 can be used as a fastener for a strap on a musical instrument, for example a guitar (FIG. 49).

Figure 50:
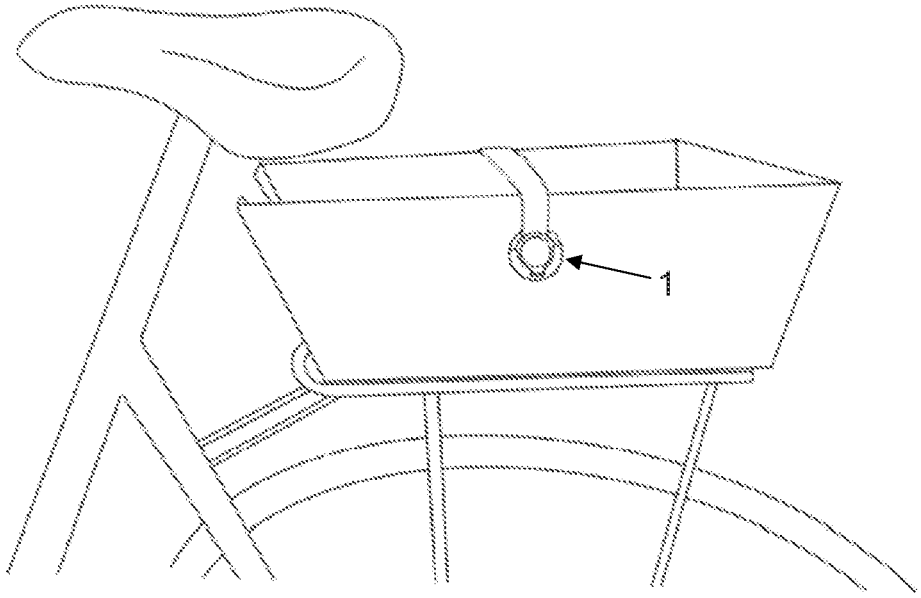

The connecting apparatus 1 can be used, for example, for fastening a strap to a bicycle, for example to a luggage rack or a basket on a bicycle (FIG. 50).

Figure 51:
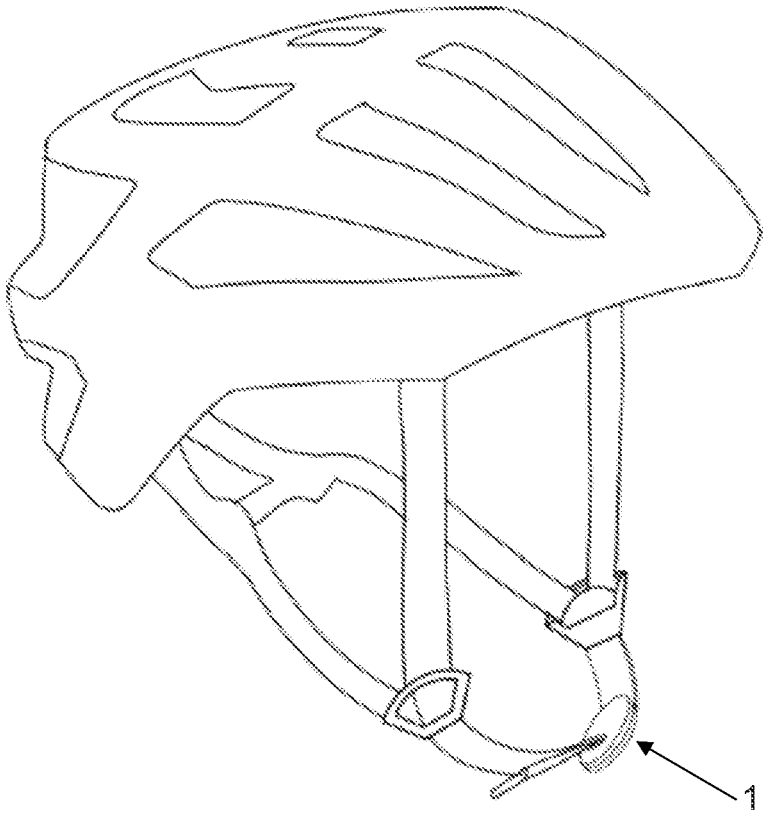

The connecting apparatus 1 can also be used as a fastener for a helmet (FIG. 51).

Figure 52:
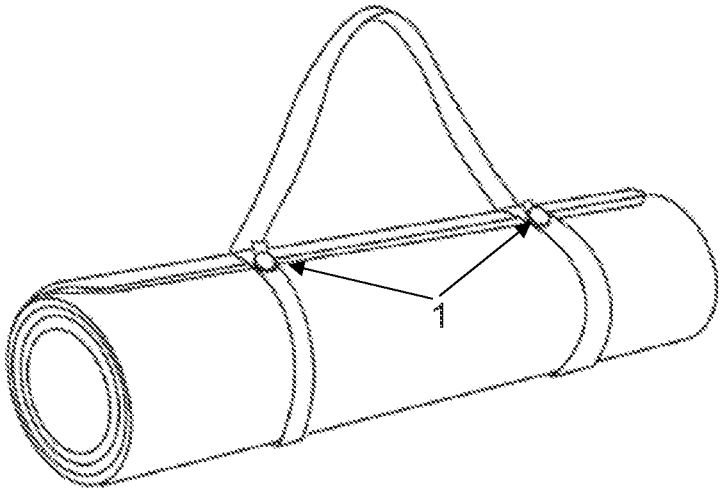

The connecting apparatus 1 can provide a strap fastener for tying up an object, for example a mat (FIG. 52).

Figure 53:
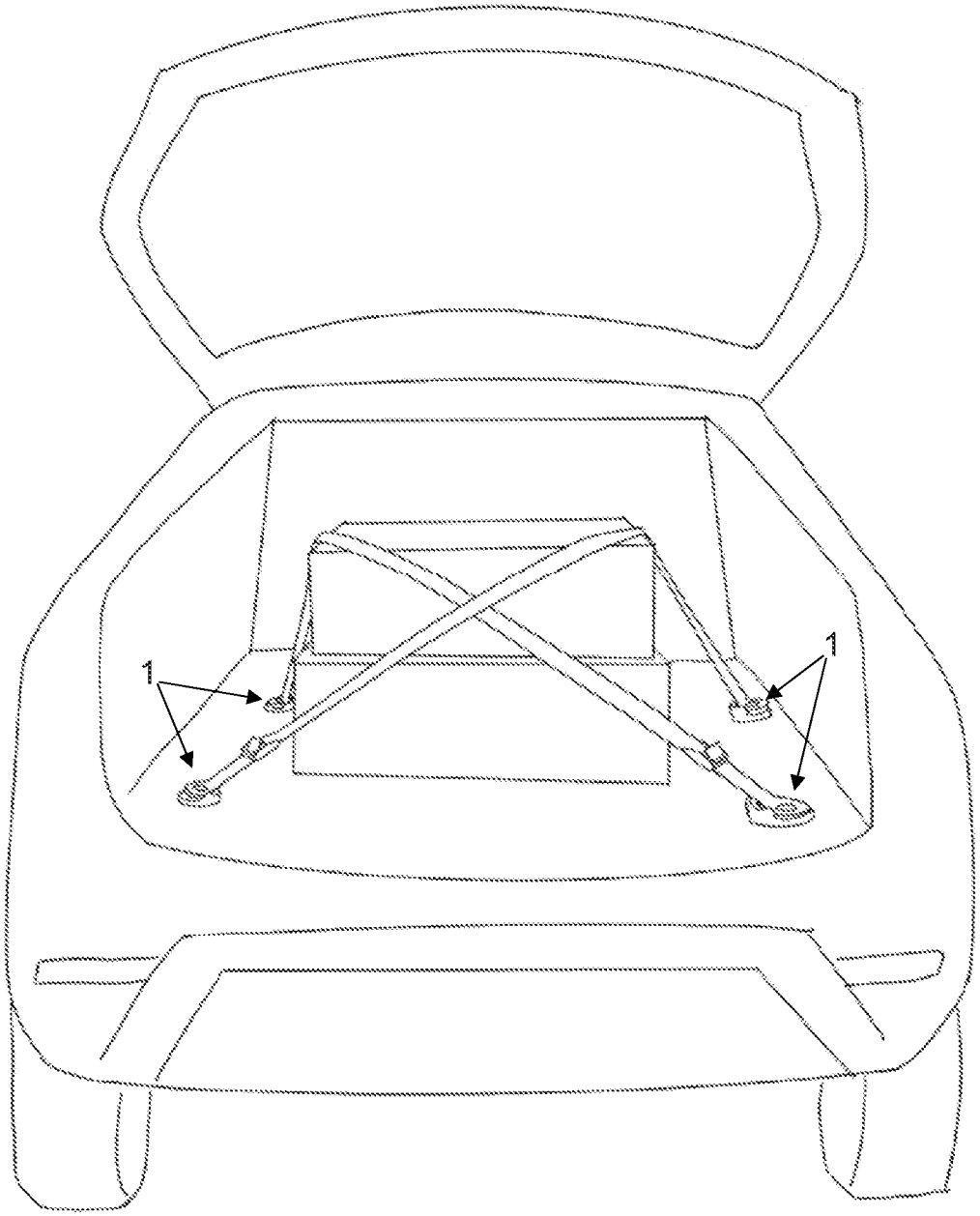

The connecting apparatus 1 can furthermore provide a fastener for a strap system for stowing luggage in a vehicle, for example a passenger vehicle (FIG. 53).

Figure 54:
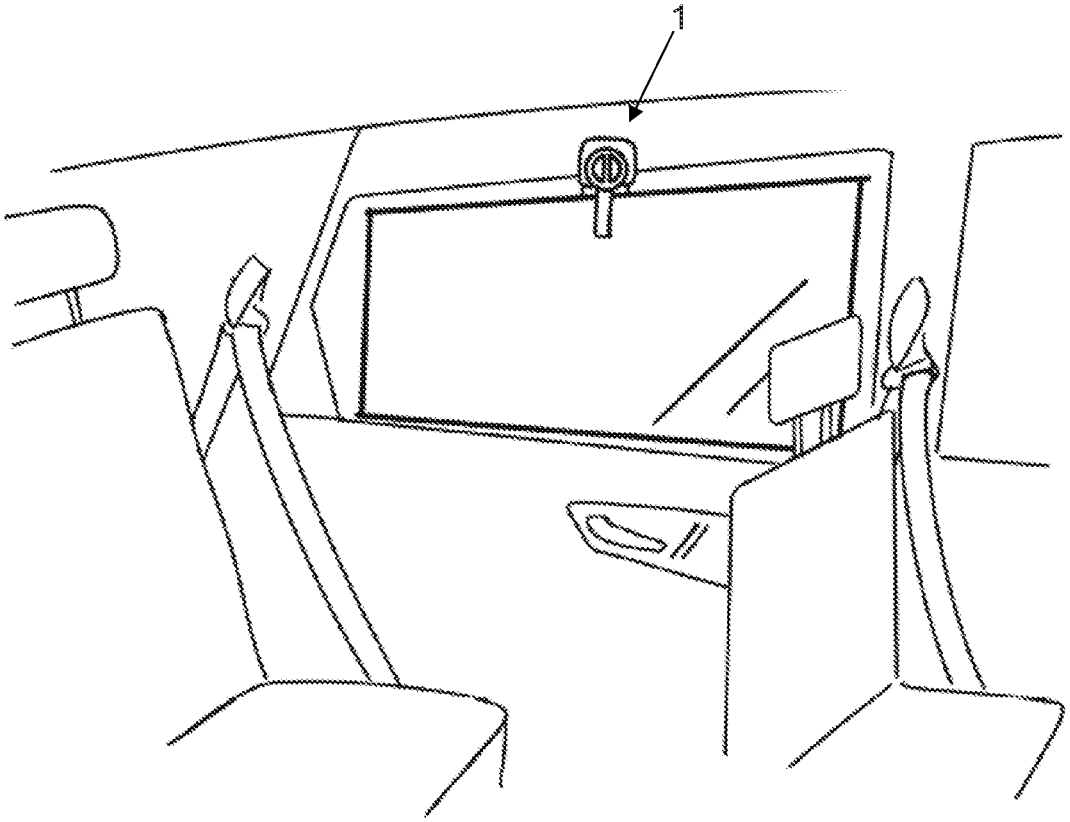

The connecting apparatus 1 can be provided as a fastener for an adjustment system in the interior of a vehicle, for example for a sunblind (FIG. 54).

Figure 55:
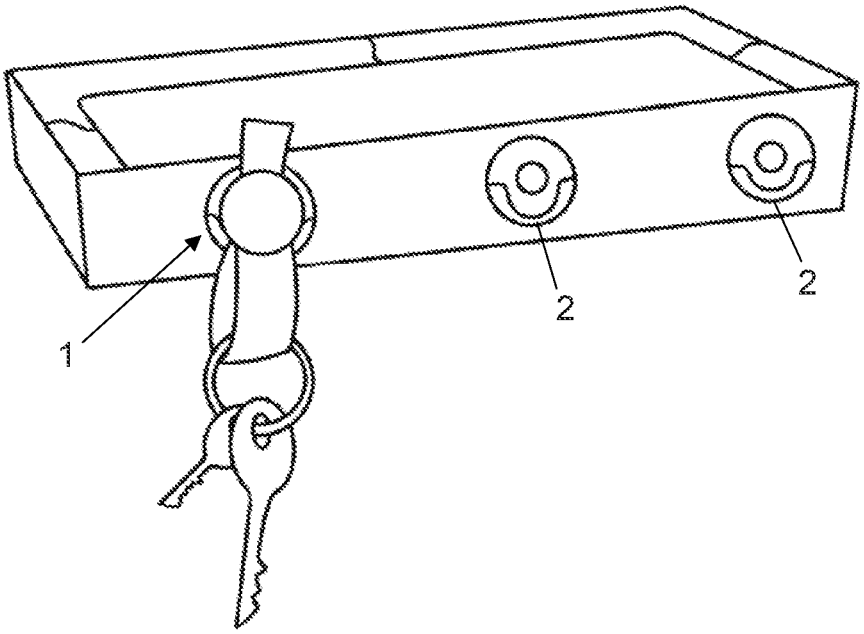

The connecting apparatus 1 can provide a holder for objects on a rack, for example for keyrings on a key holder (FIG. 55).

Figure 56:
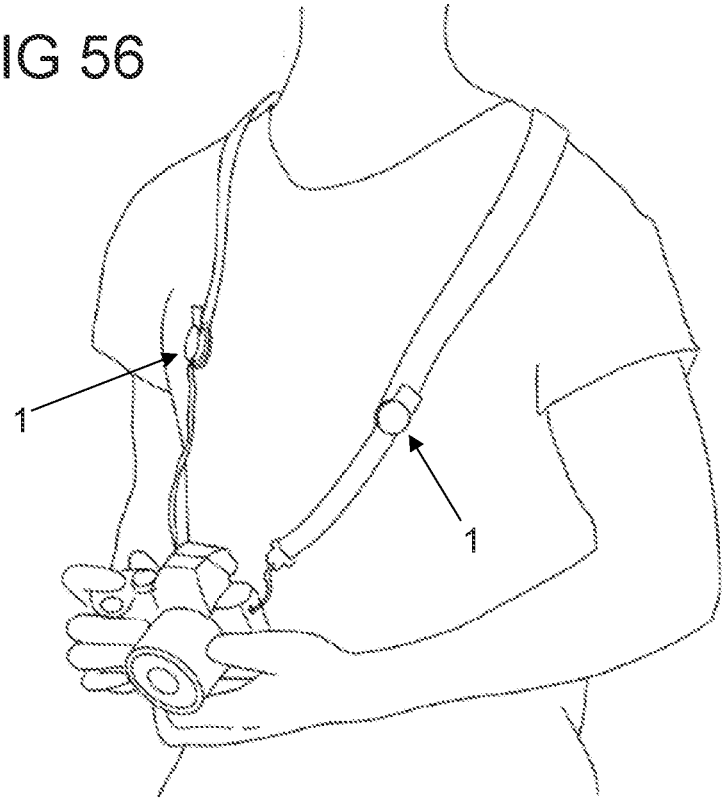
Figure 57:
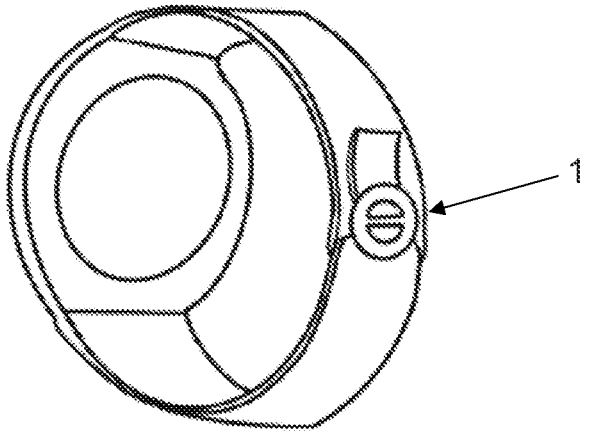

Connecting apparatuses 1 can be used as a holder for a camera, for example for connecting the camera to straps (FIG. 56).

Figure 58:
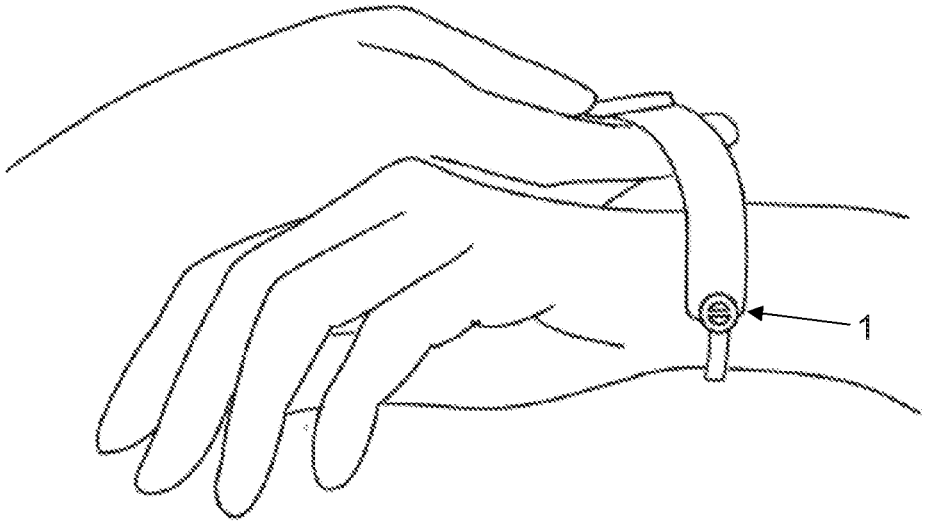

A connecting apparatus 1 can be used as a fastener for a wristwatch (FIG. 57) or a wristband (FIG. 58).

In all of the applications mentioned, the rotatability of the connecting parts 2, 3 solves important aspects required by the particular application. Conventional buckles, as are frequently used for such applications, are not rotatable.

Other application possibilities are conceivable and possible.

The concept underlying the solution is not restricted to the exemplary embodiments illustrated, but can also be realized in a different way.

In particular, a connecting apparatus of the described type can be used not only as a webbing fastener for connecting basic ends or as an object fastening device. A connecting apparatus of the described type can be used for connecting entirely random assemblies to one another.

LIST OF DESIGNATIONS

1 Connecting apparatus
2 Connecting part (female part)
20 Basic body
21 Magnetic device
22 Webbing receptacle
23 Receiving opening
230 Bottom surface
231 Recess
232 Entry opening
233 Support portion
234 Step
235 Run-on slope
236 Blocking portion (boundary wall)
237 Transition surface
238 Blocking portion
24 Engagement device
240, 241 Engagement protrusion
242, 243 Raised portion
244, 245 Sliding slope
25 Fastening opening
3 Connecting part (male part)
30 Basic body
300 Base portion
301 Fastening portion
302 Base surface
303 Blocking element (collar)
304 Edge
305 Edge portion
306 Outlet line
31 Magnetic device
32 Webbing receptacle
34 Engagement device
340 Pin element
341 Engagement portion
342 Oblique surface (cone)
35 Fastening opening
4 Strap or belt
40 Actuating portion
5 Strap or belt
A Sliding-off movement
B Axis
H Vertical direction
K Tilting axis
N Normal direction
Q Transverse direction
R Axis of rotation
U Circumferential direction
X Closing direction
Y Engagement direction

The invention claimed is:

1. A connecting apparatus, comprising a first connecting part, which has a first basic body and at least one engagement protrusion arranged rigidly on the first basic body, and a second connecting part, which is attachable to the first connecting part in a closing direction and which has a second basic body with an engagement portion arranged rigidly on the second basic body, wherein the engagement portion can be brought along an engagement direction which is different from the closing direction into engagement with the at least one engagement protrusion of the first connecting part such that, in a connected position of the first connecting part and the second connecting part, the engagement portion is in engagement with the at least one engagement protrusion of the first connecting part, wherein the first connecting part has a first magnetic device and the second connecting part has a second magnetic device, wherein the first magnetic device and the second magnetic device interact in a magnetically attracting manner along the closing direction to assist attachment of the first connecting part and the second connecting part to each other, wherein the first connecting part has a blocking portion which is arranged rigidly on the first basic body and which is designed, in the connected position, to interact with the second connecting part in order to block the engagement of the engagement portion with the at least one engagement protrusion counter to the engagement direction, wherein, in the connected position, the second connecting part is rotatable about the closing direction with respect to the first connecting part and, in an event of rotation, the engagement of the engagement portion with the at least one engagement protrusion and blocking of the engagement by the blocking portion remain, and wherein the second connecting part is tiltable with respect to the first connecting part in order, for separating the first connecting part and the second connecting part from each other, to remove the blocking counter to the engagement direction and to permit disengagement of the engagement portion and the at least one engagement protrusion.

2. The connecting apparatus according to claim 1, wherein the second connecting part, for tilting relative to the first connecting part, can be lifted off the first connecting part counter to the closing direction on a side facing away from the at least one engagement protrusion.

3. The connecting apparatus according to claim 1, wherein the second connecting part has an actuating portion which is actuable for tilting the second connecting part relative to the first connecting part.

4. The connecting apparatus according to claim 1, wherein the engagement portion extends circumferentially about the closing direction.

5. The connecting apparatus according to claim 4, wherein the engagement portion is formed rotationally symmetrically with respect to the closing direction.

6. The connecting apparatus according to claim 1, wherein the second basic body of the second connecting part has a base portion which forms the engagement portion or with respect to which the engagement portion is spaced apart along the closing direction.

7. The connecting apparatus according to claim 6, wherein the base portion has an edge portion and the first connecting part has a support portion formed rigidly on the first basic body, wherein, in the connected position, the edge portion of the base portion is supported on the support portion for load absorption along the engagement direction in addition to the engagement of the engagement portion and the at least one engagement protrusion.

8. The connecting apparatus according to claim 7, wherein the support portion, as viewed along the closing direction, is spaced apart from the at least one engagement protrusion.

9. The connecting apparatus according to claim 7, wherein the support portion, as viewed along the engagement direction, is spaced apart from the at least one engagement protrusion.

10. The connecting apparatus according to claim 7, wherein the support portion is formed by a surface portion which is directed parallel or obliquely to the closing direction.

11. The connecting apparatus according to claim 6, wherein the first basic body has a positive locking portion on which the base portion lies in the connected position of the first connecting part and the second connecting part in order to counteract tilting of the second connecting part relative to the first connecting part.

12. The connecting apparatus according to claim 6, wherein, for tilting the second connecting part relative to the first connecting part, the base portion can be tilted with respect to the first connecting part about a tilting axis perpendicular to the closing direction and to the engagement direction.

13. The connecting apparatus according to claim 6, wherein the first basic body has an entry opening in which a portion of the base portion enters when the second connecting part is tilted in the closing direction relative to the first connecting part.

14. The connecting apparatus according to claim 1, wherein the second connecting part has a blocking element, which is arranged rigidly on the second basic body, for interaction with the blocking portion of the first connecting part.

15. The connecting apparatus according to claim 14, wherein, in the connected position, the blocking element is rotatable about the closing direction relative to the blocking portion of the first connecting part, wherein, in the event of rotation, the blocking of the engagement of the engagement portion with the at least one engagement protrusion remains.

16. The connecting apparatus according to claim 1, wherein the at least one engagement protrusion has a sliding slope which extends obliquely to the closing direction and is designed to guide the second connecting part, during attachment to the first connecting part, along the closing direction on the at least one engagement protrusion in such a manner that the second connecting part is offset with respect to the first connecting part counter to the engagement direction and, as a result, is guided past the at least one engagement protrusion and, after it moves past, the engagement portion can be brought in the engagement direction into engagement with the at least one engagement protrusion.

17. A webbing fastener comprising the connecting apparatus according to claim 1.

18. The webbing fastener according to claim 17, further comprising a strap or belt which is connected to the second connecting part, wherein the strap or belt is connected fixedly and nonadjustably to the second connecting part.

19. The webbing fastener according to claim 18, wherein the first connecting part has two engagement protrusions which are spaced apart from each other in such a manner that, in the connected position of the first connecting part and the second connecting part, the belt or strap can be guided through between the engagement protrusions.

20. An object fastening device for fastening an object to an assembly, comprising the connecting apparatus according to claim 1, wherein the object is arranged on one of the connecting parts and the other of the connecting parts is arranged on the assembly.

* * * * *